US010118402B2

(12) United States Patent
Ueda et al.

(10) Patent No.: US 10,118,402 B2
(45) Date of Patent: Nov. 6, 2018

(54) VALVE OPENING/CLOSING MECHANISM, INK SUPPLY SYSTEM, AND INK JET PRINTER

(71) Applicant: Roland DG Corporation, Hamamatsu-shi, Shizuoka (JP)

(72) Inventors: Naoki Ueda, Hamamatsu (JP); Kazuya Morizono, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/831,456

(22) Filed: Dec. 5, 2017

(65) Prior Publication Data

US 2018/0154649 A1 Jun. 7, 2018

(30) Foreign Application Priority Data

Dec. 6, 2016 (JP) ..... 2016-236888

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01); *B41J 2/175* (2013.01); *B41J 2202/12* (2013.01)

(58) Field of Classification Search
CPC . B41J 2/17596; B41J 2/18; B41J 2/175; B41J 2202/12
See application file for complete search history.

(56) References Cited

U.S. PATENT DOCUMENTS

2008/0122902 A1* 5/2008 Tanaka ..... B41J 2/17509 347/85
2008/0158283 A1* 7/2008 Tsai ..... B41J 2/17509 347/20

FOREIGN PATENT DOCUMENTS

JP 2008-012819 A 1/2008

* cited by examiner

*Primary Examiner* — Geoffrey S Mruk
(74) *Attorney, Agent, or Firm* — Keating & Bennett, LLP

(57) ABSTRACT

A valve opening/closing mechanism includes a rotating shaft, first and second cams provided on the rotating shaft and rotatable together with the rotating shaft, first and second valves, and a rotating mechanism that rotates the rotating shaft. The first and second valves each include a flow channel in which ink flows and an opening/closing member at a position at which the opening/closing member contacts the first or second cam, so as to open or close the flow channel, depending on whether the opening/closing member is in contact with the cam. When the rotating shaft is rotated by the rotating mechanism, rotating positions of the first and second cams are at any of first, second, third or fourth positions.

16 Claims, 27 Drawing Sheets

VALVE OPENING/CLOSING MECHANISM, INK SUPPLY SYSTEM, AND INK JET PRINTER

CROSS REFERENCE TO RELATED APPLICATION

This application claims the benefit of priority to Japanese Patent Application No. 2016-236888 filed on Dec. 6, 2016. The entire contents of this application are hereby incorporated herein by reference.

BACKGROUND OF THE INVENTION

1. Field of the Invention

The present invention relates to a valve opening/closing mechanism, an ink supply system including the valve opening/closing mechanism, and an ink jet printer including the ink supply system.

2. Description of the Related Art

Japanese Patent Application Publication No. 2008-12819 discloses an ink jet printer that includes an ink jet head which is an example of an ink head that injects ink and a main tank which is an example of an ink tank in which ink to be supplied to the ink jet head is stored. In this ink jet printer, ink is injected from the ink jet head toward a recording medium whereby printing is performed with respect to the recording medium.

In the ink jet printer disclosed in Japanese Patent Application Publication No. 2008-12819, the main tank is connected to a sub-tank via an ink replenishing channel. The sub-tank and the ink jet head are connected to a first ink circulation channel through which ink is supplied from the sub-tank to the ink jet head and a second ink circulation channel through which ink is returned from the ink jet head to the sub-tank. A bypass channel is connected to the first ink circulation channel. A valve is provided in the bypass channel. One end of a first waste liquid channel is connected to the valve. A waste tank is connected to the other end of the first waste liquid channel. For example, by opening the valve so that the bypass channel communicates with the first waste liquid channel, it is possible to cause ink to flow into the waste tank.

A mechanism that includes the main tank, the ink jet head, and a flow channel that connects the main tank and the ink jet head, and the valve will be referred to as an ink supply mechanism. The number of ink supply mechanisms is the number of main tanks. The valve is provided in respective ink supply mechanisms. Due to this, a plurality of valves is provided in an ink jet printer in which a plurality of ink supply mechanisms is provided. For example, there may be a case in which ink is to be discharged to a waste tank using predetermined ink supply mechanisms among a plurality of ink supply mechanisms. In this case, the valves in respective ink supply mechanisms are controlled to open and close the valves. Therefore, valve control is sometimes complex.

SUMMARY OF THE INVENTION

Preferred embodiments of the present invention provide valve opening/closing mechanisms which control opening/closing of a plurality of valves without complex control and also provide ink supply systems and ink jet printers.

A valve opening/closing mechanism according to a preferred embodiment of the present invention includes a rotating shaft, a first cam, a first valve, a second cam, a second valve, and a rotating mechanism. The first cam is provided on the rotating shaft so as to rotate together with the rotating shaft. The first valve includes a first flow channel in which ink flows and a first opening/closing member that is disposed at a position at which the first opening/closing member contacts with the first cam so as to open or close the first flow channel, depending on whether the first opening/closing member makes contact with the first cam. The second cam is provided on the rotating shaft so as to rotate together with the rotating shaft. The second valve includes a second flow channel in which ink flows and a second opening/closing member that is disposed at a position at which the second opening/closing member contacts with the second cam so as to open or close the second flow channel depending on whether the second opening/closing member makes contact with the second cam. The rotating mechanism rotates the rotating shaft. The rotating positions of the first and second cams, when the first opening/closing member opens the first flow channel and the second opening/closing member opens the second flow channel, are defined as a first position. The rotating positions of the first and second cams, when the first opening/closing member closes the first flow channel and the second opening/closing member closes the second flow channel, are defined as a second position. The rotating positions of the first and second cams, when the first opening/closing member opens the first flow channel and the second opening/closing member closes the second flow channel, are defined as a third position. The rotating positions of the first and second cams, when the first opening/closing member closes the first flow channel and the second opening/closing member opens the second flow channel, are defined as a fourth position. When the rotating shaft is rotated by the rotating mechanism, the rotating positions of the first and second cams are at any one of the first, second, third, and fourth positions.

According to the valve opening/closing mechanism, when the rotating shaft is rotated by the rotating mechanism, the first and second cams rotate together. By rotation of the rotating shaft, the rotating positions of the first and second cams are able to be any one of the first to fourth positions. For example, when the flow channel of the first valve is to be open and the flow channel of the second valve is to be closed, the rotating shaft may be rotated so that the rotating positions of the first and second cams are at the third position. Therefore, it is possible to control opening and closing of the flow channel of the first valve and opening and closing of the flow channel of the second valve by rotating the first and second cams with a simple operation of rotating the rotating shaft. Therefore, according to the valve opening/closing mechanism, it is possible to control opening and closing of a plurality of valves without complex control.

According to various preferred embodiments of the present invention, it is possible to provide valve opening/closing mechanisms which control opening/closing of a plurality of valves without complex control.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
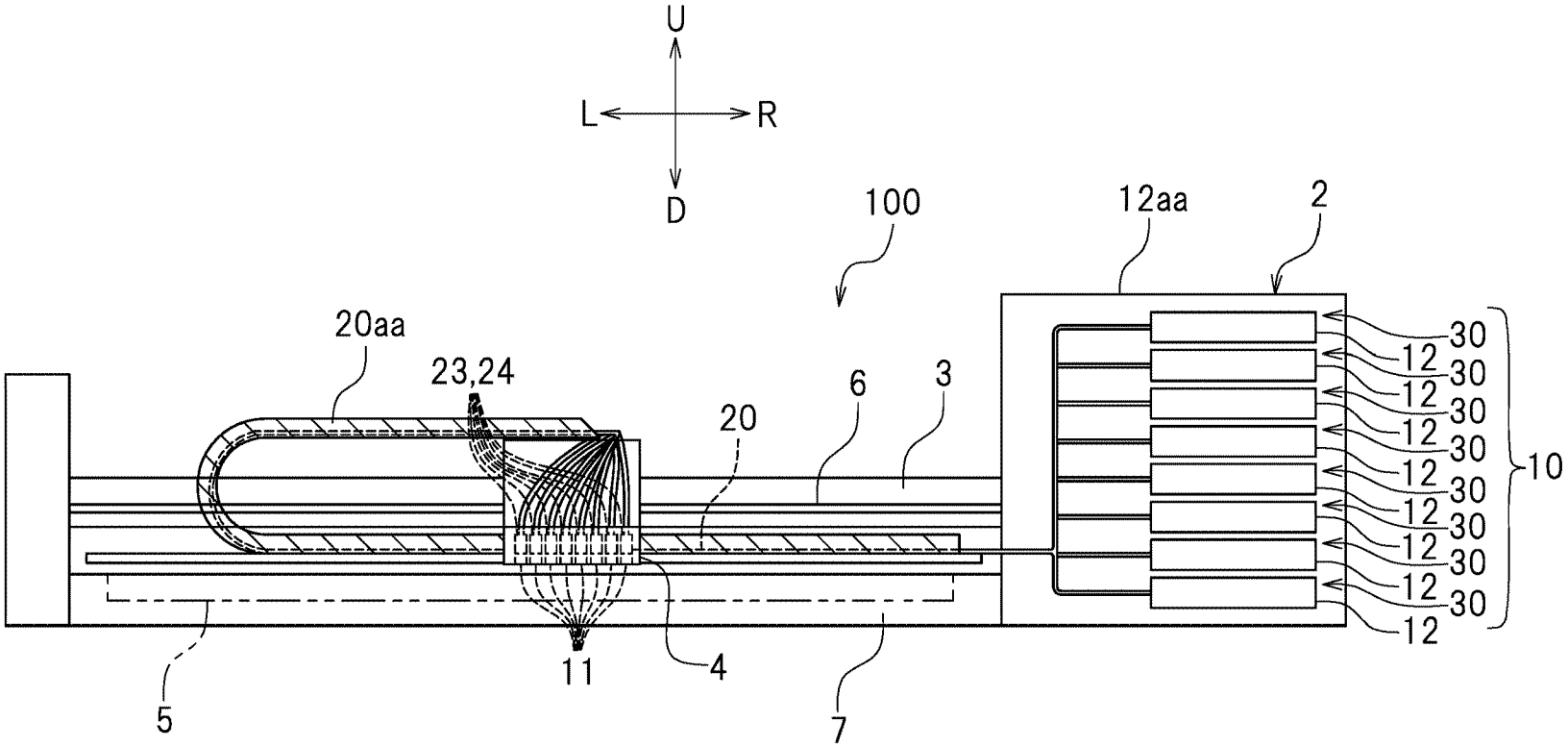
FIG. 1 is a front view illustrating a printer according to a preferred embodiment of the present invention.

Hereinafter, preferred embodiments of ink supply systems each including a valve opening/closing mechanism according to a preferred embodiment of the present invention and ink jet printers each including an ink supply system according to a preferred embodiment of the present invention will be described with reference to the drawings. The preferred embodiments described herein is not naturally intended to limit the present invention particularly. Moreover, members or portions that perform the same operations will be denoted by the same reference numerals, and redundant description thereof will be appropriately omitted or simplified.

FIG. 1 is a front view of an ink jet printer 100 according to the present preferred embodiment. Hereinafter, the ink jet printer 100 will be referred to as a printer 100. The printer 100 preferably is an ink jet-type printer. In the present preferred embodiment, the "ink jet type" refers to an ink jet type that follows a method including various continuous systems such as a binary deflection system and a continuous deflection system and various on-demand systems such as a thermal system and a piezoelectric system. In the following description, symbols F, Rr, L, R, U, and D in the drawings mean, respectively, the front, rear, left, right, up, and down directions when the printer 100 is seen from the front surface. However, the directions are directions defined for the sake of convenience and do not limit an installation aspect of the printer 100.

As illustrated in FIG. 1, the printer 100 preferably performs printing on a recording medium 5. In the present preferred embodiment, the recording medium 5 is a roll-shaped recording paper. The recording medium 5 is a so-called rolled paper. However, the recording medium 5 is not limited to a roll-shaped recording paper. For example, the recording medium 5 may be a sheet formed of a resin. Moreover, the recording medium 5 is not limited to a flexible sheet. For example, the recording medium 5 may be a rigid medium formed of a glass substrate. In the present preferred embodiment, a material that forms the recording medium 5 is not particularly limited.

In the present preferred embodiment, the printer 100 includes a printer body 2 and a guide rail 3 fixed to the printer body 2. For example, the guide rail 3 extends in a left-right direction. In this example, a carriage 4 engages with the guide rail 3. The carriage 4 can slide along the guide rail 3. Although not illustrated in the drawings, a roller is provided on each of left and right end sides of the guide rail 3. A carriage motor (not illustrated) is connected to any one of these rollers. One roller connected to the carriage motor is rotated by the carriage motor. In this example, an endless belt 6 is wound around the rollers provided on both end sides of the guide rail 3. The carriage 4 is fixed to the belt 6. When the carriage motor is driven, the rollers rotates and the belt 6 travels. When the belt 6 travels, the carriage 4 moves in the left-right direction. In this manner, the carriage 4 is able to move in the left-right direction along the guide rail 3.

In the present preferred embodiment, a platen 7 on which the recording medium 5 is placed is provided in the printer body 2. The platen 7 supports the recording medium 5 when printing is performed with respect to the recording medium 5. A pair of upper grit roller (not illustrated) and lower pinch roller (not illustrated) are provided in the platen 7. A feed motor (not illustrated) is coupled to the grit roller. The grit roller is rotated by the feed motor. The grit roller rotates in a state in which the recording medium 5 is pinched between the grit roller and the pinch roller such that the recording medium 5 is conveyed in a front-rear direction.

In the present preferred embodiment, the printer 100 includes an ink supply system 10. The ink supply system 10 includes a plurality of ink supply mechanisms 30, an inlet valve opening/closing mechanism 26, an outlet valve opening/closing mechanism 27, and a controller 55 (see FIG. 16). The ink supply mechanism 30 is a system that supplies ink from an ink tank 12 toward an ink head 11. Moreover, the ink supply mechanism 30 circulates ink supplied to the ink head 11. The ink supply mechanism 30 is provided in each ink head 11. In other words, the ink supply mechanism 30 is provided in each ink tank 12. In the present preferred embodiment, the number of ink heads 11 and the number of ink tanks 12 preferably are "8", respectively, for example. Due to this, the number of ink supply mechanisms 30 preferably is "8", for example. However, the number of ink heads 11, the number of ink tanks 12, and the number of ink supply mechanisms 30 are not particularly limited. The plurality of ink supply mechanisms 30 have the same configuration. Due to this, the configuration of one ink supply mechanism 30 will be described in detail.

Figure 2:
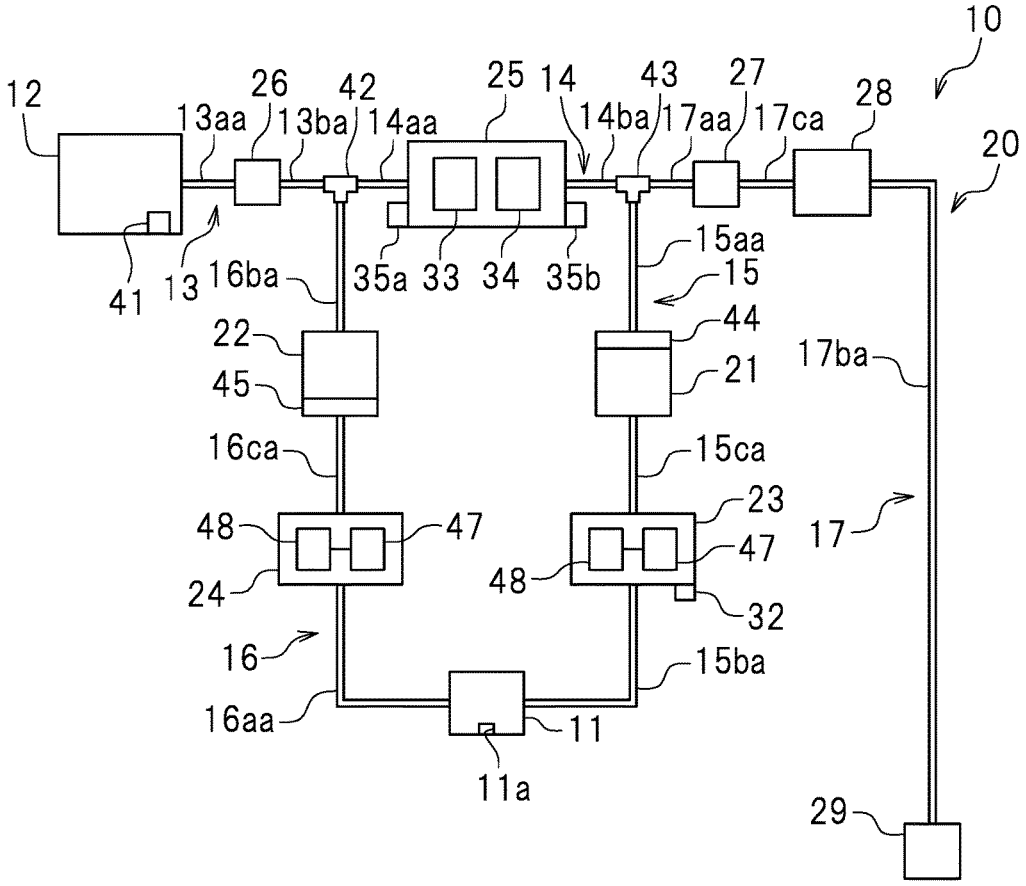
FIG. 2 is a schematic diagram illustrating an ink supply mechanism.

FIG. 2 is a schematic diagram illustrating the ink supply mechanism 30. As illustrated in FIG. 2, the ink supply mechanism 30 includes the ink head 11, the ink tank 12, an ink flow channel 20, an upstream pump 21, a downstream pump 22, an upstream damper 23, a downstream damper 24, an air trap 25, and an outlet pump 28. In the following description, a side on which ink flows into the ink head 11 is referred to as an upstream side. A side on which ink flows out of the ink head 11 is referred to a downstream side.

As illustrated in FIG. 1, the ink head 11 injects ink to the recording medium 5 placed on the platen 7. As illustrated in FIG. 2, a nozzle 11*aa* through which ink is injected is provided on a bottom surface of the ink head 11. As illustrated in FIG. 1, the ink head 11 is mounted on the carriage 4. The ink head 11 can move in the left-right direction along the guide rail 3 by the carriage 4. Specifically, when the carriage motor that causes the belt 6 to travel is driven, the ink head 11 moves in the left-right direction together with the carriage 4.

Figure 3:
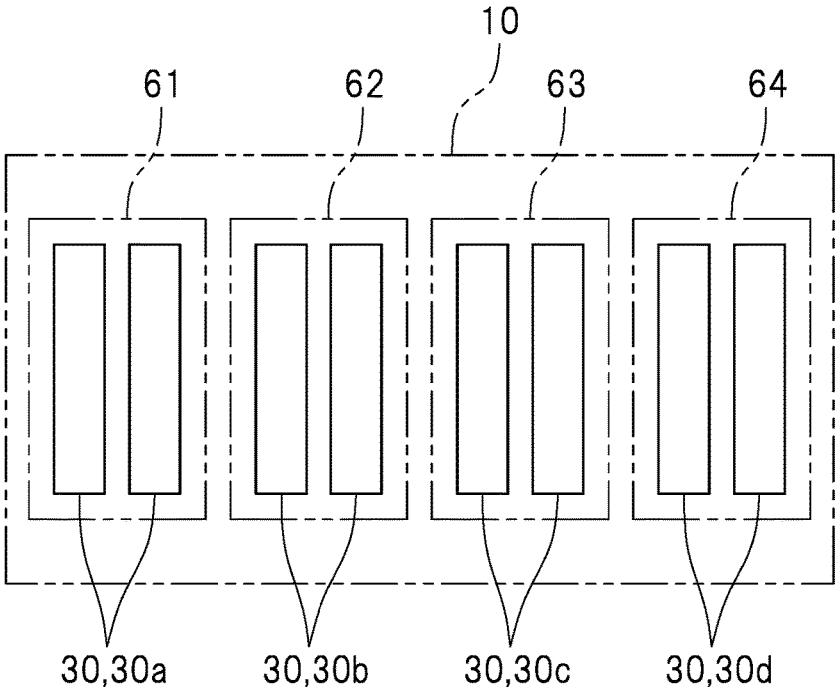
FIG. 3 is a conceptual diagram of an ink supply system.

The ink tank 12 is structured to store ink. In the present preferred embodiment, the number of ink tanks 12 is preferably the same as the number of the ink head 11, for example. In this example, the number of ink tanks 12 is "8", for example. One ink head 11 is connected to one ink tank 12. However, a plurality of ink tanks 12 may be connected to one ink head 11. The ink stored in the ink tank 12 is supplied to the ink head 11. The ink stored in one ink tank 12 is any one of process color ink such as cyan ink, magenta ink, yellow ink, light cyan ink, light magenta ink, and black ink and spot color ink such as white ink, metallic ink, and clear ink. In the present preferred embodiment, ink of the same color is stored in two ink tanks 12 among the eight ink tanks 12. FIG. 3 is a conceptual diagram of the ink supply system 10. As illustrated in FIG. 3, for example, the eight ink supply mechanisms 30 can be subdivided into four groups of a first group 61, a second group 62, a third group 63, and a fourth group 64. It is assumed that two ink supply mechanisms 30 belong to each group. In this case, for example, cyan ink is stored in the ink tank 12 of the ink supply mechanism 30 belonging to the first group 61. Magenta ink is stored in the ink tank 12 of the ink supply mechanism 30 belonging to the second group 62. Yellow ink is stored in the ink tank 12 of the ink supply mechanism 30 belonging to the third group 63. Black ink is stored in the ink tank 12 of the ink supply mechanism 30 belonging to the fourth group 64. However, different ink may be stored in the plurality of ink tanks 12. Although not illustrated in the drawings, an ink outlet port (not illustrated) is provided in the ink tank 12. In the present preferred embodiment, for example, cyan ink corresponding to "first ink". For example, magenta ink corresponds to "second ink".

In the present preferred embodiment, as illustrated in FIG. 1, the ink tank 12 is provided so as to be detachably attached to the printer body 2. Specifically, for example, an accommodation section 12*aa* is provided in the printer body 2. The plurality of ink tanks 12 is accommodated in the accommodation section 12*aa*. However, an arrangement position of the ink tanks 12 is not particularly limited. For example, the ink tank 12 may be provided so as to be detachably attached to the carriage 4.

As illustrated in FIG. 2, a detection sensor 41 that detects the amount of ink stored in the ink tank 12 may be provided in the ink tank 12. The type of the detection sensor 41 is not particularly limited. For example, the detection sensor 41 may be a photo-interrupter. The detection sensor 41 detects, for example that the amount of ink stored in the ink tank 12 corresponds to a predetermined storage amount.

The ink flow channel 20 is a flow channel through which ink stored in the ink tank 12 is supplied to the ink head 11 and a flow channel through which ink in the ink head 11 circulates. As illustrated in FIG. 1, in the present preferred embodiment, at least a portion of the ink flow channel 20 is covered by a cable protection and guiding device 20*aa*. The cable protection and guiding device 20*aa* is a cableveyor (registered trademark), for example. As illustrated in FIG. 2, the ink flow channel 20 includes the inlet flow channel 13, a connection flow channel 14, an upstream flow channel 15, a downstream flow channel 16, and an outlet flow channel 17.

The inlet flow channel 13 is a flow channel through which ink stored in the ink tank 12 is supplied to the connection flow channel 14. One end of the inlet flow channel 13 is detachably connected to the ink tank 12. The other end of the inlet flow channel 13 is connected to the connection flow channel 14. In the present preferred embodiment, the inlet flow channel 13 includes a first inlet section 13*aa* and a second inlet section 13*ba*. One end of the inlet flow channel 13 is included in the first inlet section 13*aa*. The first inlet section 13*aa* is detachably connected to the ink tank 12. The first inlet section 13*aa* is structured so that, when the ink tank 12 is detached from the one end of the inlet flow channel 13, ink does not leak from one end of the inlet flow channel 13. The other end of the inlet flow channel 13 is included in the second inlet section 13*ba*. The second inlet section 13*ba* is connected to the connection flow channel 14.

The connection flow channel 14 is a flow channel through which ink supplied to the inlet flow channel 13 is supplied to the upstream flow channel 15. The connection flow channel 14 is a flow channel that connects the inlet flow channel 13 and the upstream flow channel 15. One end of the connection flow channel 14 is connected to the other end of the inlet flow channel 13. In the present preferred embodiment, a three-way valve 42 is provided at one end of the connection flow channel 14. One end of the connection flow channel 14 is connected to the other end of the inlet flow channel 13 via the three-way valve 42. The other end of the connection flow channel 14 is connected to the upstream flow channel 15. In this example, the connection flow channel 14 has a first connection section 14*aa* and a second connection section 14*ba*. One end of the connection flow channel 14 is included in the first connection section 14*aa*. The first connection section 14*aa* is connected to the second inlet section 13*ba* via the three-way valve 42. The other end of the connection flow channel 14 is included in the second connection section 14*ba*. The second connection section 14*ba* is connected to the upstream flow channel 15.

The upstream flow channel 15 is a flow channel through which ink supplied to the connection flow channel 14 is supplied to the ink head 11. One end of the upstream flow channel 15 is connected to the other end of the connection flow channel 14. In this example, a three-way valve 43 is provided at one end of the upstream flow channel 15. One end of the upstream flow channel 15 is connected to the other end of the connection flow channel 14 via the three-way valve 43. The other end of the upstream flow channel 15 is connected to the ink head 11. In the present preferred embodiment, the upstream flow channel 15 includes a first upstream section 15*aa*, a second upstream section 15*ba*, and an upstream middle section 15*ca*. One end of the upstream flow channel is included in the first upstream section 15*aa*. The first upstream section 15*aa* is connected to the second connection section 14*ba* via the three-way valve 43. The other end of the upstream flow channel 15 is included in the second upstream section 15*ba*. The second upstream section 15*ba* is connected to the ink head 11. The upstream middle section 15*ca* is positioned between the first upstream section 15*aa* and the second upstream section 15*ba*. The upstream middle section 15*ca* is connected to the first upstream section 15*aa* and the second upstream section 15*ba*.

The downstream flow channel 16 is a flow channel through which ink in the ink head 11 flows out of the ink head 11. The downstream flow channel 16 is a flow channel through which ink in the ink head 11 flows into the connection flow channel 14. In this example, one end of the downstream flow channel 16 is connected to the ink head 11. The other end of the downstream flow channel 16 is connected to one end of the connection flow channel 14. Specifically, the other end of the downstream flow channel 16 is connected to one end of the connection flow channel 14 and the other end of the inlet flow channel 13 via the three-way valve 42. In the present preferred embodiment, the downstream flow channel 16 includes a first downstream section 16*aa*, a second downstream section 16*ba*, and a downstream middle section 16*ca*. One end of the downstream flow channel 16 is included in the first downstream section 16*aa*. The first downstream section 16*aa* is connected to the ink head 11. The other end of the downstream flow channel 16 is included in the second downstream section 16*ba*. The second downstream section 16*ba* is connected to the second inlet section 13*ba* and the first connection section 14*aa* via the three-way valve 42. The downstream middle section 16*ca* is positioned between the first downstream section 16*aa* and the second downstream section 16*ba*. The downstream middle section 16*ca* is connected to the first downstream section 16*aa* and the second downstream section 16*ba*.

The outlet flow channel 17 is a flow channel through which ink in the inlet flow channel 13, the connection flow channel 14, the upstream flow channel 15, and the downstream flow channel is discharged to the outside. One end of the outlet flow channel 17 is connected to the other end of the connection flow channel 14. Specifically, one end of the outlet flow channel 17 is connected to the other end of the connection flow channel 14 and one end of the upstream flow channel 15 via the three-way valve 43. In the present preferred embodiment, a waste tank 29 is connected to the other end of the outlet flow channel 17. The waste tank 29 is a tank to which ink flowing through the ink flow channel 20 and the like of the ink supply system 10 flows when the ink is discharged.

In the present preferred embodiment, the outlet flow channel 17 includes a first outlet section 17*aa*, a second outlet section 17*ba*, and an outlet middle section 17*ca*. One end of the outlet flow channel 17 is included in the first outlet section 17*aa*. The second connection section 14*ba* and the first upstream section 15*aa* are connected to the first outlet section 17*aa* via the three-way valve 43. The other end of the outlet flow channel is included in the second outlet section 17*ba*. The second outlet section 17*ba* is connected to the waste tank 29. The outlet middle section 17*ca* is positioned between the first outlet section 17*aa* and the second outlet section 17*ba*. The outlet middle section 17*ca* is connected to the first outlet section 17*aa* and the second outlet section 17*ba*.

In the present preferred embodiment, the ink flow channel 20 includes a flexible tube. Specifically, the inlet flow channel 13, the connection flow channel 14, the upstream flow channel 15, the downstream flow channel 16, and the outlet flow channel 17 include flexible tubes, for example. However, the types and the materials of the inlet flow channel 13, the connection flow channel 14, the upstream flow channel 15, the downstream flow channel 16, and the outlet flow channel 17 are not particularly limited.

The upstream pump 21 and the downstream pump 22 supply ink. The upstream pump 21 is a pump to supply ink toward the ink head 11. The upstream pump 21 adjusts the flow rate of ink flowing into the ink head 11. The downstream pump 22 is a pump to cause ink to flow into the connection flow channel 14 by causing ink flowing from the ink head 11 to circulate. The downstream pump 22 adjusts the flow rate of ink flowing out of the ink head 11. In the present preferred embodiment, the upstream pump 21 is provided in the upstream flow channel 15. Specifically, the upstream pump 21 is provided between the first upstream section 15*aa* and the upstream middle section 15*ca* of the upstream flow channel 15. The downstream pump 22 is provided in the downstream flow channel 16. Specifically, the downstream pump 22 is provided between the downstream middle section 16*ca* and the second downstream section 16*ba* of the downstream flow channel 16. In this example, the ink head 11 is disposed between the upstream pump 21 and the downstream pump 22. Due to this, when the flow rate of the ink is adjusted by the upstream pump 21, the pressure in a flow channel (in this example, the upstream flow channel 15) on the upstream side of the ink head 11 is adjusted. The pressure in a flow channel (in this example, the downstream flow channel 16) on the downstream side of the ink head 11 is adjusted by the downstream pump 22. In this manner, when the pressures on the upstream and downstream sides of the ink head 11 are adjusted, the pressure in the ink head 11 is adjusted. Ink is injected according to the pressure in the ink head 11.

In the present preferred embodiment, the type of the upstream pump 21 is the same as the type of the downstream pump 22. However, the upstream pump 21 may be a pump of a different type from the downstream pump 22. In this example, the upstream pump 21 and the downstream pump 22 are diaphragm pumps. However, the types of the upstream pump 21 and the downstream pump 22 are not particularly limited. Although not illustrated in the drawings, the upstream pump 21 and the downstream pump 22 each include a diaphragm that is elastically deformable and a pump motor that elastically deforms the diaphragm. When the pump motor is driven and the diaphragm is elastically deformed, the upstream pump 21 and the downstream pump 22 adjust the flow rate of ink. In the present preferred embodiment, the expressions "the upstream pump 21 is driven" and "the downstream pump 22 is driven" refer to a state in which the pump motor is driven and the diaphragm is elastically deformed.

In the present preferred embodiment, for example, an inlet port (not illustrated) into which ink flows is provided in the upstream pump 21. An upstream filter 44 to catch impurities such as dregs in the ink flow channel 20 may be provided in the inlet port of the upstream pump 21. In this way, it is possible to significantly reduce or prevent the occurrence of problems resulting from impurities entering into the upstream pump 21. Similarly, an inlet port (not illustrated) into which ink flows is provided in the downstream pump 22. A downstream filter 45 to catch impurities in the ink flow channel 20 may be provided in the inlet port of the downstream pump 22. In this way, it is possible to significantly reduce or prevent the occurrence of problems resulting from impurities entering into the downstream pump 22.

The upstream damper 23 and the downstream damper 24 are structured to alleviate a variation in the pressure of ink to stabilize an ink injection operation of the ink head 11. The upstream damper 23 detects the flow rate of ink flowing into the upstream damper 23. The driving of the upstream pump 21 is controlled on the basis of the flow rate detection result obtained by the upstream damper 23. The downstream damper 24 detects the flow rate of ink flowing into the downstream damper 24. The driving of the downstream pump 22 is controlled on the basis of the flow rate detection result obtained by the downstream damper 24.

In the present preferred embodiment, the upstream damper 23 is provided in the upstream flow channel 15. Specifically, the upstream damper 23 is provided in a portion of the upstream flow channel 15 positioned closer to the ink head 11 than the upstream pump 21. In the present preferred embodiment, the upstream damper 23 is provided between the upstream middle section 15*ca* and the second upstream section 15*ba* of the upstream flow channel 15. The downstream damper 24 is provided in the downstream flow channel 16. Specifically, the downstream damper 24 is provided in a portion of the downstream flow channel 16 positioned closer to the ink head 11 than the downstream pump 22. In the present preferred embodiment, the downstream damper 24 is provided between the first downstream section 16*aa* and the downstream middle section 16*ca* of the downstream flow channel 16.

In the present preferred embodiment, for example, the upstream damper 23 and the downstream damper 24 each include an ink storing chamber 47 in which ink is stored and a detection sensor 48 that detects whether the amount of ink stored in the ink storing chamber 47 is equal to or smaller than a predetermined storage amount. For example, the detection sensor 48 may be a photo-interrupter. For example, in the upstream damper 23, when the detection sensor 48 detects that the storage amount of ink in the ink storing chamber 47 is equal to or smaller than the predetermined storage amount, the driving of the upstream pump 21 is controlled so that the flow rate of ink in the upstream pump 21 is increased. Moreover, in the upstream damper 23, when the storage amount of ink in the ink storing chamber 47 is larger than the predetermined storage amount, the driving of the upstream pump 21 is controlled so that the flow rate of ink in the upstream pump 21 is decreased.

Similarly, in the downstream damper 24, when the detection sensor 48 detects that the storage amount of ink in the ink storing chamber 47 is equal to or smaller than the predetermined storage amount, the driving of the downstream pump 22 is controlled so that the flow rate of ink in the downstream pump 22 is increased. Moreover, in the downstream damper 24, when the storage amount of ink in the ink storing chamber 47 is larger than the predetermined storage amount, the driving of the downstream pump 22 is controlled so that the flow rate of ink in the downstream pump 22 is decreased.

The upstream damper 23 and the downstream damper 24 may be provided in one damper body (not illustrated). In this case, the upstream damper 23 and the downstream damper 24 may be provided in the damper body so that portions that define the upstream damper 23 do not overlap portions that define the downstream damper 24. For example, the damper body is provided on an upper surface of the ink head 11. The damper body is mounted on the carriage 4. That is, as illustrated in FIG. 1, the upstream damper 23 and the downstream damper 24 are mounted on the carriage 4 together with the ink head 11. The upstream damper 23 and the downstream damper 24 are disposed above the ink head 11.

A damper filter (not illustrated) to catch impurities such as dregs in the ink flow channel 20 may be provided in the upstream damper 23. In this way, it is possible to significantly reduce or prevent impurities included in ink from flowing into the ink head 11 and the second upstream section 15*ba* of the upstream flow channel 15. Moreover, as illustrated in FIG. 2, a thermistor 32 that detects the temperature of ink in the upstream flow channel 15 may be provided in the upstream damper 23.

The air trap 25 is structured to trap air contained in the ink supply system 10 and discharge the air trapped in the air trap 25 to the outside. The air trap 25 is provided in the connection flow channel 14. Specifically, the air trap 25 is provided between the first connection section 14*aa* and the second connection section 14*ba* of the connection flow channel 14. For example, the air trap 25 includes an ink pouch 33 in which ink and air in the air are accumulated and a discharge mechanism 34 that discharges ink in the ink pouch 33 to the outside. In this example, the expression "the air trap 25 is stopped" refers to a state in which air in the air trap 25 is not discharged but air is trapped in the air trap 25. The expression "the air trap 25 is driven" refers to a state in which air trapped in the air trap 25 is discharged to the outside.

In the present preferred embodiment, a thermistor 35*a* and a heater 35*b* may be provided in the air trap 25. The thermistor 35*a* detects the temperature of ink in the ink pouch 33 of the air trap 25. The heater 35*b* heats the ink in the ink pouch 33 of the air trap 25.

Next, the inlet valve opening/closing mechanism 26 and the outlet valve opening/closing mechanism 27 will be described. The inlet valve opening/closing mechanism 26 opens and closes the inlet flow channel 13. When the inlet valve opening/closing mechanism 26 opens the inlet flow channel 13, the ink stored in the ink tank 12 is able to be supplied to the ink head 11. When the inlet valve opening/closing mechanism 26 closes the inlet flow channel 13, the ink stored in the ink tank 12 cannot flow into the ink head 11. In the present preferred embodiment, the inlet valve opening/closing mechanism 26 is provided in the inlet flow channel 13. Specifically, the inlet valve opening/closing mechanism 26 is provided between the first inlet section 13*aa* and the second inlet section 13*ba* of the inlet flow channel 13.

The outlet valve opening/closing mechanism 27 is a valve that opens and closes the outlet flow channel 17. When the outlet valve opening/closing mechanism 27 opens the outlet flow channel 17, the ink in the ink flow channel 20 is able to be discharged to the outside. When the outlet valve opening/closing mechanism 27 closes the outlet flow channel 17, the ink in the ink flow channel 20 cannot be discharged to the outside. In the present preferred embodiment, the outlet valve opening/closing mechanism 27 is provided in the outlet flow channel 17. Specifically, the outlet valve opening/closing mechanism 27 is provided between the first outlet section 17*aa* and the outlet middle section 17*ca* of the outlet flow channel 17. In the present preferred embodiment, the expression "open" includes a case in which a target flow channel is not completely open but is partially open, for example, as well as a case in which the target flow channel is completely open. When a state in which the target flow channel is completely open is a 100%-open state, the expression "open" may include an about 80%-open state and an about 90%-open state, for example. Moreover, depending on a configuration of the ink supply system 10, the expression "open" may include an about 10%-open state, for example. In the present preferred embodiment, the expression "closed" preferably refers to a state in which the target flow channel is completely closed. However, depending on a configuration of the ink supply system 10, the expression "closed" may include a state in which a very small portion of the target flow channel is open. When a state in which the target flow channel is completely open is a 100%-open state, the expression "closed" may include an about 1%-open state, for example, depending on a configuration of the ink supply system 10.

In the present preferred embodiment, the inlet valve opening/closing mechanism 26 and the outlet valve opening/closing mechanism 27 preferably have the same configuration. Due to this, in this example, the configuration of the inlet valve opening/closing mechanism 26 will be described in detail, and detailed description of the configuration of the outlet valve opening/closing mechanism 27 will be omitted.

In the following description, the expression "height" refers to the length in the direction of gravity (in other words, a vertical direction) when the ink supply mechanism 30 and the inlet valve opening/closing mechanism 26 (or the outlet valve opening/closing mechanism 27) are disposed normally in a predetermined attitude at a predetermined position. Moreover, in the drawings associated with the inlet valve opening/closing mechanism 26, symbols F1, Rr1, L1, R1, U1, and D1 mean the front, rear, left, right, up, and down directions when the inlet valve opening/closing mechanism 26 is seen from the front surface.

Figure 4:
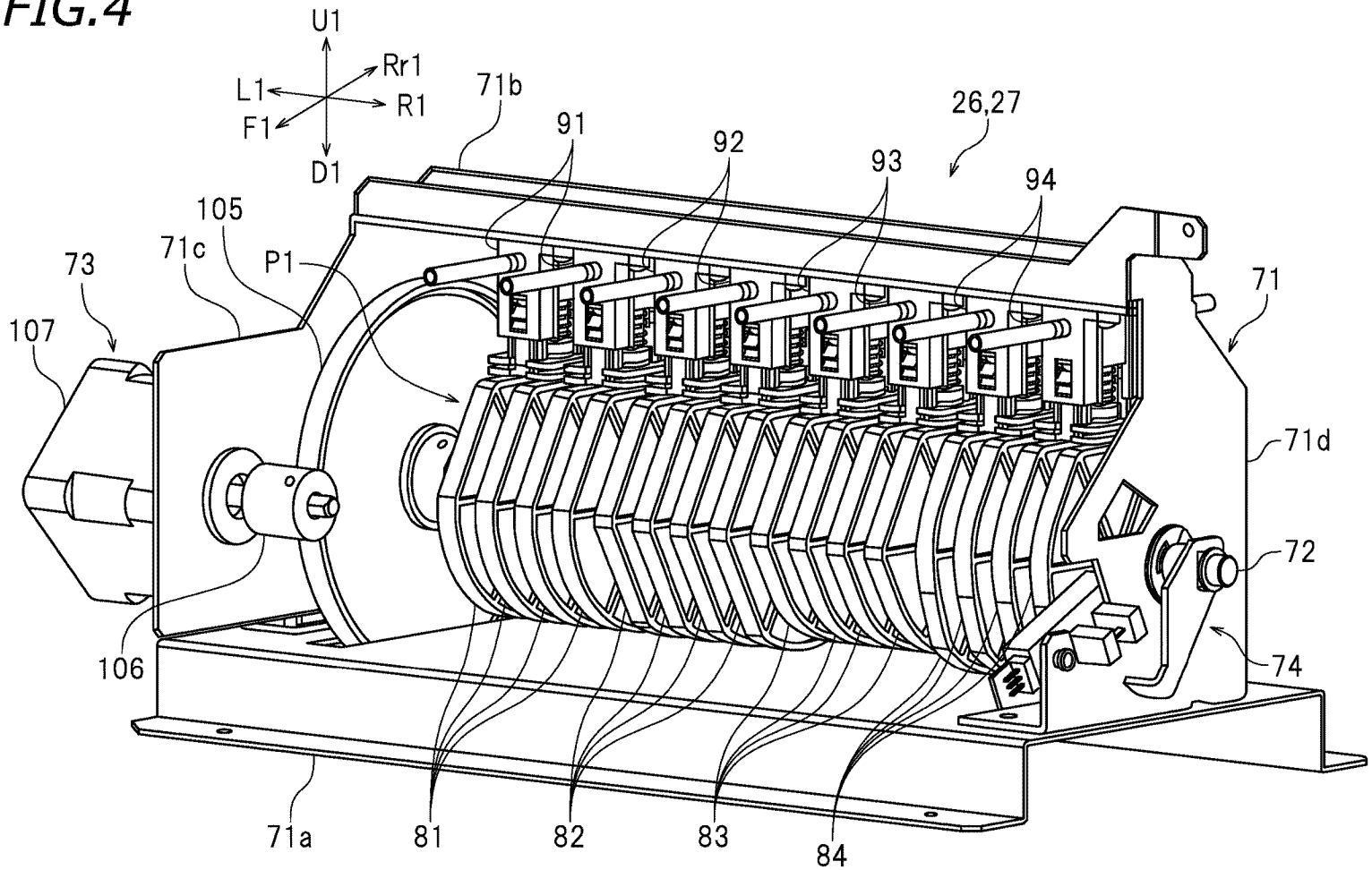
FIG. 4 is a perspective view of an inlet valve opening/closing mechanism.

FIG. 4 is a perspective view of the inlet valve opening/closing mechanism 26. As illustrated in FIG. 4, the inlet valve opening/closing mechanism 26 is able to open and close the inlet flow channels 13 of all ink supply mechanisms 30 (in this example, eight ink supply mechanisms 30). The outlet valve opening/closing mechanism 27 is able to open and close the outlet flow channels 17 of all ink supply mechanisms 30. The inlet valve opening/closing mechanism 26 includes a main body 71, a rotating shaft 72, a first cam 81, a second cam 82, a third cam 83, a fourth cam 84, a first valve 91, a second valve 92, a third valve 93, a fourth valve 94, a rotating mechanism 73, and a lock mechanism 74.

The main body 71 is a hollow member. The rotating shaft 72, the first to fourth cams 81 to 84, and the first to fourth valves 91 to 94 are provided inside the main body 71. In the present preferred embodiment, the main body 71 includes a lower wall 71*a*, an upper wall 71*b*, a left wall 71*c*, and a right wall 71*d*. The lower wall 71*a* is a planar member extending in the left-right direction. The upper wall 71*b* is a planar member extending in the left-right direction. The upper wall 71*b* is provided above the lower wall 71*a*. The left wall 71*c* and the right wall 71*d* are members extending in an up-down direction. The upper end of the left wall 71*c* is connected to the left end of the upper wall 71*b*. The lower end of the left wall 71*c* is connected to the left end of the lower wall 71*a*. The upper end of the right wall 71*d* is connected to the right end of the upper wall 71*b*. The lower end of the right wall 71*d* is connected to the right end of the lower wall 71*a*. The rotating shaft 72, the first to fourth cams 81 to 84, and the first to fourth valves 91 to 94 are disposed in a space surrounded by the lower wall 71*a*, the upper wall 71*b*, the left wall 71*c*, and the right wall 71*d*.

The rotating shaft 72 is a shaft that rotates the first cam 81, the second cam 82, the third cam 83, and the fourth cam 84. In the present preferred embodiment, the rotating shaft 72 is a shaft extending in the left-right direction. One end (in this example, the left end) of the rotating shaft 72 is rotatably supported by the left wall 71*c*. The other end (in this example, the right end) of the rotating shaft 72 is rotatably supported by the right wall 71*d*. The rotating shaft 72 is supported by the main body 71 so as to be rotatable with respect to the main body 71.

The first to fourth valves 91 to 94 open and close a portion of the ink flow channel 20. Specifically, the first to fourth valves 91 to 94 of the inlet valve opening/closing mechanism 26 open and close any one of the inlet flow channels 13 of the plurality of ink supply mechanisms 30. Any one of the first to fourth valves 91 to 94 of the inlet valve opening/closing mechanism is provided in one inlet flow channel 13. In the present preferred embodiment, the first to fourth valves 91 to 94 of the inlet valve opening/closing mechanism 26 each are provided in two sets. The first valve 91 of the inlet valve opening/closing mechanism 26 is provided in the inlet flow channel 13 of the ink supply mechanism 30 belonging to the first group 61. The second valve 92 of the inlet valve opening/closing mechanism 26 is provided in the inlet flow channel 13 of the ink supply mechanism 30 belonging to the second group 62. The third valve 93 of the inlet valve opening/closing mechanism 26 is provided in the inlet flow channel 13 of the ink supply mechanism 30 belonging to the third group 63. The fourth valve 94 of the inlet valve opening/closing mechanism 26 is provided in the inlet flow channel 13 of the ink supply mechanism 30 belonging to the fourth group 64.

The first to fourth valves 91 to 94 of the outlet valve opening/closing mechanism 27 each are able to open and close any one of the outlet flow channels 17 of the plurality of ink supply mechanisms 30. Any one of the first to fourth valves 91 to 94 of the outlet valve opening/closing mechanism 27 is provided in one outlet flow channel 17. The first valve 91 of the outlet valve opening/closing mechanism 27 is provided in the outlet flow channel 17 of the ink supply mechanism 30 belonging to the first group 61. The second valve 92 of the outlet valve opening/closing mechanism 27 is provided in the outlet flow channel 17 of the ink supply mechanism 30 belonging to the second group 62. The third valve 93 of the outlet valve opening/closing mechanism 27 is provided in the outlet flow channel 17 of the ink supply mechanism 30 belonging to the third group 63. The fourth valve 94 of the outlet valve opening/closing mechanism 27 is provided in the outlet flow channel 17 of the ink supply mechanism 30 belonging to the fourth group 64.

Figure 5:
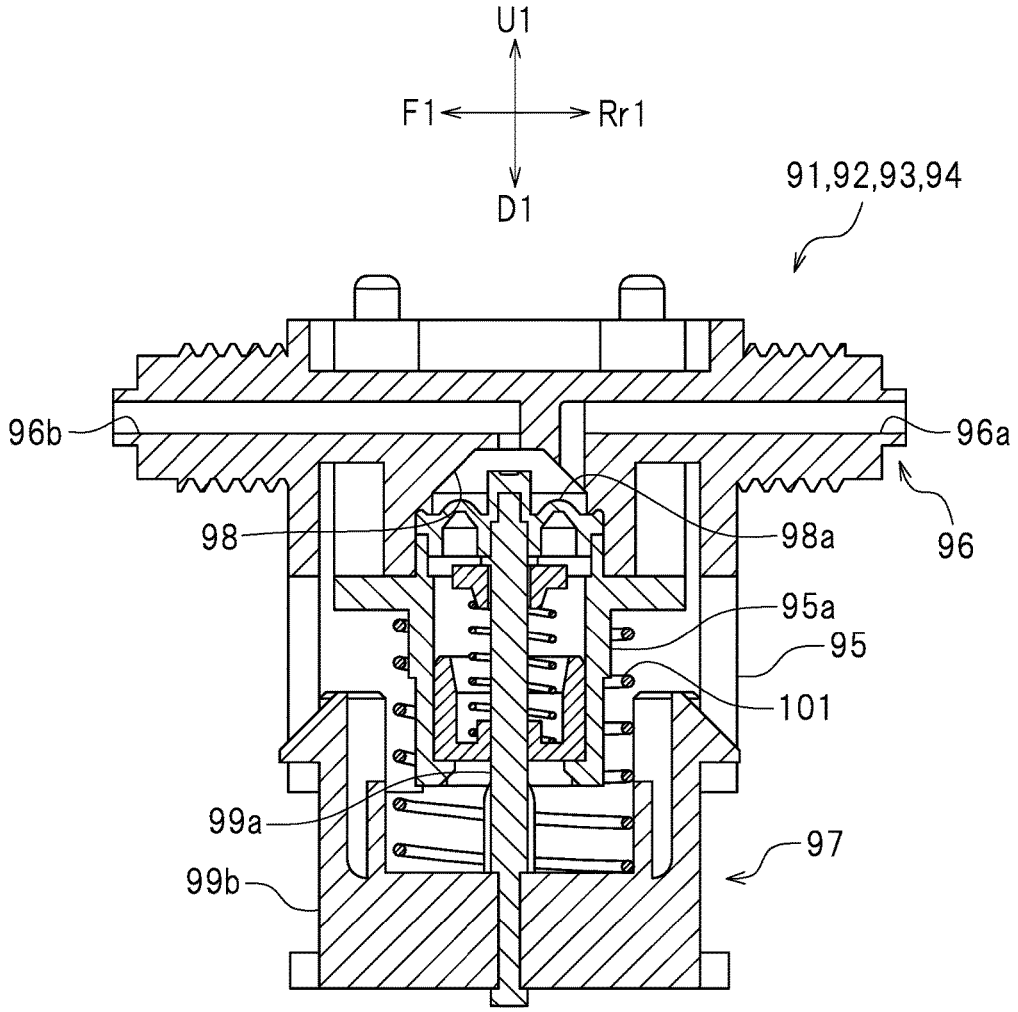
FIG. 5 is a cross-sectional view of a right side surface of a first valve.

In the present preferred embodiment, the first to fourth valves 91 to 94 have the same configuration. Due to this, in this example, the configuration of the first valve 91 will be described in detail, and detailed description of the second to fourth valves 92 to 94 will be omitted. FIG. 5 is a cross-sectional view of a right side surface of the first valve 91. As illustrated in FIG. 5, the first valve 91 has a valve body 95, a flow channel 96, and an opening/closing member 97.

The valve body 95 is hollow. A lower surface of the valve body 95 is open. A cylindrical supporting member 95*a* extending in the up-down direction is provided inside the valve body 95. The lower end of the supporting member 95*a* is positioned in a portion corresponding to the opening of the valve body 95. Ink flows through the flow channel 96. The flow channel 96 is provided in an upper section of the valve body 95. In the present preferred embodiment, the flow channel 96 includes an inflow channel 96*a* and an outflow channel 96*b*. The inflow channel 96*a* is a flow channel into which ink flows. The inflow channel 96*a* is provided in the valve body 95. In this example, although not illustrated in the drawings, the inflow channel 96*a* of the inlet valve opening/closing mechanism 26 is connected to the first inlet section 13*aa* (see FIG. 2) of the inlet flow channel 13. The inflow channel 96*a* of the outlet valve opening/closing mechanism 27 is connected to the first outlet section 17*aa* (see FIG. 2) of the outlet flow channel 17. The outflow channel 96*b* is a flow channel from which ink flows. The outflow channel 96*b* is provided in the valve body 95. In this example, although not illustrated in the drawings, the outflow channel 96*b* of the inlet valve opening/closing mechanism 26 is connected to the second inlet section 13*ba* (see FIG. 2) of the inlet flow channel 13. The outflow channel 96*b* of the outlet valve opening/closing mechanism 27 is connected to the outlet middle section 17*ca* (see FIG. 2) of the outlet flow channel 17. The inflow channel 96*a* and the outflow channel 96*b* communicate with each other inside the valve body 95. In the present preferred embodiment, an ink chamber 98 is connected to the inflow channel 96*a* and the outflow channel 96*b*. The inflow channel 96*a* and the outflow channel 96*b* communicate with each other via the ink chamber 98. A lower wall of the ink chamber 98 is defined by a flexible membrane 98*a*.

The opening/closing member 97 is able to open or close the flow channel 96. In the present preferred embodiment, the opening/closing member 97 is supported by the valve body 95 so as to be movable in the up-down direction. The opening/closing member 97 of the first valve 91 closes the flow channel 96 when the first cam 81 comes into contact with and presses the opening/closing member 97 upward. In this example, the opening/closing member 97 includes a rod section 99*a* and a contact section 99*b*. The rod section 99*a* is a member extending in the up-down direction. The rod section 99*a* is disposed so that a lower portion thereof protrudes toward a lower side of the contact section 99*b*. The upper portion of the rod section 99*a* is disposed inside the valve body 95. Moreover, the upper end of the rod section 99*a* is in contact with the membrane 98*a*. The rod section 99*a* is pressed upward by the first cam 81, for example, so that the upper end thereof blocks a portion of the ink chamber 98 connected to the outflow channel 96*b*. In this way, the outflow channel 96*b* is closed. In this case, ink does not flow into the outflow channel 96*b*. The contact section 99*b* is provided in a lower portion of the rod section 99*a*. The contact section 99*b* is supported by the valve body 95 so as to be movable in the up-down direction together with the rod section 99*a*. In this example, the lower portion of the contact section 99*b* contacts with the first cam 81. The contact section 99*b* is exposed to the lower side of the valve body 95. In the present preferred embodiment, a spring 101 is interposed between the contact section 99*b* and the supporting member 95*a*. The spring 101 applies downward elastic force to the opening/closing member 97.

In the present preferred embodiment, the flow channel 96 of the first valve 91 corresponds to a "first flow channel". The opening/closing member 97 of the first valve 91 corresponds to a "first opening/closing member". The flow channel 96 of the second valve 92 corresponds to a "second flow channel". The opening/closing member 97 of the second valve 92 correspond to a "second opening/closing member". The flow channel 96 of the third valve 93 corresponds to a "third flow channel". The opening/closing member 97 of the third valve 93 corresponds to a "third opening/closing member". The flow channel 96 of the fourth valve 94 corresponds to a "fourth flow channel". The opening/closing member 97 of the fourth valve 94 corresponds to a "fourth opening/closing member".

Figure 6:
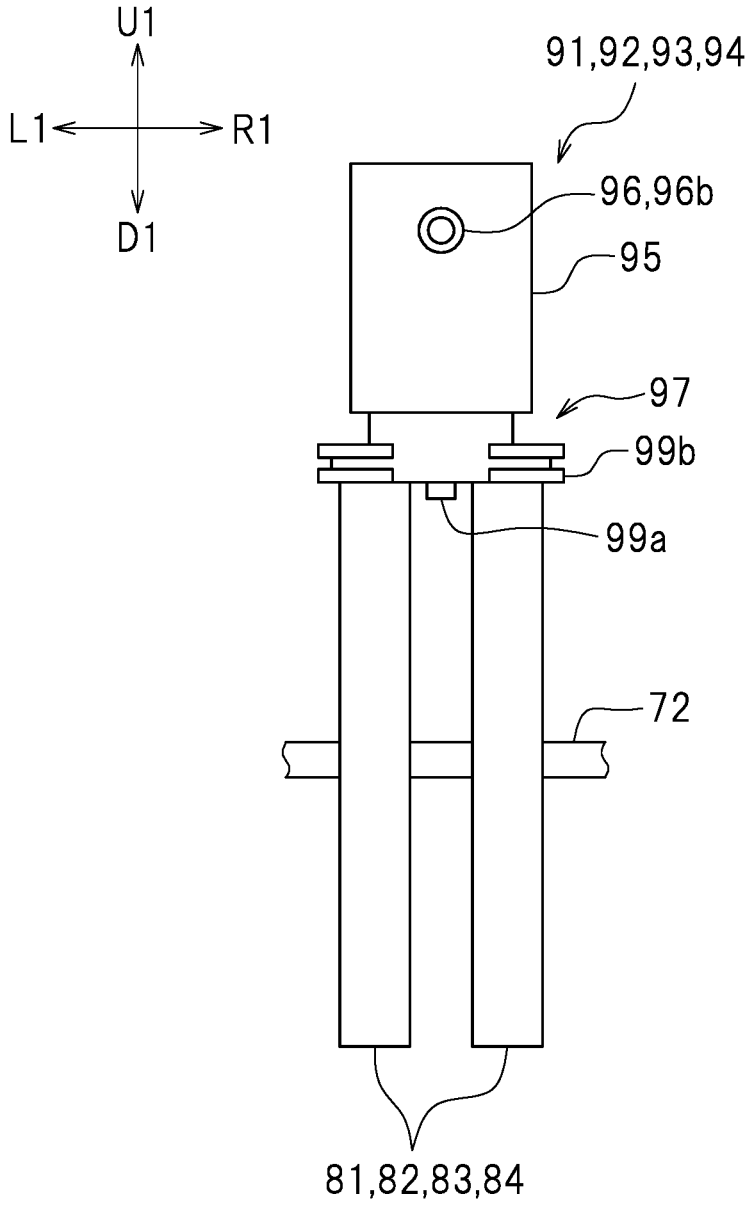
FIG. 6 is a schematic diagram in a front view, illustrating a state in which a first cam is in contact with the first valve.

Next, the first to fourth cams 81 to 84 will be described. The first to fourth cams 81 to 84 make contact with the opening/closing members 97 of the first to fourth valves 91 to 94, respectively. The first to fourth cams 81 to 84 press the opening/closing members 97 upward to close the flow channel 96. In this example, when the first to fourth cams 81 to 84 are not in contact with the opening/closing members 97 of the first to fourth valves 91 to 94, the flow channel 96 is open. In the present preferred embodiment, as illustrated in FIG. 4, the first to fourth cams 81 to 84 are provided on the rotating shaft 72. The first to fourth cams 81 to 84 rotate together with the rotating shaft 72. FIG. 6 is a schematic diagram in a plan view, illustrating a state in which the first cam 81 is in contact with the first valve 91. In this example, as illustrated in FIG. 6, any two of the first to fourth cams 81 to 84 contacts with one of the first to fourth valves 91 to 94. Specifically, the first cam 81 is provided in four sets. Two first cams 81 contacts with one first valve 91. One of the first cams 81 contacts with a lower left portion of the opening/closing member 97. The other of the first cams 81 can make with a lower right portion of the opening/closing member 97. The second to fourth cams 82 to 84 each are provided in four sets. Two second cams 82 contacts with one second valve 92. Two third cams 83 contacts with one third valve 93. Two fourth cams 84 contacts with one fourth valve 94.

Figure 7:
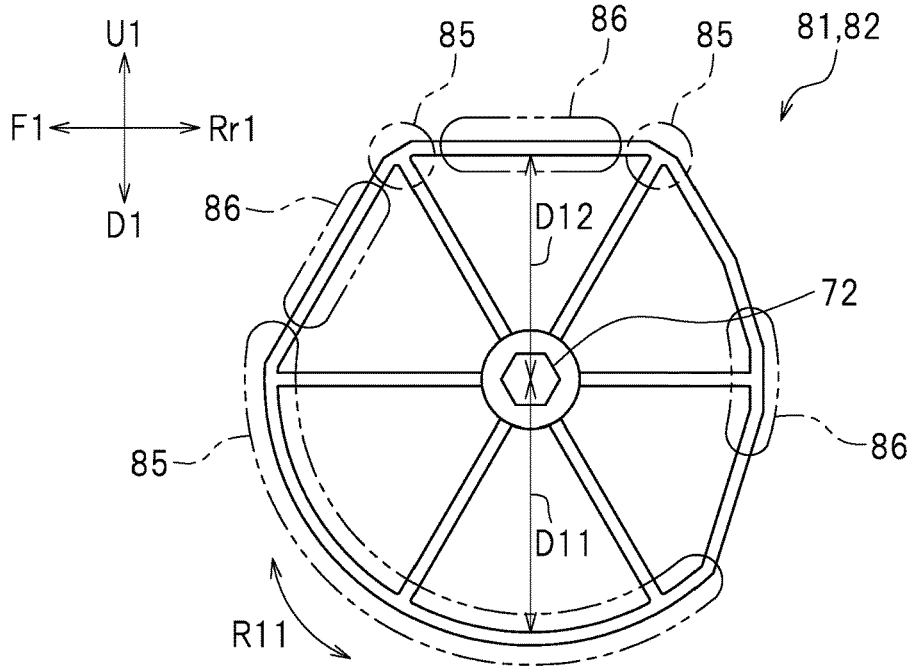
FIG. 7 is a right side view of the first cam and a second cam.
Figure 8:
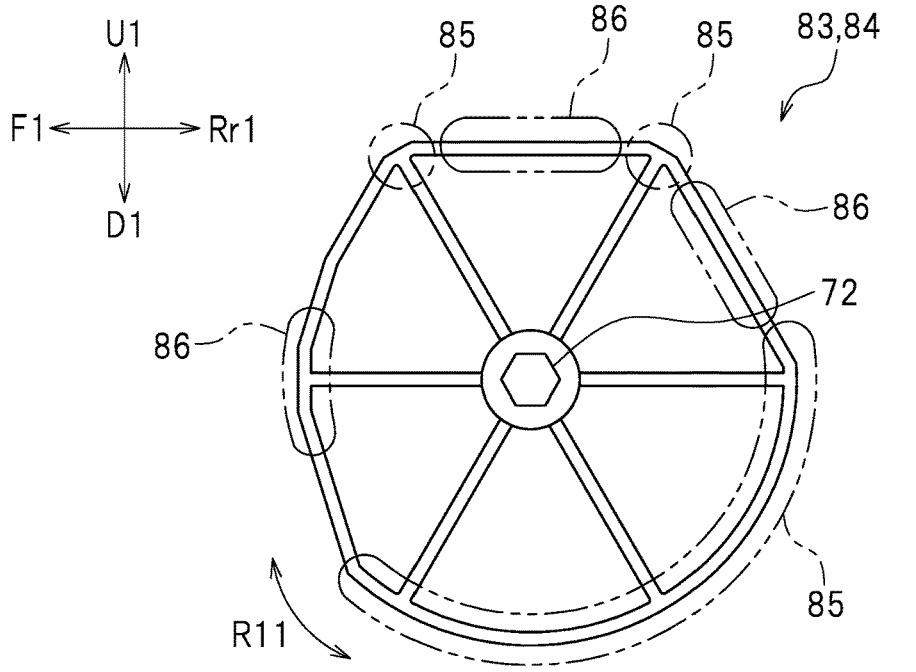
FIG. 8 is a right side view of a third cam and a fourth cam.

FIG. 7 is a right side view of the first cam 81 and the second cam 82. FIG. 8 is a right side view of the third cam 83 and the fourth cam 84. In the present preferred embodiment, as illustrated in FIGS. 7 and 8, the first to fourth cams 81 to 84 have the same shape. However, the first to fourth cams 81 to 84 may have different shapes. In the present preferred embodiment, as illustrated in FIG. 7, the first cam 81 and the second cam 82 are provided on the rotating shaft 72 in the same orientation with respect to an axial direction of the rotating shaft 72. As illustrated in FIG. 8, the third cam 83 and the fourth cam 84 are provided on the rotating shaft 72 in the same orientation with respect to the axial direction of the rotating shaft 72. The third cam 83 and the fourth cam 84 are provided on the rotating shaft 72 so as to be disposed in such an orientation that the first cam 81 is reversed with respect to the axial direction of the rotating shaft 72. For example, the shape in a left side view of the first cam 81 is the same as the shape in a right side view of the third cam 83.

Figure 9:
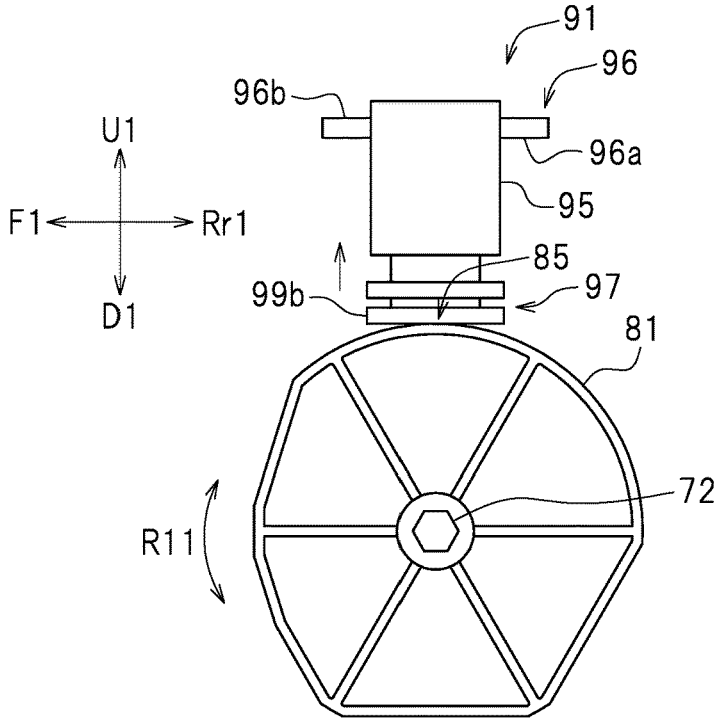
FIG. 9 is a schematic diagram in a right side view, illustrating a state in which the first cam closes a flow channel of the first valve.
Figure 10:
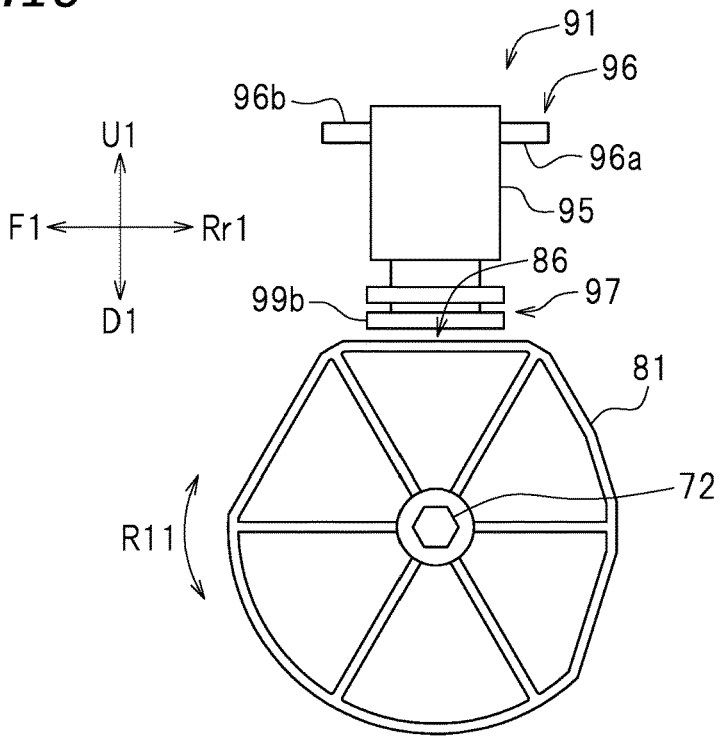
FIG. 10 is a schematic diagram in a right side view, illustrating a state in which the first cam opens the flow channel of the first valve.

As described above, the first to fourth cams 81 to 84 have the same shape. Due to this, in this example, the shape of the first cam 81 will be described. As illustrated in FIG. 7, the first cam 81 has a disk shape in which a portion of an outer edge is cut. FIG. 9 is a schematic diagram in a right side view, illustrating a state in which the first cam 81 closes the flow channel 96 of the first valve 91. FIG. 10 is a schematic diagram in a right side view, illustrating a state in which the first cam 81 opens the flow channel 96 of the first valve 91. As illustrated in FIGS. 9 and 10, the flow channel 96 of the first valve 91 is open or closed depending on the position of the first cam 81 when the first cam 81 is rotated. In the present preferred embodiment, the first cam 81 includes a closing section 85 and an opening section 86. A portion of the outer edge of the first cam 81 is included in each of the closing section 85 and the opening section 86. As illustrated in FIG. 9, the closing section 85 is a section that makes contact with the opening/closing member 97 to press the opening/closing member 97 upward when the first cam 81 rotates together with the rotating shaft 72 to approach the opening/closing member 97 of the first valve 91 (that is, when the first cam 81 is positioned right below the opening/closing member 97). In this way, the flow channel 96 of the first valve 91 enters a closed state. In this example, as illustrated in FIG. 7, the closing section 85 includes an outer edge of the first cam 81 in which the distance from the center of the rotating shaft 72 is a distance D11. In the present preferred embodiment, a plurality of closing sections 85 are provided in the first cam 81.

As illustrated in FIG. 10, the opening section 86 is a section that does not make contact with the opening/closing member 97 and does not press the opening/closing member 97 upward when the first cam 81 rotates together with the rotating shaft 72 to approach the opening/closing member 97 of the first valve 91 (that is, when the first cam 81 is positioned right below the opening/closing member 97). In this case, since the opening/closing member 97 is not pressed upward, the flow channel 96 of the first valve 91 enters an open state. In this example, as illustrated in FIG. 7, the opening section 86 includes an outer edge of the first cam 81 in which the distance from the center of the rotating shaft 72 is a distance D12 which is shorter than the distance D11. In the present preferred embodiment, a plurality of opening sections 86 are provided in the first cam 81. The opening section 86 is positioned between the adjacent closing sections 85. The flow channel 96 of the first valve 91 is closed when the first cam 81 rotates and the section that approaches the closest to the opening/closing member 97 of the first valve 91 is the closing section 85. The flow channel 96 of the first valve 91 is open when the first cam 81 rotates and the section that approaches the closest to the opening/closing member 97 is the opening section 86.

In the present preferred embodiment, as illustrated in FIG. 4, the relative orientations of the first to fourth cams 81 to 84 with respect to a rotating direction R11 (see FIG. 7) of the rotating shaft 72 are different. Due to this, when the rotating shaft 72 rotates and the rotating positions of the first to fourth cams 81 to 84 are at a predetermined position, some of the first to fourth cams 81 to 84 may close the flow channel 96 and the other cams may open the flow channel 96. In this example, the rotating positions in the rotating direction R11 of the first to fourth cams 81 to 84 include six positions of a first position P1 (see FIG. 4), a second position P2 (see FIG. 11), a third position P3 (see FIG. 12), a fourth position P4 (see FIG. 13), a fifth position P5 (see FIG. 14), and a sixth position P6 (see FIG. 15). When the rotating shaft 72 rotates and the position in the rotating direction R11 of the first to fourth cams 81 to 84 is changed, the position is changed to any one of the first to sixth positions P1 to P6.

Figure 11:
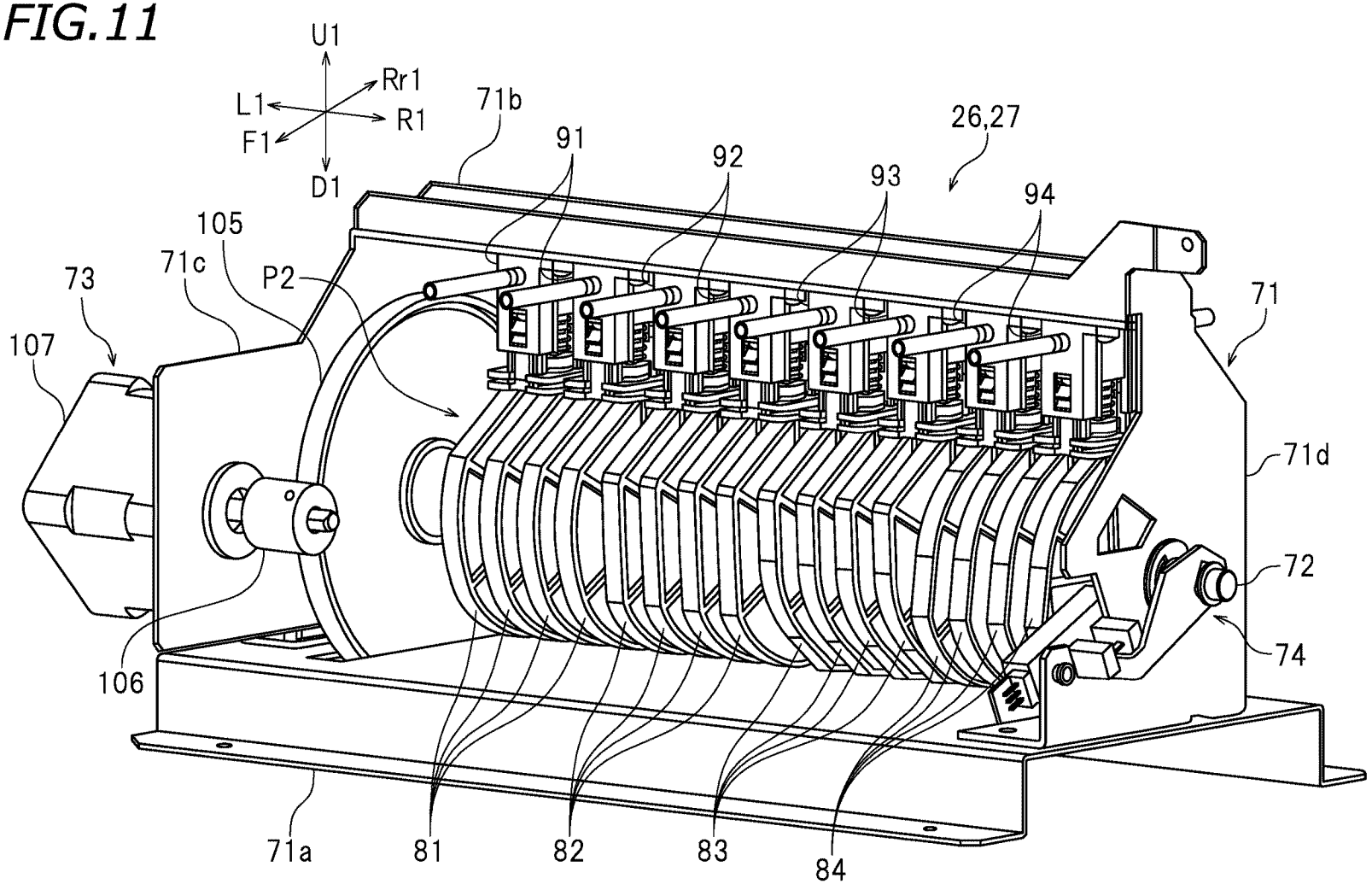
FIG. 11 is a perspective view of the inlet valve opening/closing mechanism when the rotating positions of the first to fourth cams are at a second position.

As illustrated in FIG. 4, the first position P1 is such positions in the rotating direction R11 of the first to fourth cams 81 to 84 that all flow channels 96 of the first to fourth valves 91 to 94 are open. At the first position P1, the opening sections 86 of the first to fourth cams 81 to 84 approach the closest to the opening/closing members 97 of the first to fourth valves 91 to 94. As illustrated in FIG. 11, the second position P2 is a position in the rotating direction R11 of the first to fourth cams 81 to 84 in which all flow channels 96 of the first to fourth valves 91 to 94 enters a closed state. At the second position P2, the closing sections 85 of the first to fourth cams 81 to 84 approach the closest to the opening/closing members 97 of the first to fourth valves 91 to 94. At the second position P2, the closing sections 85 of the first to fourth cams 81 to 84 press the opening/closing member 97 upward.

Figure 12:
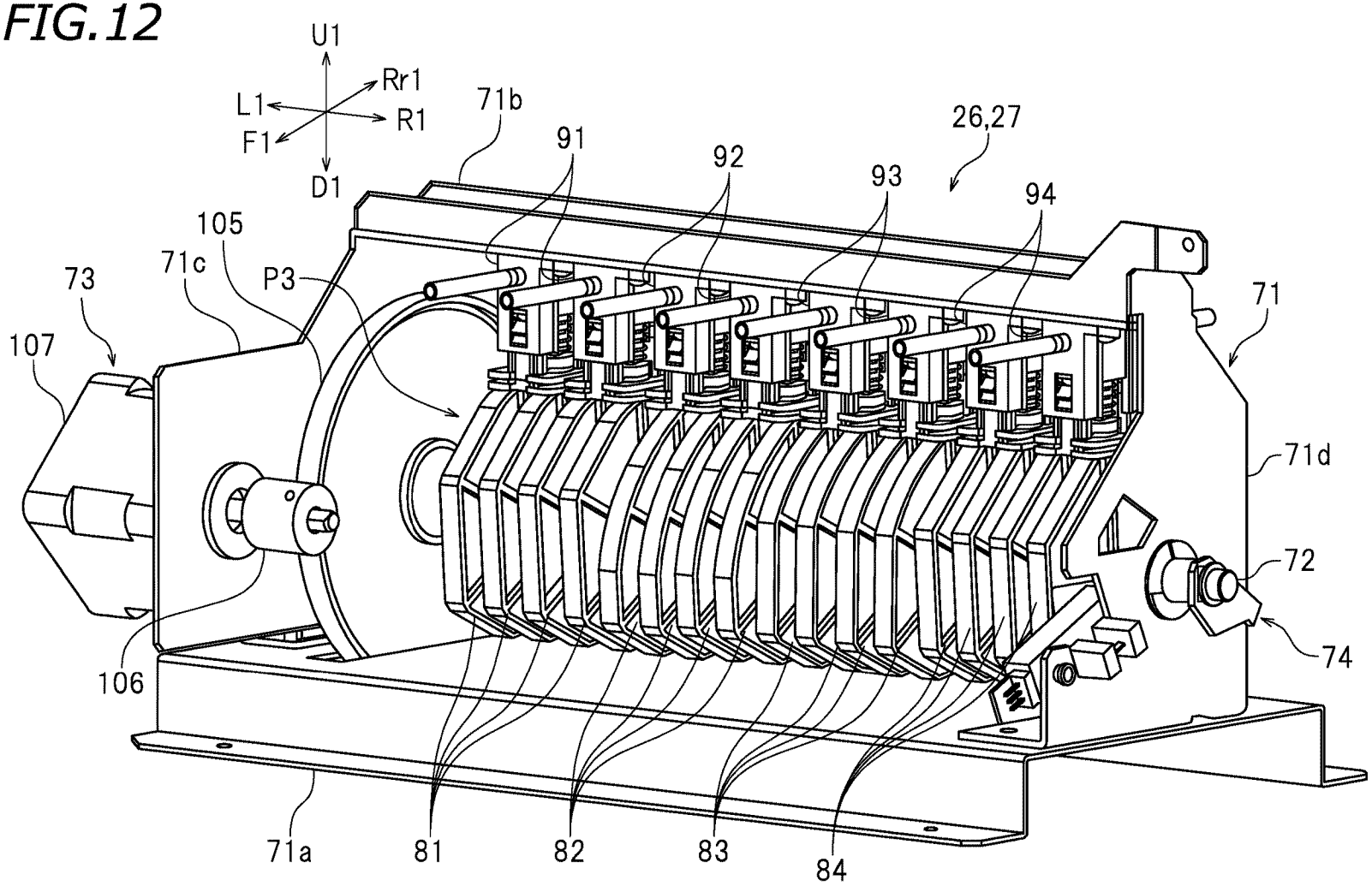
FIG. 12 is a perspective view of the inlet valve opening/closing mechanism when the rotating positions of the first to fourth cams are at a third position.
Figure 13:
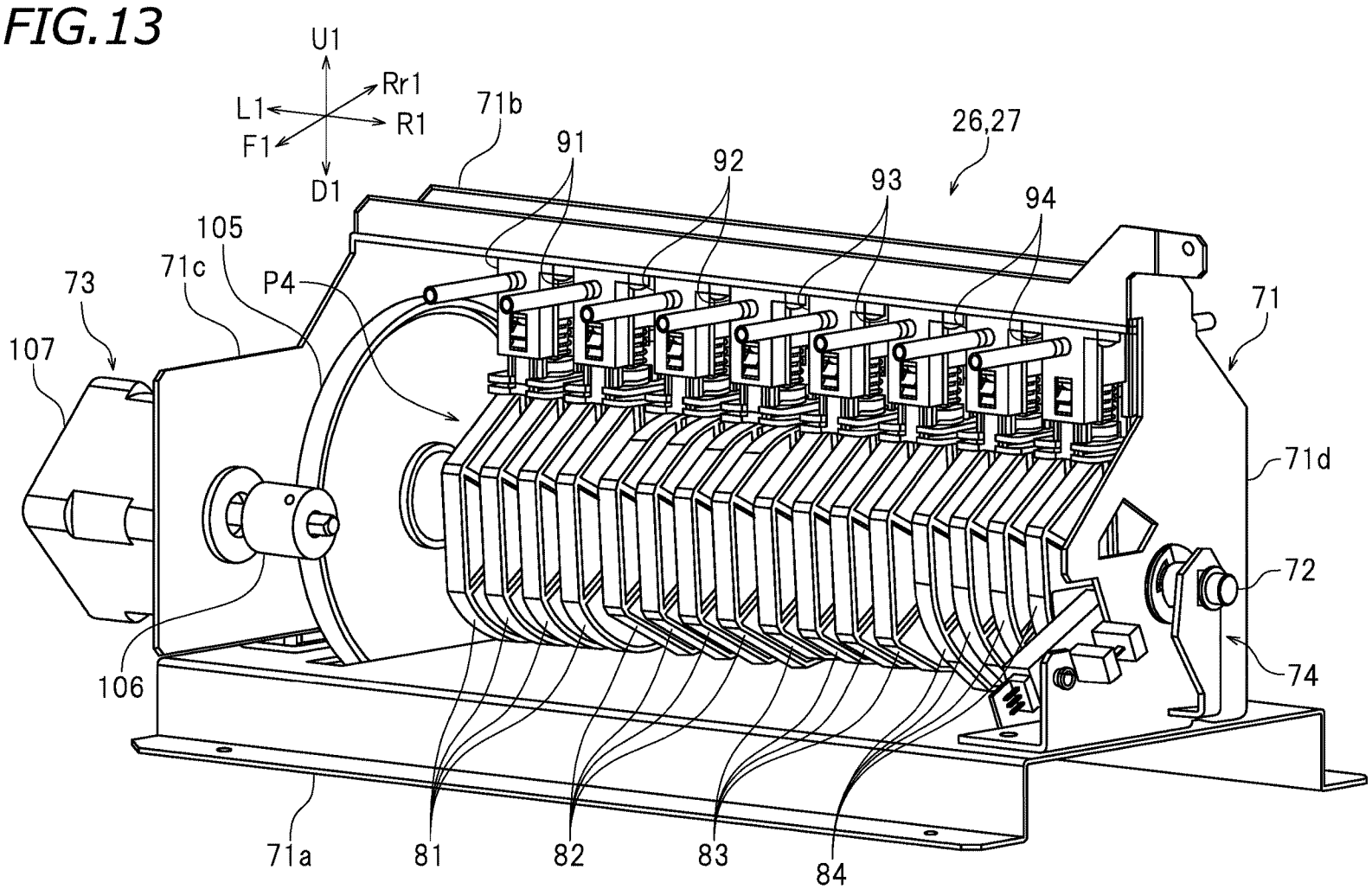
FIG. 13 is a perspective view of the inlet valve opening/closing mechanism when the rotating positions of the first to fourth cams are at a fourth position.

As illustrated in FIG. 12, the third position P3 is such a position in the rotating direction R11 of the first to fourth cams 81 to 84 that the flow channel 96 of the first valve 91 is open and the flow channels 96 of the second to fourth valves 92 to 94 are in the closed state. At the third position P3, the opening section 86 of the first cam 81 approaches the closest to the opening/closing member 97 of the first valve 91. In this case, the closing sections 85 of the second to fourth cams 82 to 84 approach the closest to the opening/closing members 97 of the second to fourth valves 92 to 94, respectively, to press the opening/closing members 97 upward. As illustrated in FIG. 13, the fourth position P4 is such a position in the rotating direction R11 of the first to fourth cams 81 to 84 that the flow channel 96 of the second valve 92 is open and the flow channels 96 of the first, third, and fourth valves 91, 93, and 94 are closed. At the fourth position P4, the opening section 86 of the second cam 82 approaches the closest to the opening/closing member 97 of the second valve 92. In this case, the closing sections 85 of the first, third, and fourth cams 81, 83, and 84 approach the closest to the opening/closing members 97 of the first, third, and fourth valves 91, 93, and 94, respectively, to press the opening/closing members 97 upward.

Figure 14:
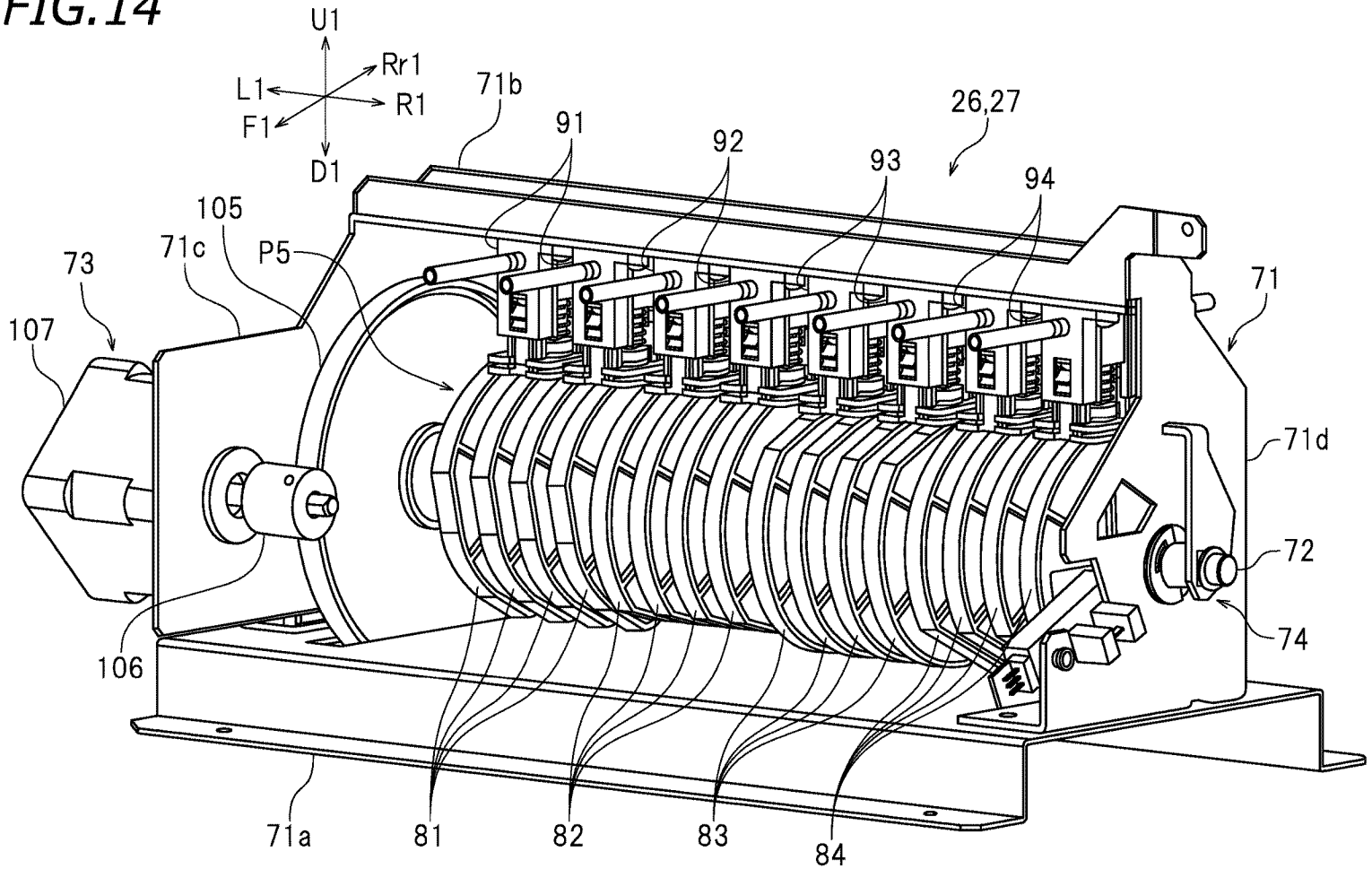
FIG. 14 is a perspective view of the inlet valve opening/closing mechanism when the rotating positions of the first to fourth cams are at a fifth position.
Figure 15:
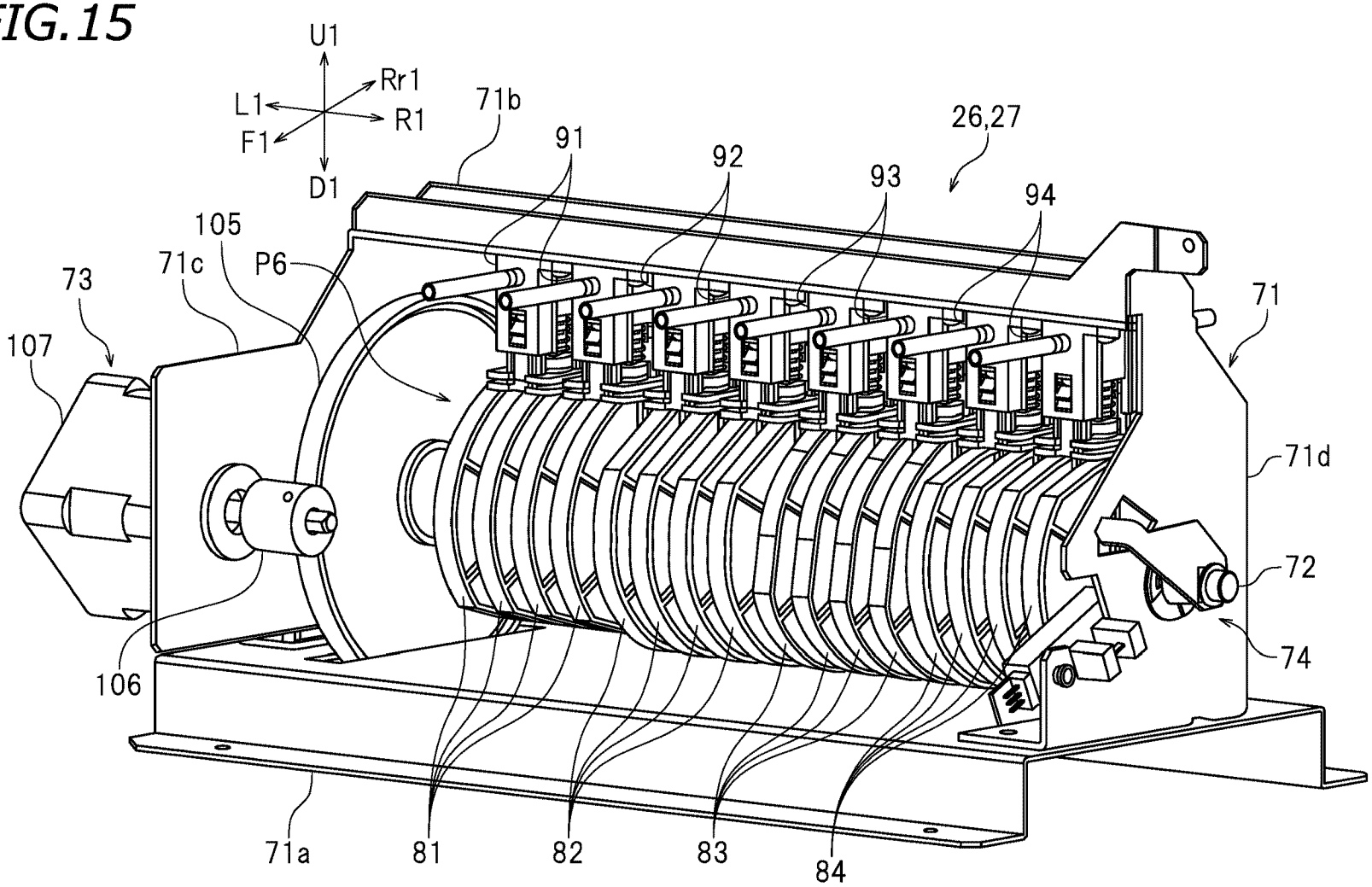
FIG. 15 is a perspective view of the inlet valve opening/closing mechanism when the rotating positions of the first to fourth cams are at a sixth position.

As illustrated in FIG. 14, the fifth position P5 is such a position in the rotating direction R11 of the first to fourth cams 81 to 84 that the flow channel 96 of the third valve 93 is open and the flow channels 96 of the first, second, and fourth valves 91, 92, and 94 are closed. At the fifth position P5, the opening section 86 of the third cam 83 approaches the closest to the opening/closing member 97 of the third valve 93. In this case, the closing sections 85 of the first, second, and fourth cams 81, 82, and 84 approach the closest to the opening/closing members 97 of the first, second, and fourth valves 91, 92, and 94, respectively, to press the opening/closing members 97 upward. As illustrated in FIG. 15, the sixth position P6 is such a position in the rotating direction R11 of the first to fourth cams 81 to 84 that the flow channel 96 of the fourth valve 94 is open and the flow channels 96 of the first to third valves 91 to 93 are closed. At the sixth position P6, the opening section 86 of the fourth cam 84 approaches the closest to the opening/closing member 97 of the fourth valve 94. In this case, the closing sections 85 of the first to third cams 81 to 83 approach the closest to the opening/closing members 97 of the first to third valves 91 to 93, respectively, to press the opening/closing members 97 upward. In the present preferred embodiment, as described above, depending on the position in the rotating direction R11 of the first to fourth cams 81 to 84, it is possible to open all flow channels 96 of the first to fourth valves 91 to 94, close all flow channels 96 of the first to fourth valves 91 to 94, or open any one of the flow channels 96 of the first to fourth valves 91 to 94.

Next, the rotating mechanism 73 will be described. As illustrated in FIG. 4, the rotating mechanism 73 is a mechanism that rotates the rotating shaft 72. In this example, when the rotating mechanism 73 rotates the rotating shaft 72, it is possible to rotate the first to fourth cams 81 to 84 in the rotating direction R11. The rotating mechanism 73 is a mechanism that switches the position in the rotating direction R11 of the first to fourth cams 81 to 84 to any one of the first to sixth positions P1 to P6. In the present preferred embodiment, the rotating mechanism 73 includes a first gear 105, a second gear 106, and a driving motor 107. The first gear 105 is able to rotate together with the rotating shaft 72. The first gear 105 is provided on the rotating shaft 72. In the present preferred embodiment, the first gear 105 is provided at the left end of the rotating shaft 72. However, the first gear 105 may be provided at the right end of the rotating shaft 72. The second gear 106 is provided on a front side of the first gear 105 and is engaged with the first gear 105. In this example, the second gear 106 has a smaller diameter than the first gear 105. The driving motor 107 is a motor that rotates the rotating shaft 72. When the driving motor 107 is driven to rotate the rotating shaft 72, the first to fourth cams 81 to 84 rotate. In the present preferred embodiment, the driving motor 107 is connected to the second gear 106. When the driving motor 107 is driven, the second gear 106 rotates. When the second gear 106 rotates, the rotating shaft 72 rotates together with the first gear 105.

The lock mechanism 74 is a mechanism that locks the positions of the first to fourth cams 81 to 84 in a state in which the position in the rotating direction R11 of the first to fourth cams 81 to 84 is at the second position P2 (see FIG. 11). For example, when a main power source is turned off contrary to a user's intention such as in the event of power failure, the lock mechanism 74 locks the first to fourth cams 81 to 84 at the second position P2 to close the flow channels 96 of the first to fourth valves 91 to 94. A specific configuration of the lock mechanism is not particularly limited. In the present preferred embodiment, the lock mechanism 74 preferably includes a spring, for example. By the elastic force of the spring, the first to fourth cams 81 to 84 are locked at the second position P2. For example, a lever is provided in the lock mechanism 74. The lock mechanism 74 may lock the first to fourth cams 81 to 84 at the second position P2 by a user operating the lever to change the state of the spring.

Hereinabove, the configuration of the inlet valve opening/closing mechanism 26 and the outlet valve opening/closing mechanism 27 has been described. Next, the outlet pump 28 will be described. As illustrated in FIG. 2, the outlet pump 28 is configured to cause ink in the ink flow channel 20 or air contained in the ink to flow into the waste tank 29 in a state in which the outlet valve opening/closing mechanism 27 opens the outlet flow channel 17. The outlet pump 28 is provided in the outlet flow channel 17. Specifically, the outlet pump 28 is provided in a portion of the outlet flow channel 17 positioned closer to the waste tank 29 than the outlet valve opening/closing mechanism 27. In the present preferred embodiment, the outlet pump 28 is provided between the outlet middle section 17*ca* and the second outlet section 17*ba* of the outlet flow channel 17. The type of the outlet pump 28 is not particularly limited. In this example, the outlet pump 28 is a tube pump. Although not illustrated in the drawings, a motor is connected to the outlet pump 28. When the motor is driven, resultantly the outlet pump 28 is driven.

Figure 16:
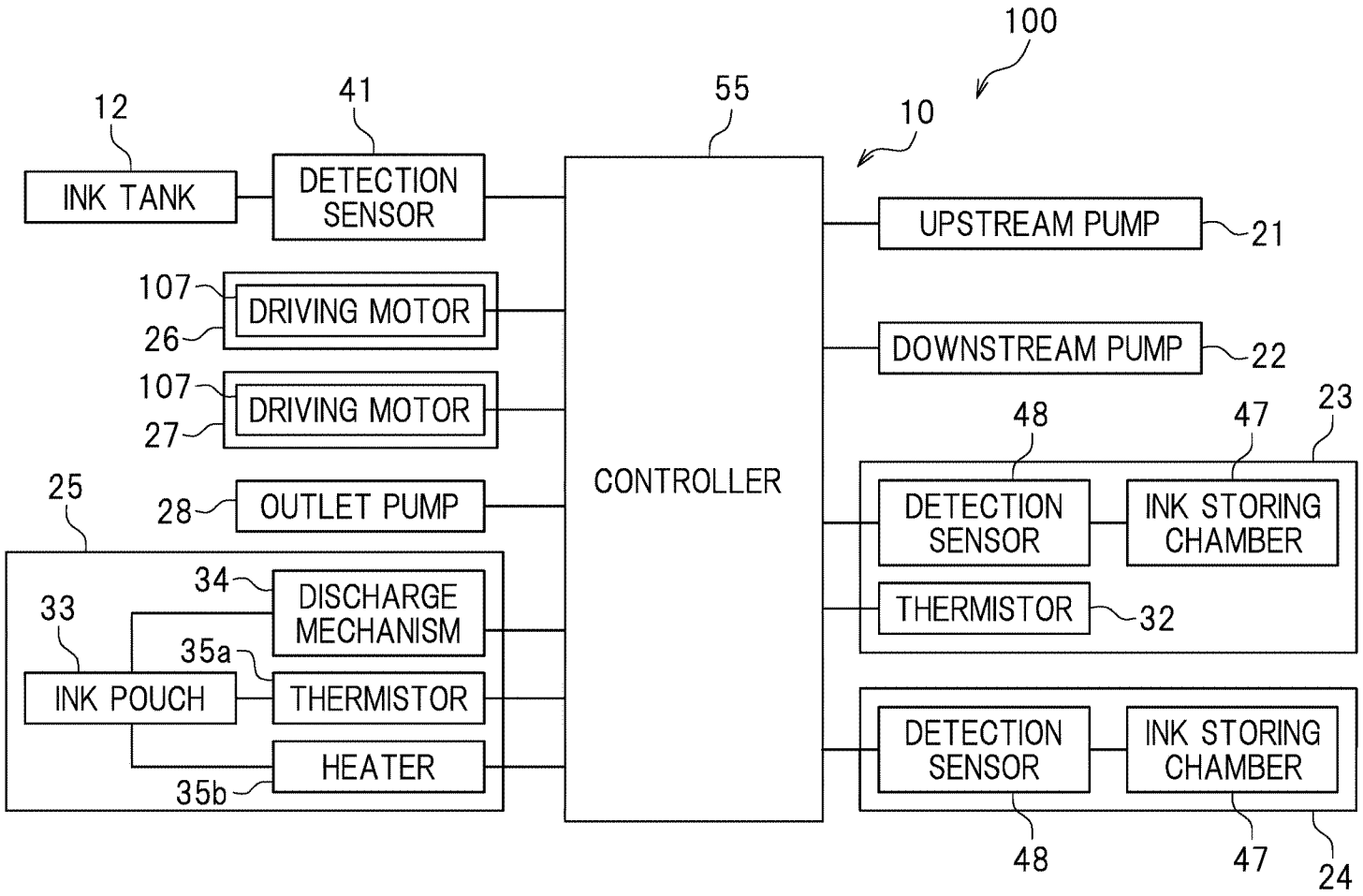
FIG. 16 is a block diagram of a printer.
Figure 17:
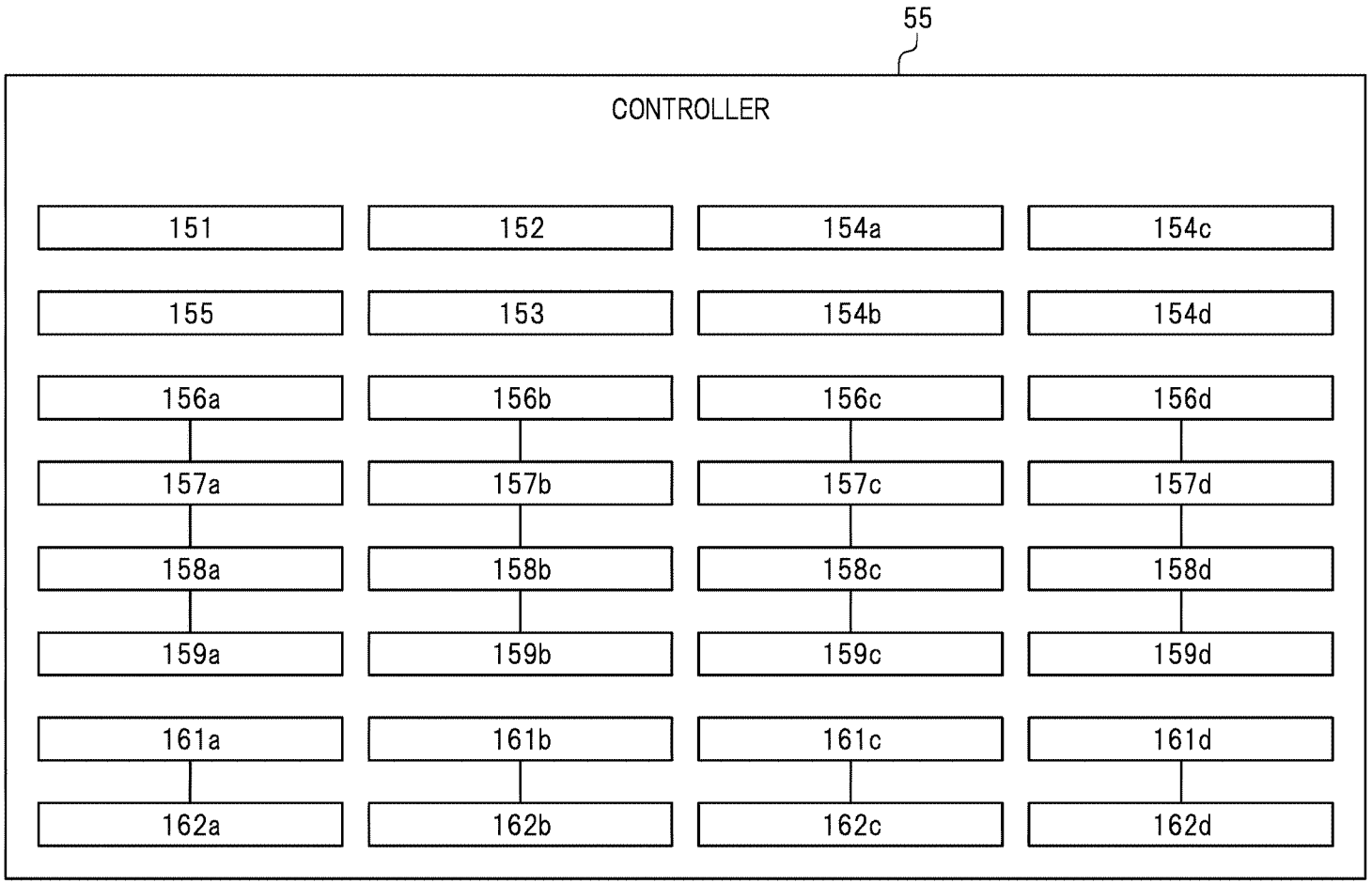
FIG. 17 is a block diagram of a controller.

FIG. 16 is a block diagram of the printer 100. FIG. 17 is a block diagram of the controller 55. In the present preferred embodiment, as illustrated in FIG. 16, the ink supply system 10 includes the controller 55. The controller 55 is a device that controls the ink supply system 10. In this example, the controller 55 is a device that performs control related to supply of ink to the ink head 11. The configuration of the controller 55 is not particularly limited. For example, the controller 55 is a computer and may include a central processing unit (hereinafter referred to as a CPU), a ROM in which programs and the like executed by the CPU are stored, and a RAM.

The controller 55 is connected to the detection sensor 41 provided in the ink tank 12. The controller 55 detects the storage amount of ink stored in the ink tank 12 by the detection sensor 41. The controller 55 is connected to the upstream pump 21 and the detection sensor 48 of the upstream damper 23. The controller 55 detects the storage amount of ink in the ink storing chamber 47 of the upstream damper 23 by the detection sensor 48 of the upstream damper 23. The controller 55 controls driving of the upstream pump 21 on the basis of the detection result. The controller 55 is connected to the downstream pump 22 and the detection sensor 48 of the downstream damper 24. The controller 55 detects the storage amount of ink in the ink storing chamber 47 of the downstream damper 24 by the detection sensor 48 of the downstream damper 24. The controller 55 controls driving of the downstream pump 22 on the basis of the detection result.

The controller 55 is connected to the thermistor 32 provided in the upstream damper 23. The controller 55 detects the temperature of ink in the upstream flow channel 15 by the thermistor 32. The controller 55 is connected to the discharge mechanism 34 of the air trap 25. When air in the ink pouch 33 is discharged, the controller 55 controls the discharge mechanism 34 so as to discharge the air. The controller 55 is connected to the thermistor 35*a* provided in the air trap 25. The controller 55 detects the temperature of ink in the ink pouch 33 of the air trap 25 by the thermistor 35*a*. The controller 55 is connected to the heater 35*b* provided in the air trap 25. The controller 55 heats the ink in the ink pouch 33 by controlling the heater 35*b*. The controller 55 is connected to the driving motors 107 of the rotating mechanisms 73 of the inlet valve opening/closing mechanism 26 and the outlet valve opening/closing mechanism 27. The controller 55 controls driving of the driving motor 107 of the inlet valve opening/closing mechanism 26 to put the rotating positions of the first to fourth cams 81 to 84 of the inlet valve opening/closing mechanism 26 to any one of the first to sixth positions P1 to P6 to control opening/closing of the inlet flow channel 13. The controller 55 controls driving of the driving motor 107 of the outlet valve opening/closing mechanism 27 to put the rotating positions of the first to fourth cams 81 to 84 of the outlet valve opening/closing mechanism 27 to any one of the first to sixth positions P1 to P6 to control opening/closing of the outlet flow channel 17. The controller 55 is connected to the outlet pump 28. The controller 55 controls the outlet pump 28 so that ink in the ink flow channel 20 is discharged to the waste tank 29.

In the present preferred embodiment, as illustrated in FIG. 17, the controller 55 includes a storage processor 151, a print control processor 152, a print standby control processor 153, a first air discharge control processor 154*a*, a second air discharge control processor 154*b*, a third air discharge control processor 154*c*, a fourth air discharge control processor 154*d*, and a purge control processor 155. Moreover, the controller 55 includes a first of first ink filling control processor 156*a*, a second of first ink filling control processor 157*a*, a third of first ink filling control processor 158*a*, and a fourth of first ink filling control processor 159*a*; a first of second ink filling control processor 156*b*, a second of second ink filling control processor 157*b*, a third of second ink filling control processor 158*b*, and a fourth of second ink filling control processor 159*b*; a first of third ink filling control processor 156*c*, a second of third ink filling control processor 157*c*, a third of third ink filling control processor 158*c*, and a fourth of third ink filling control processor 159*c*; and a first of fourth ink filling control processor 156*d*, a second of fourth ink filling control processor 157*d*, a third of fourth ink filling control processor 158*d*, and a fourth of fourth ink filling control processor 159*d*. Furthermore, the controller 55 includes a first of first ink discharge control processor 161*a* and a second of first ink discharge control processor 162*a*, a first of second ink discharge control processor 161*b* and a second of second ink discharge control processor 162*b*, a first of third ink discharge control processor 161*c* and a second of third ink discharge control processor 162*c*, and a first of fourth ink discharge control processor 161*d* and a second of fourth ink discharge control processor 162*d*. The respective processors of the controller 55 may be configured as software or may be configured as hardware. Moreover, the respective processors of the controller 55 may be performed by a processor and may be integrated into circuits. Specific control of the respective processors will be described later.

Hereinabove, the configuration of the printer 100 including the ink supply system 10 has been described. In the present preferred embodiment, the controller 55 performs the same control with respect to two ink supply mechanisms 30 among eight ink supply mechanisms 30. Therefore, as illustrated in FIG. 3, the eight ink supply mechanisms 30 are subdivided into four groups of the first group 61, the second group 62, the third group 63, and the fourth group 64. In this example, the same control is performed with respect to two ink supply mechanisms 30 belonging to the same group.

Figure 18:
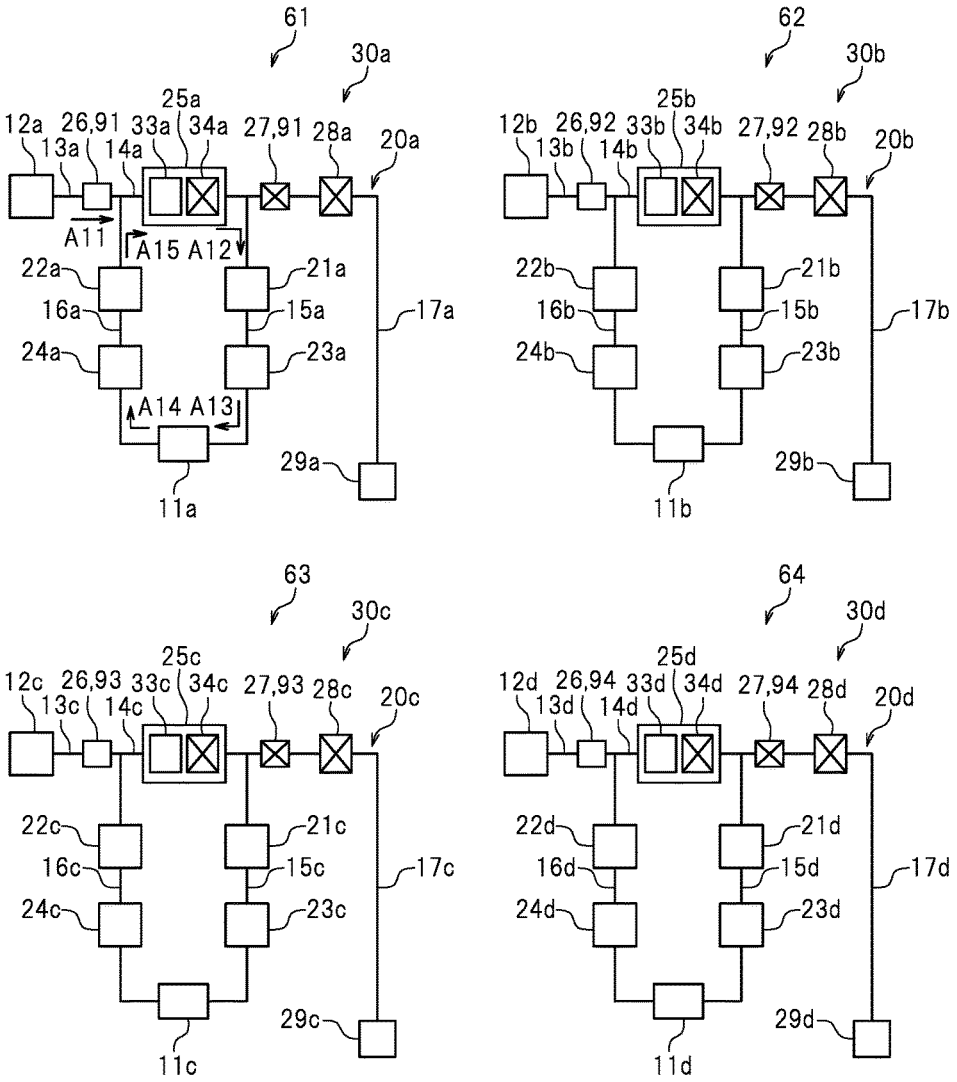
FIG. 18 is a schematic diagram of first to fourth ink supply mechanisms in a printing state.

In the following description, as illustrated in FIG. 18, the ink supply mechanisms 30 belonging to the first group 61, the second group 62, the third group 63, and the fourth group 64 will be appropriately referred to as a first ink supply mechanism 30*a*, a second ink supply mechanism 30*b*, a third ink supply mechanism 30*c*, and a fourth ink supply mechanism 30*d*, respectively. The ink head 11, the ink tank 12, the inlet flow channel 13, the connection flow channel 14, the upstream flow channel 15, the downstream flow channel 16, the outlet flow channel 17, the ink flow channel 20, the upstream pump 21, the downstream pump 22, the upstream damper 23, the downstream damper 24, the air trap 25, the outlet pump 28, and the waste tank 29 of the first ink supply mechanism 30*a* will be appropriately referred to as a first ink head 11*a*, a first ink tank 12*a*, a first inlet flow channel 13*a*, a first connection flow channel 14*a*, a first upstream flow channel 15*a*, a first downstream flow channel 16*a*, a first outlet flow channel 17*a*, a first ink flow channel 20*a*, a first upstream pump 21*a*, a first downstream pump 22*a*, a first upstream damper 23*a*, a first downstream damper 24*a*, a first air trap 25*a*, a first outlet pump 28*a*, and a first waste tank 29*a*, respectively. The ink pouch 33 and the discharge mechanism 34 of the first air trap 25*a* will be referred to as a first ink pouch 33*a* and a first discharge mechanism 34*a*, respectively. In the present preferred embodiment, the first ink pouch 33*a* is an example of a "first air storing section". Moreover, the ink head 11, the ink tank 12, the inlet flow channel 13, the connection flow channel 14, the upstream flow channel 15, the downstream flow channel 16, the outlet flow channel 17, the ink flow channel 20, the upstream pump 21, the downstream pump 22, the upstream damper 23, the downstream damper 24, the air trap 25, the outlet pump 28, and the waste tank 29 of the second ink supply mechanism 30*b* will be appropriately referred to as a second ink head 11*b*, a second ink tank 12*b*, a second inlet flow channel 13*b*, a second connection flow channel 14*b*, a second upstream flow channel 15*b*, a second downstream flow channel 16*b*, a second outlet flow channel 17*b*, a second ink flow channel 20*b*, a second upstream pump 21*b*, a second downstream pump 22*b*, a second upstream damper 23*b*, a second downstream damper 24*b*, a second air trap 25*b*, a second outlet pump 28*b*, and a second waste tank 29*b*, respectively. The ink pouch 33 and the discharge mechanism 34 of the second air trap 25*b* will be referred to as a second ink pouch 33*b* and a second discharge mechanism 34*b*, respectively. In the present preferred embodiment, the second ink pouch 33*b* is an example of a "second air storing section".

Moreover, the ink head 11, the ink tank 12, the inlet flow channel 13, the connection flow channel 14, the upstream flow channel 15, the downstream flow channel 16, the outlet flow channel 17, the ink flow channel 20, the upstream pump 21, the downstream pump 22, the upstream damper 23, the downstream damper 24, the air trap 25, the outlet pump 28, and the waste tank 29 of the third ink supply mechanism 30*c* will be appropriately referred to as a third ink head 11*c*, a third ink tank 12*c*, a third inlet flow channel 13*c*, a third connection flow channel 14*c*, a third upstream flow channel 15*c*, a third downstream flow channel 16*c*, a third outlet flow channel 17*c*, a third ink flow channel 20*c*, a third upstream pump 21*c*, a third downstream pump 22*c*, a third upstream damper 23*c*, a third downstream damper 24*c*, a third air trap 25*c*, a third outlet pump 28*c*, and a third waste tank 29*c*, respectively. The ink pouch 33 and the discharge mechanism 34 of the third air trap 25*c* will be referred to as a third ink pouch 33*c* and a third discharge mechanism 34*c*, respectively. Moreover, the ink head 11, the ink tank 12, the inlet flow channel 13, the connection flow channel 14, the upstream flow channel 15, the downstream flow channel 16, the outlet flow channel 17, the ink flow channel 20, the upstream pump 21, the downstream pump 22, the upstream damper 23, the downstream damper 24, the air trap 25, the outlet pump 28, and the waste tank 29 of the fourth ink supply mechanism 30*d* will be appropriately referred to as a fourth ink head 11*d*, a fourth ink tank 12*d*, a fourth inlet flow channel 13*d*, a fourth connection flow channel 14*d*, a fourth upstream flow channel 15*d*, a fourth downstream flow channel 16*d*, a fourth outlet flow channel 17*d*, a fourth ink flow channel 20*d*, a fourth upstream pump 21*d*, a fourth downstream pump 22*d*, a fourth upstream damper 23*d*, a fourth downstream damper 24*d*, a fourth air trap 25*d*, a fourth outlet pump 28*d*, and a fourth waste tank 29*d*, respectively. The ink pouch 33 and the discharge mechanism 34 of the fourth air trap 25*d* will be referred to as a fourth ink pouch 33*d* and a fourth discharge mechanism 34*d*, respectively.

In the present preferred embodiment, the state of members (specifically, the upstream pump 21, the downstream pump 22, the air trap 25, the inlet valve opening/closing mechanism 26, the outlet valve opening/closing mechanism 27, the outlet pump 28, and the like) controlled by the controller 55 among the members of the ink supply mechanism 30 includes a printing state, a print standby state, an air discharge state, a purging state, an ink filling state, and an ink discharge state. Hereinafter, the control of the controller 55 in the respective states will be described.

First, the control of the controller 55 in the printing state will be described. FIG. 18 is a schematic diagram of the first to fourth ink supply mechanisms 30*a* to 30*d* in the printing state. In the following description of the inlet valve opening/closing mechanism 26 and the outlet valve opening/closing mechanism 27, symbol "X" in the drawings indicates a closed state of the respective valves 91 to 94 of the inlet valve opening/closing mechanism 26 and the outlet valve opening/closing mechanism 27. Moreover, in the first to fourth upstream pumps 21*a* to 21*d*, the first to fourth downstream pumps 22*a* to 22*d*, the discharge mechanisms 34*a* to 34*d* of the first to fourth air traps 25*a* to 25*d*, and the first to fourth outlet pumps 28*a* to 28*d*, symbol "X" indicates a stopped state. Moreover, arrows in the following drawings indicate the flow of ink. As illustrated in FIG. 18, the printing state refers to a state in which printing is performed with respect to the recording medium 5. The printing state refers to a state in which ink is injected from the nozzles 11*aa* of the ink heads 11*a* to 11*d* toward the recording medium 5 placed on the platen 7. In the printing state, ink stored in the ink tanks 12*a* to 12*d* is supplied to the ink heads 11*a* to 11*d*, respectively.

In the printing state, the print control processor 152 (see FIG. 17) of the controller 55 performs control. In the printing state, the same control is performed with respect to the first to fourth ink supply mechanisms 30*a* to 30*d*. In the printing state, the print control processor 152 controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4). In this way, the first to fourth valves 91 to 94 of the inlet valve opening/closing mechanism 26 enter an open state. Therefore, the first to fourth inlet flow channels 13*a* to 13*d* enter an open state. Moreover, in the printing state, the print control processor 152 controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). In this way, the first to fourth valves 91 to 94 of the outlet valve opening/closing mechanism 27 enter a closed state. Therefore, the first to fourth outlet flow channels 17*a* to 17*d* enter a closed state.

Moreover, in the printing state, the print control processor 152 drives the first to fourth upstream pumps 21*a* to 21*d* and the first to fourth downstream pumps 22*a* to 22*d*. Specifically, the print control processor 152 controls driving of the first to fourth upstream pumps 21*a* to 21*d* and the first to fourth downstream pumps 22*a* to 22*d* on the basis of the detection result of the ink storage amount of the ink storing chamber 47 obtained by the detection sensors 48 provided in the first to fourth upstream dampers 23*a* to 23*d* and the detection result of the ink storage amount of the ink storing chamber 47 obtained by the detection sensors 48 provided in the first to fourth downstream dampers 24*a* to 24*d* so that the pressures in the first to fourth ink heads 11*a* to 11*d* become negative. In this way, ink is injected from the nozzles 11*aa* of the first to fourth ink heads 11*a* to 11*d*. In the printing state, the print control processor 152 performs control so that the discharge mechanisms 34*a* to 34*d* of the first to fourth air traps 25*a* to 25*d* and the first to fourth outlet pumps 28*a* to 28*d* are stopped.

In the present preferred embodiment, in the printing state, the flow of ink in the first to fourth ink supply mechanisms 30*a* to 30*d* is the same. For example, in the first ink supply mechanism 30*a*, the ink stored in the first ink tank 12*a* flows into the first connection flow channel 14*a* through the first inlet flow channel 13*a* as indicated by arrow A11. Moreover, in the first ink supply mechanism 30*a*, since the first valve 91 of the outlet valve opening/closing mechanism 27 is closed and the first upstream pump 21*a* and the first downstream pump 22*a* are driven, the ink in the first connection flow channel 14*a* does not flow into the first outlet flow channel 17*a* but flows into the first upstream flow channel 15*a* as indicated by arrow A12. Moreover, by the driving of the first upstream pump 21*a*, the ink in the first upstream flow channel 15*a* is supplied to the first ink head 11*a* as indicated by arrow A13. Here, in the printing state, since the print control processor 152 controls driving of the first upstream pump 21*a* and the first downstream pump 22*a* so that the pressure in the first ink head 11*a* becomes negative, a portion of the ink in the first ink head 11*a* is injected from the nozzle 11*aa* toward the recording medium 5. Moreover, by the driving of the first downstream pump 22*a*, a portion of the remaining ink in the first ink head 11*a* flows into the first downstream flow channel 16*a* as indicated by arrow A14. Moreover, the ink in the first downstream flow channel 16*a* flows into the first connection flow channel 14*a* as indicated by arrow A15.

Figure 19:
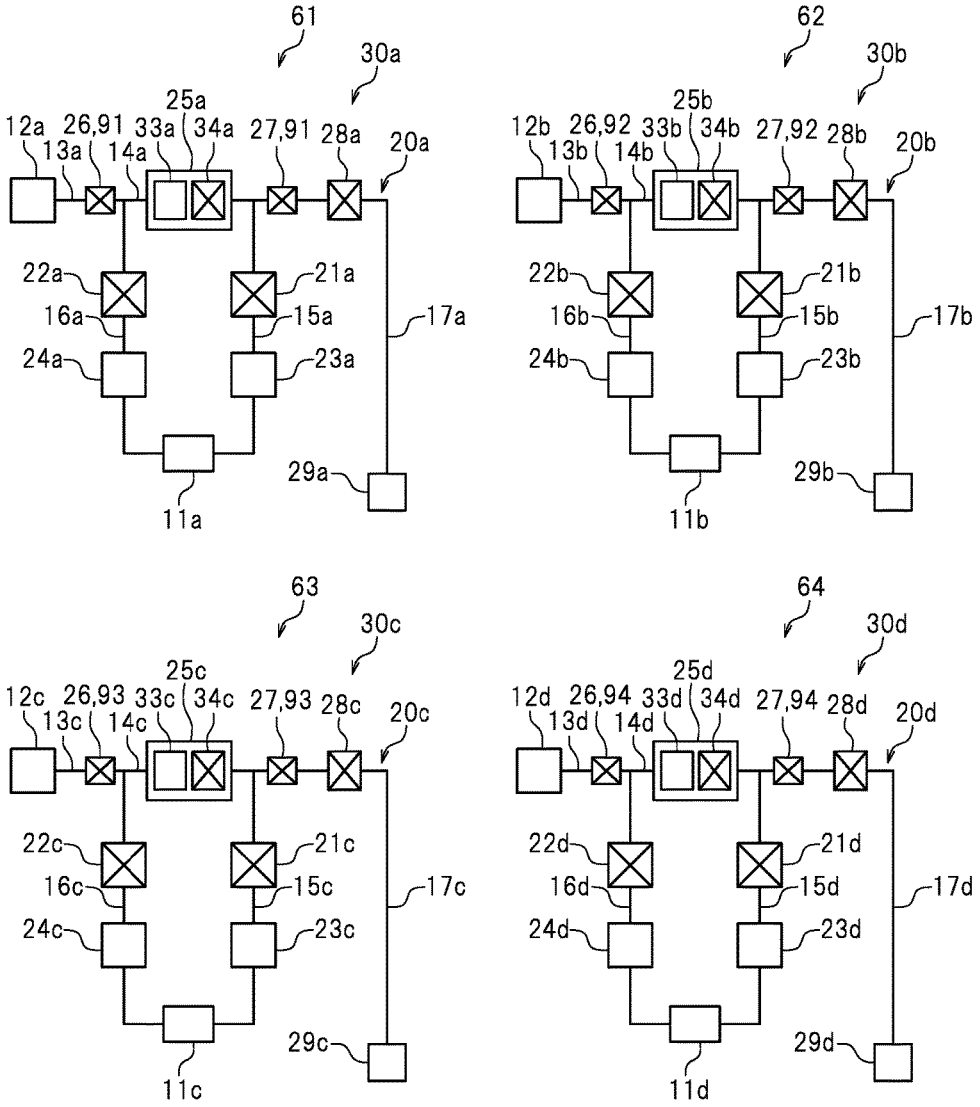
FIG. 19 is a schematic diagram of first to fourth ink supply mechanisms in a print standby state.

Next, the control of the controller 55 in the print standby state will be described. FIG. 19 is a schematic diagram of the first to fourth ink supply mechanisms 30*a* to 30*d* in the print standby state. As illustrated in FIG. 19, the print standby state refers to a state in which printing is not performed with respect to the recording medium 5. The print standby state refers to a state in which the first to fourth ink heads 11*a* to 11*d* are waiting at the home positions. In the print standby state, the print standby control processor 153 (see FIG. 17) of the controller 55 performs control. In the print standby state, the same control is performed with respect to the first to fourth ink supply mechanisms 30*a* to 30*d*. In the print standby state, the print standby control processor 153 controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11). Moreover, the print standby control processor 153 controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). In this way, the first to fourth valves 91 to 94 of the inlet valve opening/closing mechanism 26 and the first to fourth valves 91 to 94 of the outlet valve opening/closing mechanism 27 enter a closed state. Therefore, the first to fourth inlet flow channels 13*a* to 13*d* and the first to fourth outlet flow channels 17*a* to 17*d* enter a closed state. Moreover, in the print standby state, the print standby control processor 153 stops the first to fourth upstream pumps 21*a* to 21*d* and the first to fourth downstream pumps 22*a* to 22*d*. Moreover, in the print standby state, the print standby control processor 153 stops the discharge mechanisms 34*a* to 34*d* of the first to fourth air traps 25*a* to 25*d* and the first to fourth outlet pumps 28*a* to 28*d*.

In the print standby state, in the first to fourth ink supply mechanisms 30*a* to 30*d*, the ink stored in the first to fourth ink tanks 12*a* to 12*d* does not flow into the first to fourth connection flow channels 14*a* to 14*d*, respectively. The ink in the first to fourth connection flow channels 14*a* to 14*d* does not flow into the first to fourth outlet flow channels 17*a* to 17*d*, respectively. Moreover, since the first to fourth upstream pumps 21*a* to 21*d* and the first to fourth downstream pumps 22*a* to 22*d* are stopped, ink is not supplied to the first to fourth ink heads 11*a* to 11*d* and ink is not injected from the first to fourth ink heads 11*a* to 11*d*.

Figure 20:
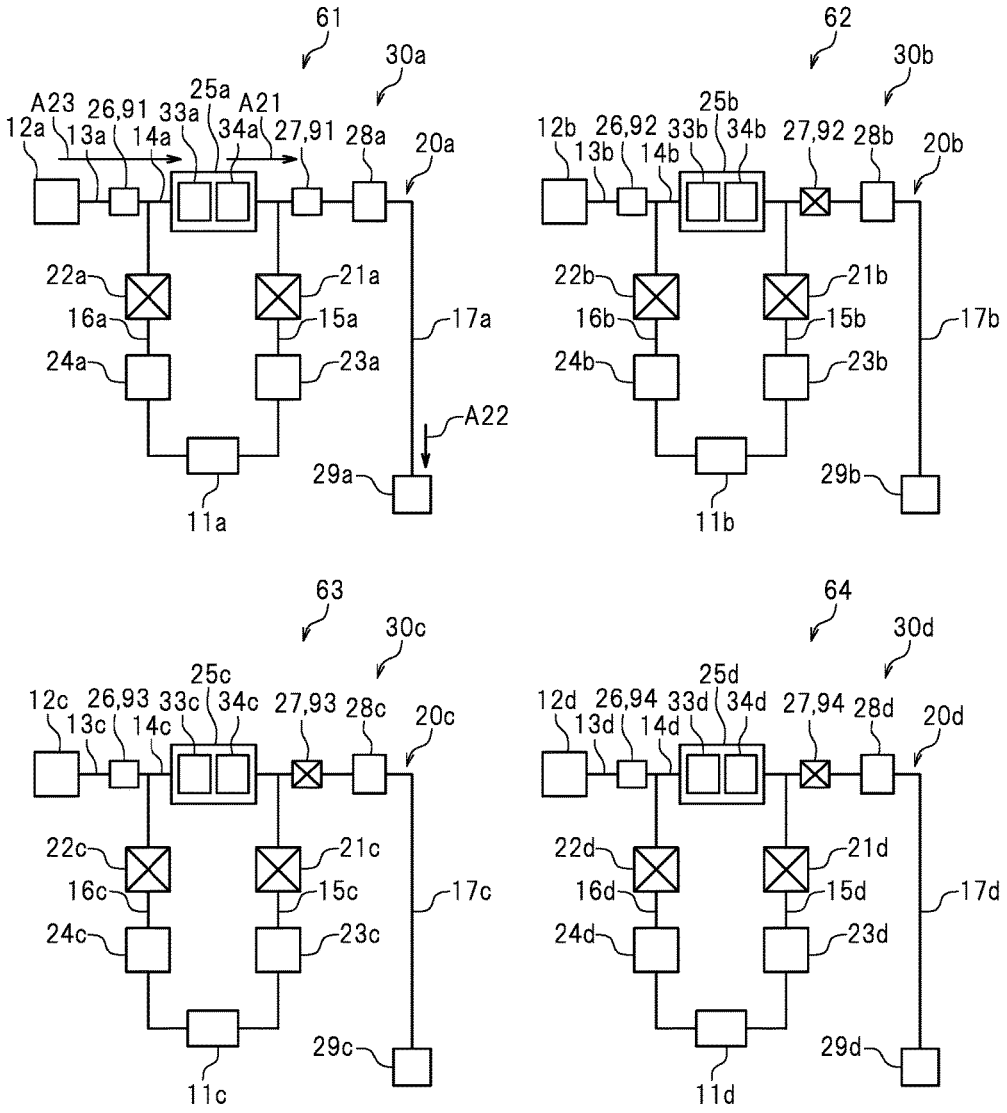
FIG. 20 is a schematic diagram of the first to fourth ink supply mechanisms in an air discharge state.

FIG. 20 is a schematic diagram of the first to fourth ink supply mechanisms 30*a* to 30*d* when an air discharge operation is performed with respect to the first ink supply mechanism 30*a*. As illustrated in FIG. 20, the air discharge state refers to a state in which air trapped in the ink pouch 33 of the air trap 25 is discharged to the outside. In the present preferred embodiment, an air discharge operation is performed with respect to the ink supply mechanism 30 belonging to any one of the first to fourth groups 61 to 64. In the air discharge state, the first air discharge control processor 154*a* performs control when an air discharge operation is performed with respect to the first ink supply mechanism 30*a*. The second air discharge control processor 154*b* performs control when an air discharge operation is performed with respect to the second ink supply mechanism 30*b*. The third air discharge control processor 154*c* performs control when an air discharge operation is performed with respect to the third ink supply mechanism 30*c*. The fourth air discharge control processor 154*d* performs control when an air discharge operation is performed with respect to the fourth ink supply mechanism 30*d*.

For example, when an air discharge operation is performed with respect to the first ink supply mechanism 30*a*, the first air discharge control processor 154*a* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4). In this way, the first to fourth valves 91 to 94 of the inlet valve opening/closing mechanism 26 enter an open state. Therefore, the first to fourth inlet flow channels 13*a* to 13*d* enter an open state. In the air discharge state, the first air discharge control processor 154*a* may control the rotating mechanism 73 of the inlet valve opening/closing mechanism 26 so that the rotating positions of the first to fourth cams 81 to 84 of the inlet valve opening/closing mechanism 26 are at the second position P2 (see FIG. 11).

When an air discharge operation is performed with respect to the first ink supply mechanism 30*a*, the first air discharge control processor 154*a* controls the rotating mechanism 73 of the outlet valve opening/closing mechanism 27 so that the rotating positions of the first to fourth cams 81 to 84 of the outlet valve opening/closing mechanism 27 are at the third position P3 (see FIG. 12). In this way, the first valve 91 of the outlet valve opening/closing mechanism 27 enters an open state and the second to fourth valves 92 to 94 of the outlet valve opening/closing mechanism 27 enter a closed state. Therefore, the first outlet flow channel 17*a* enters an open state and the second to fourth outlet flow channels 17*b* to 17*d* enter a closed state. The first air discharge control processor 154*a* stops the first to fourth upstream pumps 21*a* to 21*d* and the first to fourth downstream pumps 22*a* to 22*d* and drives the discharge mechanisms 34*a* to 34*d* of the first to fourth air traps 25*a* to 25*d*. However, the first air discharge control processor 154*a* may stop the discharge mechanisms 34*b* to 34*d* of the second to fourth air traps 25*b* to 25*d*. Moreover, the first air discharge control processor 154*a* performs control so that the first to fourth outlet pumps 28*a* to 28*d* are driven. However, the first air discharge control processor 154*a* may stop the second to fourth outlet pumps 28*b* to 28*d*.

In the present preferred embodiment, when an air discharge operation is performed with respect to the first ink supply mechanism 30*a*, the first valve 91 of the outlet valve opening/closing mechanism 27 is open and the first air trap 25*a* and the first outlet pump 28*a* are driven. Due to this, the air trapped in the first ink pouch 33*a* of the first air trap 25*a* flows into the first outlet flow channel 17*a* together with the ink in the first ink pouch 33*a* as indicated by arrow A21. Moreover, the air trapped in the first ink pouch 33*a* of the first air trap 25*a* is discharged to the first waste tank 29*a* as indicated by arrow A22. In this case, since the first upstream pump 21*a* and the first downstream pump 22*a* are stopped, the air in the first ink pouch 33*a* of the first air trap 25*a* and the ink do not flow into the first upstream flow channel 15*a*. When an air discharge operation is performed with respect to the first ink supply mechanism 30*a*, the first valve 91 of the inlet valve opening/closing mechanism 26 is open. Due to this, when the air in the first ink pouch 33*a* of the first air trap 25*a* and the ink are discharged, the ink stored in the first ink tank 12*a* is supplied to the first ink pouch 33*a* through the first inlet flow channel 13*a* as indicated by arrow A23. When an air discharge operation is performed with respect to the first ink supply mechanism 30*a*, the second to fourth valves 92 to 94 of the outlet valve opening/closing mechanism 27 are closed. Due to this, in the second to fourth ink supply mechanisms 30*b* to 30*d*, the air in the ink pouches 33*b* to 33*d* of the second to fourth air traps 25*b* to 25*d* is not discharged to the outside.

Although not illustrated in the drawings, when an air discharge operation is performed with respect to the second ink supply mechanism 30*b* in the air discharge state, the second air discharge control processor 154*b* controls the rotating mechanism 73 of the inlet valve opening/closing mechanism 26 so that the rotating positions of the first to fourth cams 81 to 84 of the inlet valve opening/closing mechanism 26 are at any one of the first position P1 (see FIG. 4) and the second position P2 (see FIG. 11). Moreover, the second air discharge control processor 154*b* controls the rotating mechanism 73 of the outlet valve opening/closing mechanism 27 so that the rotating positions of the first to fourth cams 81 to 84 of the outlet valve opening/closing mechanism 27 are at the fourth position P4 (see FIG. 13). The second air discharge control processor 154*b* performs control so that the first to fourth upstream pumps 21*a* to 21*d* and the first to fourth downstream pumps 22*a* to 22*d* are stopped, the first to fourth outlet pumps 28*a* to 28*d* are driven, and the discharge mechanisms 34*a* to 34*d* of the first to fourth air traps 25*a* to 25*d* are driven. In this way, although the air in the ink pouch 33*b* of the second air trap 25*b* of the second ink supply mechanism 30*b* is discharged to the second waste tank 29*b*, the air in the ink pouches 33*a*, 33*c*, and 33*d* of the first, third, and fourth air traps 25*a*, 25*c*, and 25*d* in the first, third, and fourth ink supply mechanisms 30*a*, 30*c*, and 30*d* is not discharged to the outside. The second air discharge control processor 154*b* may stop the discharge mechanisms 34*a*, 34*c*, and 34*d* of the first, third, and fourth air traps 25*a*, 25*c*, and 25*d*. Moreover, the second air discharge control processor 154*b* may stop the first, third, and fourth outlet pumps 28*a*, 28*c*, and 28*d*.

Although not illustrated in the drawings, when an air discharge operation is performed with respect to the third ink supply mechanism 30*c* in the air discharge state, the third air discharge control processor 154*c* controls the rotating mechanism 73 of the inlet valve opening/closing mechanism 26 so that the rotating positions of the first to fourth cams 81 to 84 of the inlet valve opening/closing mechanism 26 are at any one of the first position P1 (see FIG. 4) and the second position P2 (see FIG. 11). Moreover, the third air discharge control processor 154*c* controls the rotating mechanism 73 of the outlet valve opening/closing mechanism 27 so that the rotating positions of the first to fourth cams 81 to 84 of the outlet valve opening/closing mechanism 27 are at the fifth position P5 (see FIG. 14). The third air discharge control processor 154*c* performs control so that the first to fourth upstream pumps 21*a* to 21*d* and the first to fourth downstream pumps 22*a* to 22*d* are stopped, the first to fourth outlet pumps 28*a* to 28*d* are driven, and the discharge mechanisms 34*a* to 34*d* of the first to fourth air traps 25*a* to 25*d* are driven. In this way, although the air in the ink pouch 33*c* of the third air trap 25*c* is discharged to the third waste tank 29*c*, the air in the ink pouches 33*a*, 33*b*, and 33*d* of the first, second, and fourth air traps 25*a*, 25*b*, and 25*d* is not discharged to the outside. The third air discharge control processor 154*c* may stop the discharge mechanisms 34*a*, 34*b*, and 34*d* of the first, second, and fourth air traps 25*a*, 25*b*, and 25*d*. Moreover, the third air discharge control processor 154*c* may stop the first, second, and fourth outlet pumps 28*a*, 28*b*, and 28*d*.

Although not illustrated in the drawings, when an air discharge operation is performed with respect to the fourth ink supply mechanism 30*d* in the air discharge state, the fourth air discharge control processor 154*d* controls the rotating mechanism 73 of the inlet valve opening/closing mechanism 26 so that the rotating positions of the first to fourth cams 81 to 84 of the inlet valve opening/closing mechanism 26 are at any one of the first position P1 (see FIG. 4) and the second position P2 (see FIG. 11). Moreover, the fourth air discharge control processor 154*d* controls the rotating mechanism 73 of the outlet valve opening/closing mechanism 27 so that the rotating positions of the first to fourth cams 81 to 84 of the outlet valve opening/closing mechanism 27 are at the sixth position P6 (see FIG. 15). The fourth air discharge control processor 154*d* performs control so that the first to fourth upstream pumps 21*a* to 21*d* and the first to fourth downstream pumps 22*a* to 22*d* are stopped, the first to fourth outlet pumps 28*a* to 28*d* are driven, and the discharge mechanisms 34*a* to 34*d* of the first to fourth air traps 25*a* to 25*d* are driven. In this way, although the air in the ink pouch 33*d* of the fourth air trap 25*d* is discharged to the fourth waste tank 29*d*, the air in the ink pouches 33*a* to 33*c* of the first to third air traps 25*a* to 25*c* is not discharged to the outside. The fourth air discharge control processor 154*d* may stop the discharge mechanisms 34*a* to 34*c* of the first to third air traps 25*a* to 25*c*. Moreover, the fourth air discharge control processor 154*d* may stop the first to third outlet pumps 28*a* to 28*c*.

Figure 21:
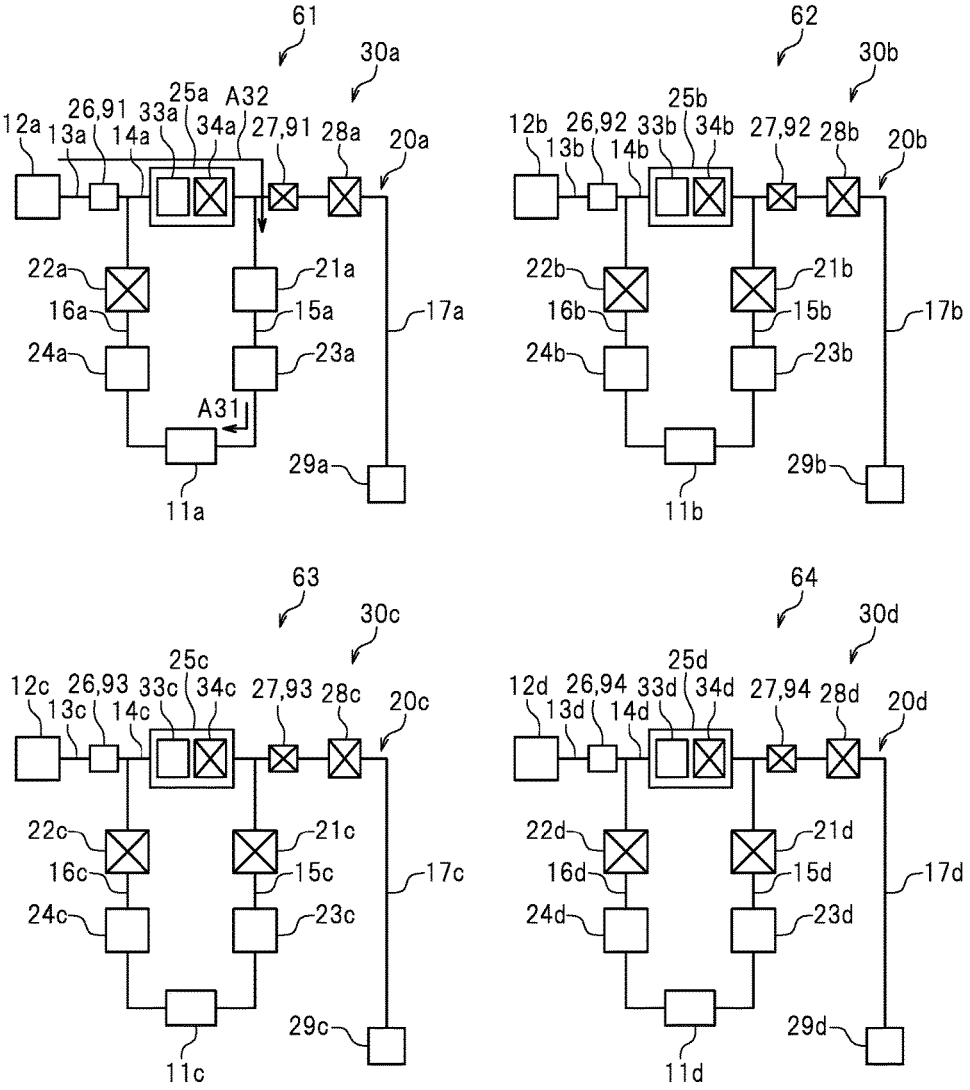
FIG. 21 is a schematic diagram of the first to fourth ink supply mechanisms in a purging state.

Next, the control of the controller 55 in the purging state will be described. FIG. 21 is a schematic diagram of the first to fourth ink supply mechanisms 30*a* to 30*d* when a purging operation is performed with respect to the first ink supply mechanism 30*a*. In the present preferred embodiment, as illustrated in FIG. 21, the purging state refers to a state in which a purging operation is performed in order to eliminate an injection fault in the nozzles 11*aa* when an injection fault occurs in the nozzles 11*aa* of the first to fourth ink heads 11*a* to 11*d*. In the purging state, the first to fourth ink heads 11*a* to 11*d* are positioned at the home positions. Although not illustrated in the drawings, in the purging state, a cap is mounted on the first to fourth ink heads 11*a* to 11*d*. In the purging state, ink is injected from the nozzles 11*aa* of the first to fourth ink heads 11*a* to 11*d* toward the caps. In the present preferred embodiment, in the purging state, the purge control processor 155 (see FIG. 17) of the controller 55 performs control. In the purging state, the purge control processor 155 controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4). Moreover, the purge control processor 155 controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). In this way, the first to fourth inlet flow channels 13*a* to 13*d* enter an open state and the first to fourth outlet flow channels 17*a* to 17*d* enter a closed state. Moreover, the purge control processor 155 drives any one upstream pump 21 of the first to fourth upstream pumps 21*a* to 21*d* and stops the remaining three upstream pumps 21. For example, when an injection fault in the first ink head 11*a* is to be eliminated, the purge control processor 155 drives the first upstream pump 21*a* and stops the second to fourth upstream pumps 21*b* to 21*d* as illustrated in FIG. 21. Although not illustrated in the drawings, when an injection fault in the second ink head lib is to be eliminated, the purge control processor 155 may drive the second upstream pump 21*b* and stop the first, third, and fourth upstream pumps 21*a*, 21*c*, and 21*d*. When an injection fault in the third ink head 11*c* is to be eliminated, the purge control processor 155 may drive the third upstream pump 21*c* and stop the first, second, and fourth upstream pumps 21*a*, 21*b*, and 21*d*. When an injection fault in the fourth ink head 11*d* is to be eliminated, the purge control processor 155 may drive the fourth upstream pump 21*d* and stop the first to third upstream pumps 21*a* to 21*c*. The purge control processor 155 performs control so that the first to fourth downstream pumps 22*a* to 22*d* are stopped or the flow rates therein are decreased and the discharge mechanisms 34*a* to 34*d* of the first to fourth air traps 25*a* to 25*d* and the first to fourth outlet pumps 28*a* to 28*d* are stopped.

In the present preferred embodiment, in the purging state, an injection fault in the ink head 11 of the ink supply mechanism 30, controlled by the upstream pump 21 is eliminated. For example, when the purge control processor 155 drives the first upstream pump 21*a* and stops the second to fourth upstream pumps 21*b* to 21*d*, the first ink head 11*a* is pressurized. In this way, as indicated by arrow A31, the ink in the first upstream flow channel 15*a* is supplied to the first ink head 11*a* and is injected from the nozzles 11*aa* of the first ink head 11*a* toward the cap. In this case, since the second to fourth upstream pumps 21*b* to 21*d* are stopped, ink is not injected from the second to fourth ink heads lib to 11*d*. In the purging state, since the first to fourth downstream pumps 22*a* to 22*d* are stopped or the flow rates of ink in the first to fourth downstream pumps 22*a* to 22*d* are decreased, the ink in the first ink head 11*a* rarely flows into the first downstream flow channel 16*a*. In the purging state, when the purge control processor 155 drives the first upstream pump 21*a* and stops the second to fourth upstream pumps 21*b* to 21*d*, the first inlet flow channel 13*a* is open. Due to this, in the first upstream flow channel 15*a*, the ink stored in the first ink tank 12*a* flows through the first inlet flow channel 13*a* and the first connection flow channel 14*a* as indicated by arrow A32.

Figure 24:
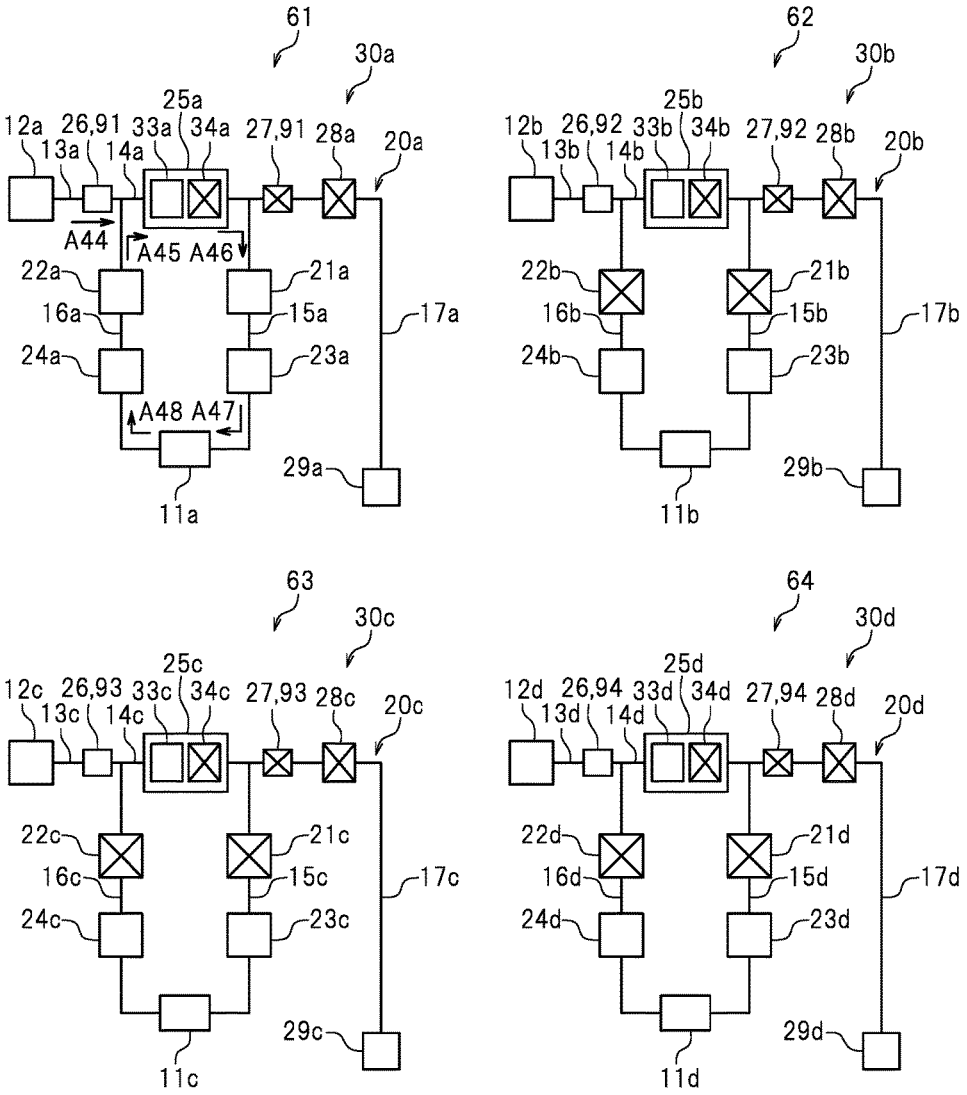
FIG. 24 is a schematic diagram of the first to fourth ink supply mechanisms during third filling control in the ink filling state.
Figure 25:
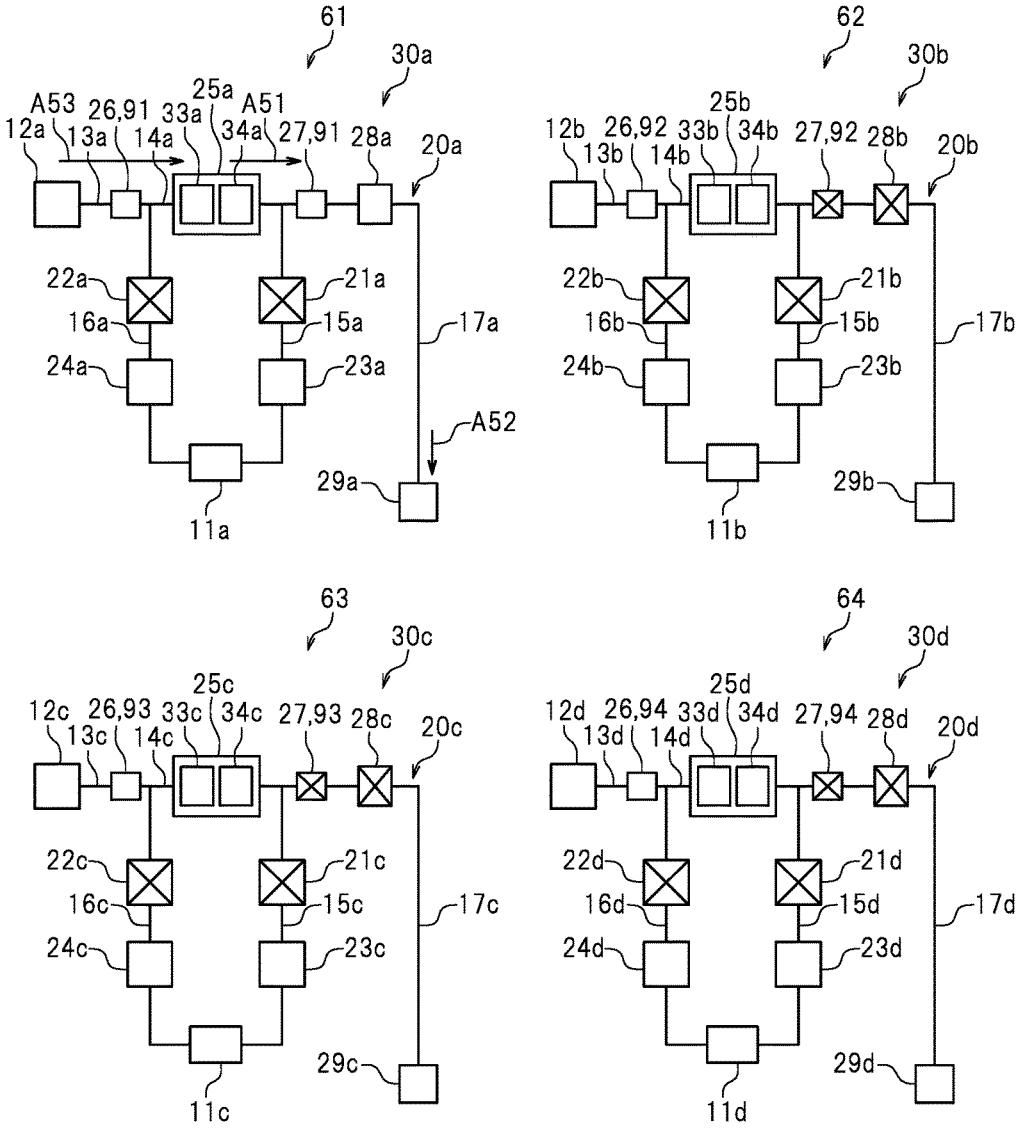
FIG. 25 is a schematic diagram of the first to fourth ink supply mechanisms during fourth filling control in the ink filling state.
Figure 26:
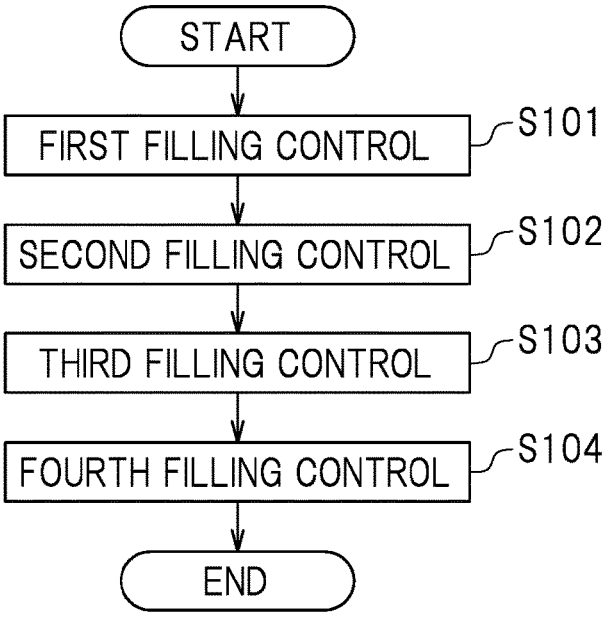
FIG. 26 is a flowchart illustrating the procedure of control of the controller in the ink filling state.

Next, the control of the controller 55 in the ink filling state will be described. FIGS. 22 to 25 are schematic diagrams of the first to fourth ink supply mechanisms 30*a* to 30*d* when an ink filling operation is performed with respect to the first ink supply mechanism 30*a*. FIG. 26 is a flowchart illustrating the procedure of the control of the controller 55 when an ink filling operation is performed with respect to the first ink supply mechanism 30*a*. In the present preferred embodiment, the ink filling state refers to a state in which ink is filled into any one ink flow channel 20 of the first to fourth ink flow channels 20*a* to 20*d*. An ink filling operation is an operation of filling the ink stored in the ink tank 12 into an ink flow channel 20 in which the ink is empty when the ink in any one ink flow channel 20 of the first to fourth ink flow channels 20*a* to 20*d* is empty, for example. In this example, the state in which "the ink in the ink flow channel 20 is empty" includes a state in which the ink in the ink pouch 33 of the air trap 25 is empty.

In the present preferred embodiment, an ink filling operation is performed with respect to the ink supply mechanisms 30 of any one of the first to fourth groups 61 to 64. When an ink filling operation is performed with respect to the first ink supply mechanism 30*a*, as illustrated in FIG. 17, the first of first to fourth of first ink filling control processors 156*a* to 159*a* perform control. When an ink filling operation is performed with respect to the second ink supply mechanism 30*b*, the first of second to fourth of second ink filling control processors 156*b* to 159*b* perform control. When an ink filling operation is performed with respect to the third ink supply mechanism 30*c*, the first of third to fourth of third ink filling control processors 156*c* to 159*c* perform control. When an ink filling operation is performed with respect to the fourth ink supply mechanism 30*d*, the first of fourth to fourth of fourth ink filling control processors 156*d* to 159*d* perform control.

Figure 22:
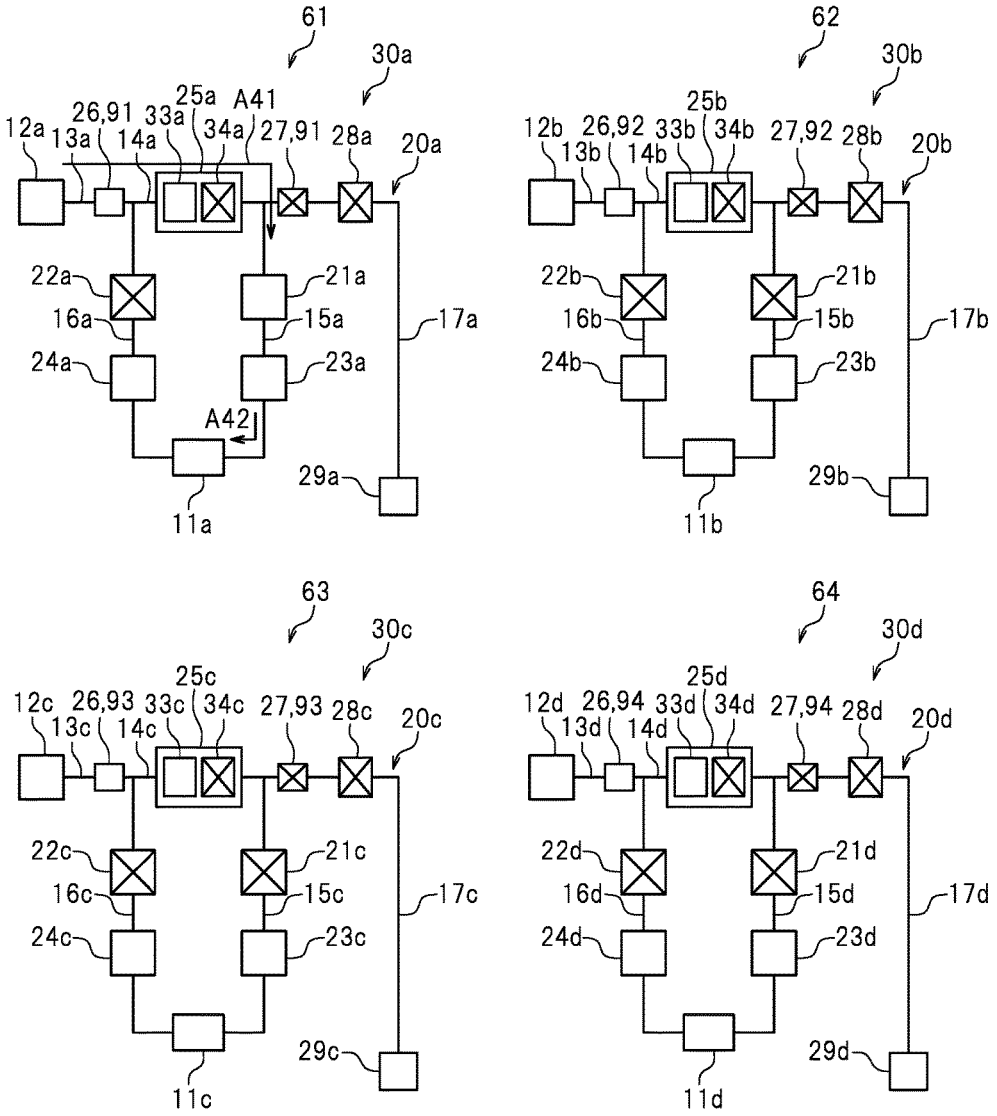
FIG. 22 is a schematic diagram of the first to fourth ink supply mechanisms during first filling control in an ink filling state.

For example, as illustrated in FIG. 26, when an ink filling operation is performed with respect to the first ink supply mechanism 30*a*, first filling control, second filling control, third filling control, and fourth filling control are performed sequentially. First, in step S101, the first of first ink filling control processor 156*a* performs the first filling control. Specifically, as illustrated in FIG. 22, the first of first ink filling control processor 156*a* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). Moreover, the first of first ink filling control processor 156*a* drives the first upstream pump 21*a*, stops the second to fourth upstream pumps 21*b* to 21*d*, and stops the first to fourth downstream pumps 22*a* to 22*d*. Moreover, the first of first ink filling control processor 156*a* stops the discharge mechanisms 34*a* to 34*d* of the first to fourth air traps 25*a* to 25*d* and the first to fourth outlet pumps 28*a* to 28*d*. By the control of the first of first ink filling control processor 156*a*, the ink stored in the first ink tank 12*a* is supplied to the first inlet flow channel 13*a*, the first connection flow channel 14*a*, and the first upstream flow channel 15*a* and ink is filled into the first inlet flow channel 13*a*, the first connection flow channel 14*a*, and the first upstream flow channel 15*a* as indicated by arrows A41 and A42. In the first filling control, the first downstream pump 22*a* is stopped. Due to this, ink does not flow from the first ink head 11*a* to the first downstream flow channel 16*a*.

Figure 23:
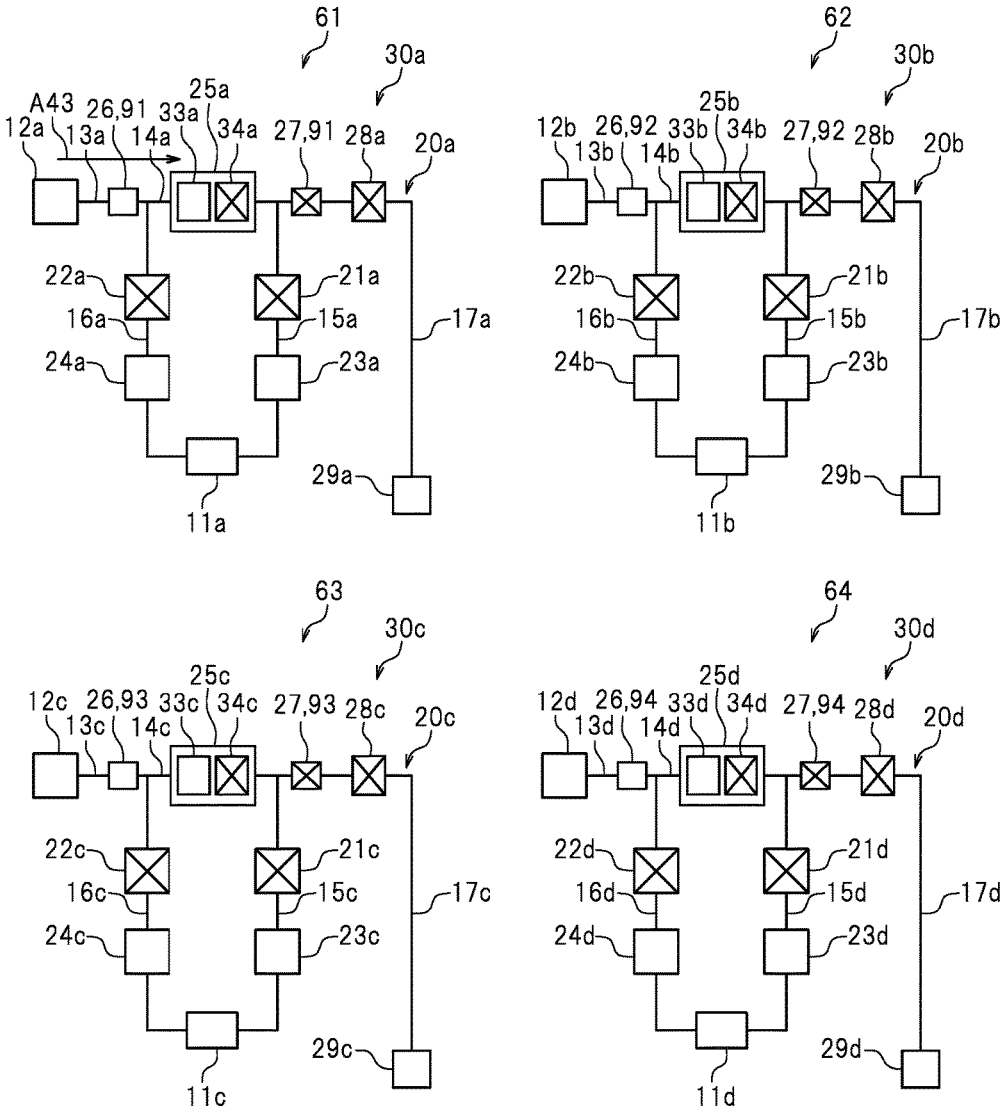
FIG. 23 is a schematic diagram of the first to fourth ink supply mechanisms during second filling control in the ink filling state.

After the first filling control is performed, in step S102 of FIG. 26, the second of first ink filling control processor 157*a* performs the second filling control. As illustrated in FIG. 23, in the second filling control, the second of first ink filling control processor 157*a* stops the first upstream pump 21*a* which is in a driving state. When the second of first ink filling control processor 157*a* performs the second filling control, the ink stored in the first ink tank 12*a* is not supplied to the first upstream flow channel 15*a*. The ink stored in the first ink tank 12*a* is filled into the ink pouch 33*a* of the first air trap 25*a* as indicated by arrow A43. In this example, for example, the second filling control is performed until the storage amount of ink in the ink pouch 33*a* of the first air trap 25*a* reaches a predetermined amount. For example, a predetermined predictable time required for the ink storage amount of the ink pouch 33*a* of the first air trap 25*a* to reach the predetermined amount after the second filling control starts is stored in advance in the storage processor 151 of the controller 55. The second of first ink filling control processor 157*a* determines that the ink storage amount of the first ink pouch 33*a* has reached the predetermined amount and ends the second filling control when the period in which the second filling control was performed reaches a predetermined period or longer.

After the second filling control ends, in step S103 of FIG. 26, the third of first ink filling control processor 158*a* performs the third filling control. As illustrated in FIG. 24, in the third filling control, the third of first ink filling control processor 158*a* drives the first upstream pump 21*a* and the first downstream pump 22*a* which are in a stopped state. When the third of first ink filling control processor 158*a* performs the third filling control, the ink in the first ink tank 12*a* flows into the first connection flow channel 14*a* through the first inlet flow channel 13*a* as indicated by arrow A44. The ink in the first ink flow channel 20*a* circulates by flowing into the first connection flow channel 14*a*, the first upstream flow channel 15*a*, and the first downstream flow channel 16*a* as indicated by arrows A45, A46, A47, and A48. Due to this, ink is filled into the first downstream flow channel 16*a*. In this case, the air in the first downstream flow channel 16*a* is trapped in the ink pouch 33*a* of the first air trap 25*a*. In the third filling control, the third of first ink filling control processor 158*a* may control driving of the first upstream pump 21*a* and the first downstream pump 22*a* so that ink does not leak from the first ink head 11*a*.

After the third filling control ends, in step S104 of FIG. 26, the fourth of first ink filling control processor 159*a* performs the fourth filling control. As illustrated in FIG. 25, in the fourth filling control, the fourth of first ink filling control processor 159*a* controls the rotating mechanism 73 of the outlet valve opening/closing mechanism 27 so that the rotating positions of the first to fourth cams 81 to 84 of the outlet valve opening/closing mechanism 27 are at the third position P3 (see FIG. 12). In this way, the first outlet flow channel 17*a* enters an open state. The second to fourth outlet flow channels 17*b* to 17*d* enter a closed state. Moreover, the fourth of first ink filling control processor 159*a* drives the first discharge mechanism 34*a* of the first air trap 25*a* and the first outlet pump 28*a* and stops the first upstream pump 21*a* and the first downstream pump 22*a*. The fourth of first ink filling control processor 159*a* may drive the discharge mechanisms 34*b* to 34*d* of the second to fourth air traps 25*b* to 25*d* and the second to fourth outlet pumps 28*b* to 28*d*. When the fourth of first ink filling control processor 159*a* performs the fourth filling control, the air trapped in the ink pouch 33*a* of the first air trap 25*a* flows into the first outlet flow channel 17*a* together with the ink in the ink pouch 33*a* as indicated by arrow A51. After that, the air having flown into the first outlet flow channel 17*a* is discharged to the first waste tank 29*a* as indicated by arrow A52. In the fourth filling control, the first upstream pump 21*a* is not driven. Due to this, the air in the ink pouch 33*a* of the first air trap 25*a* and the ink do not flow into the first upstream flow channel 15*a*. Moreover, in the fourth filling control, the first inlet flow channel 13*a* is open. Due to this, the air in the ink pouch 33*a* of the first air trap 25*a* and the ink are discharged such that the ink stored in the first ink tank 12*a* is supplied to the first ink pouch 33*a* as indicated by arrow A53. In this way, ink is filled into the first ink flow channel 20*a* of the first ink supply mechanism 30*a*.

When an ink filling operation is performed with respect to the second to fourth ink supply mechanisms 30*b* to 30*d*, control may be performed in such a manner that the respective elements of the first ink supply mechanism 30*a* when an ink filling operation is performed with respect to the first ink supply mechanism 30*a* are replaced with the respective elements of the ink supply mechanism 30 in which an ink filling operation is to be performed. For example, although not illustrated in the drawings, when an ink filling operation is performed with respect to the second ink supply mechanism 30*b*, first, the first of second ink filling control processor 156*b* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). Moreover, the first of second ink filling control processor 156*b* drives the second upstream pump 21*b*, stops the first, third, and fourth upstream pumps 21*a*, 21*c*, and 21*d*, and stops the first to fourth downstream pumps 22*a* to 22*d*. Moreover, the first of second ink filling control processor 156*b* stops the discharge mechanisms 34*a* to 34*d* of the first to fourth air traps 25*a* to 25*d* and the first to fourth outlet pumps 28*a* to 28*d*.

After the control by the first of second ink filling control processor 156*b* is performed, the second of second ink filling control processor 157*b* performs control so that the second upstream pump 21*b* which is in a driving state is stopped. After the control by the second of second ink filling control processor 157*b* is performed, the third of second ink filling control processor 158*b* performs control so that the second upstream pump 21*b* and the second downstream pump 22*b* which are in a stopped state are driven. After the control by the third of second ink filling control processor 158*b* is performed, the fourth of second ink filling control processor 159*b* controls the rotating mechanism 73 of the outlet valve opening/closing mechanism 27 so that the rotating positions of the first to fourth cams 81 to 84 of the outlet valve opening/closing mechanism 27 are at the fourth position P4 (see FIG. 13). In this way, the second outlet flow channel 17*b* enters an open state and the first, third, and fourth outlet flow channels 17*a*, 17*c*, and 17*d* enter a closed state. Moreover, the fourth of second ink filling control processor 159*b* performs control so that the second upstream pump 21*b* and the second downstream pump 22*b* which are in a driving state are stopped, the discharge mechanism 34*b* of the second air trap 25*b* is driven, and the second outlet pump 28*b* which is in a stopped state is driven. The fourth of second ink filling control processor 159*b* may drive the discharge mechanisms 34*a*, 34*c*, and 34*d* of the first, third, and fourth air traps 25*a*, 25*c*, and 25*d* and the first, third, and fourth outlet pumps 28*a*, 28*c*, and 28*d*. By the above-mentioned procedure, it is possible to fill ink into the second ink flow channel 20*b* of the second ink supply mechanism 30*b*.

For example, although not illustrated in the drawings, when an ink filling operation is performed with respect to the third ink supply mechanism 30*c*, first, the first of third ink filling control processor 156*c* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). Moreover, the first of third ink filling control processor 156*c* drives the third upstream pump 21*c*, stops the first, second, and fourth upstream pumps 21*a*, 21*b*, and 21*d*, and stops the first to fourth downstream pumps 22*a* to 22*d*. Moreover, the first of third ink filling control processor 156*c* stops the discharge mechanisms 34*a* to 34*d* of the first to fourth air traps 25*a* to 25*d* and the first to fourth outlet pumps 28*a* to 28*d*. After the control by the first of third ink filling control processor 156*c* is performed, the second of third ink filling control processor 157*c* performs control so that the third upstream pump 21*c* which is in a driving state is stopped. After the control by the second of third ink filling control processor 157*c* is performed, the third of third ink filling control processor 158*c* performs control so that the third upstream pump 21*c* and the third downstream pump 22*c* which are in a stopped state are driven.

After the control by the third of third ink filling control processor 158*c* is performed, the fourth of third ink filling control processor 159*c* controls the rotating mechanism 73 of the outlet valve opening/closing mechanism 27 so that the rotating positions of the first to fourth cams 81 to 84 of the outlet valve opening/closing mechanism 27 are at the fifth position P5 (see FIG. 14). In this way, the third outlet flow channel 17*c* enters an open state and the first, second, and fourth outlet flow channels 17*a*, 17*b*, and 17*d* enter a closed state. Moreover, the fourth of third ink filling control processor 159*c* performs control so that the third upstream pump 21*c* and the third downstream pump 22*c* which are in a driving state are stopped, the discharge mechanism 34*c* of the third air trap 25*c* is driven, and the third outlet pump 28*c* which is in a stopped state is driven. The fourth of third ink filling control processor 159*c* may drive the discharge mechanisms 34*a*, 34*b*, and 34*d* of the first, second, and fourth air traps 25*a*, 25*b*, and 25*d* and the first, second, and fourth outlet pumps 28*a*, 28*b*, and 28*d*. By the above-mentioned procedure, it is possible to fill ink into the third ink flow channel 20*c* of the third ink supply mechanism 30*c*.

For example, although not illustrated in the drawings, when an ink filling operation is performed with respect to the fourth ink supply mechanism 30*d*, first, the first of fourth ink filling control processor 156*d* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). Moreover, the first of fourth ink filling control processor 156*d* drives the fourth upstream pump 21*d*, stops the first to third upstream pumps 21*a* to 21*c*, and stops the first to fourth downstream pumps 22*a* to 22*d*. Moreover, the first of fourth ink filling control processor 156*d* stops the discharge mechanisms 34*a* to 34*d* of the first to fourth air traps 25*a* to 25*d* and the first to fourth outlet pumps 28*a* to 28*d*. After the control by the first of fourth ink filling control processor 156*d* is performed, the second of fourth ink filling control processor 157*d* performs control so that the fourth upstream pump 21*d* which is in a driving state is stopped. After the control by the second of fourth ink filling control processor 157*d* is performed, the third of fourth ink filling control processor 158*d* performs control so that the fourth upstream pump 21*d* and the fourth downstream pump 22*d* which are in a stopped state are driven.

After the control by the third of fourth ink filling control processor 158*d* is performed, the fourth of fourth ink filling control processor 159*d* controls the rotating mechanism 73 of the outlet valve opening/closing mechanism 27 so that the rotating positions of the first to fourth cams 81 to 84 of the outlet valve opening/closing mechanism 27 are at the sixth position P6 (see FIG. 15). In this way, the fourth outlet flow channel 17*d* enters an open state and the first to third outlet flow channels 17*a* to 17*c* enter a closed state. Moreover, the fourth of fourth ink filling control processor 159*d* performs control so that the fourth upstream pump 21*d* and the fourth downstream pump 22*d* which are in a driving state are stopped, the discharge mechanism 34*d* of the fourth air trap 25*d* is driven, and the fourth outlet pump 28*d* which is in a stopped state is driven. The fourth of fourth ink filling control processor 159*d* may drive the discharge mechanisms 34*a* to 34*c* of the first to third air traps 25*a* to 25*c* and the first to third outlet pumps 28*a* to 28*c*. By the above-mentioned procedure, it is possible to fill ink into the fourth ink flow channel 20*d* of the fourth ink supply mechanism 30*d*.

Figure 27:
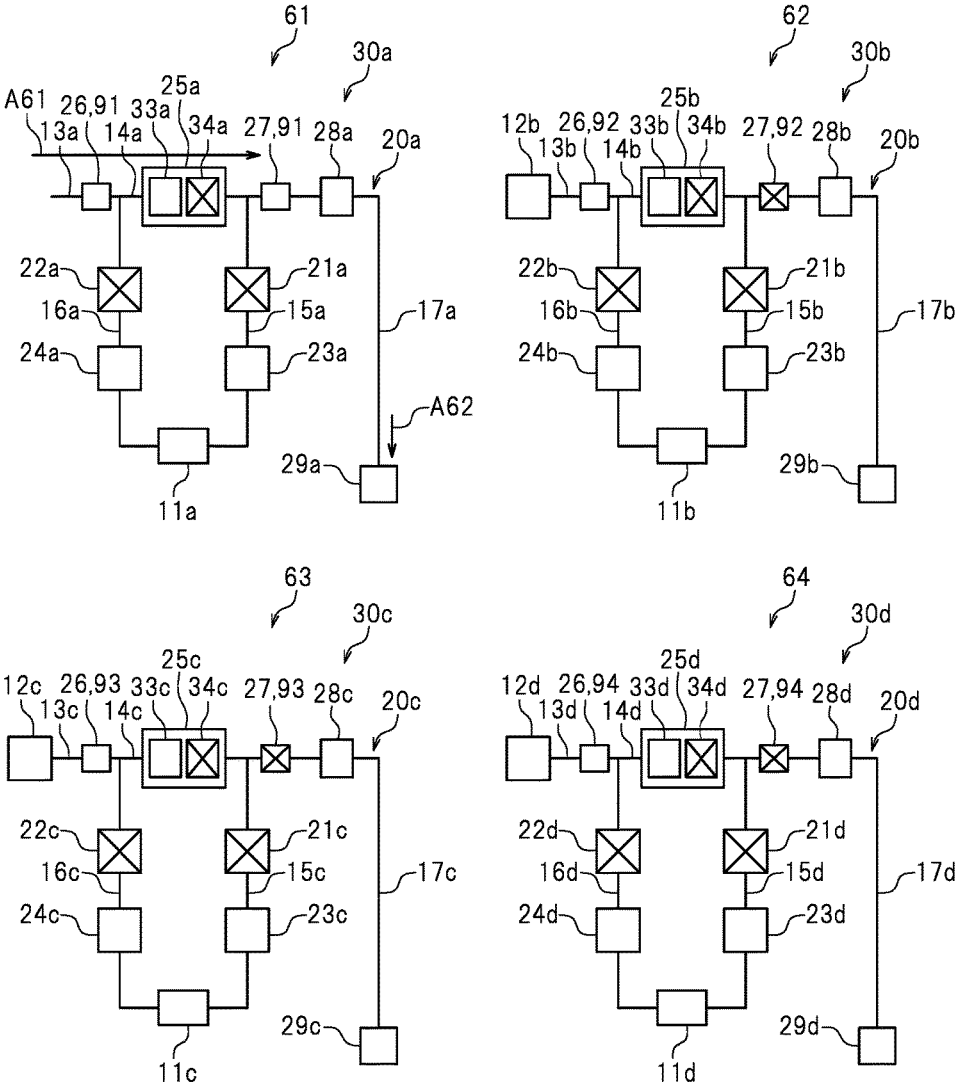
FIG. 27 is a schematic diagram of the first to fourth ink supply mechanisms during first discharge control in an ink discharge state.
Figure 28:
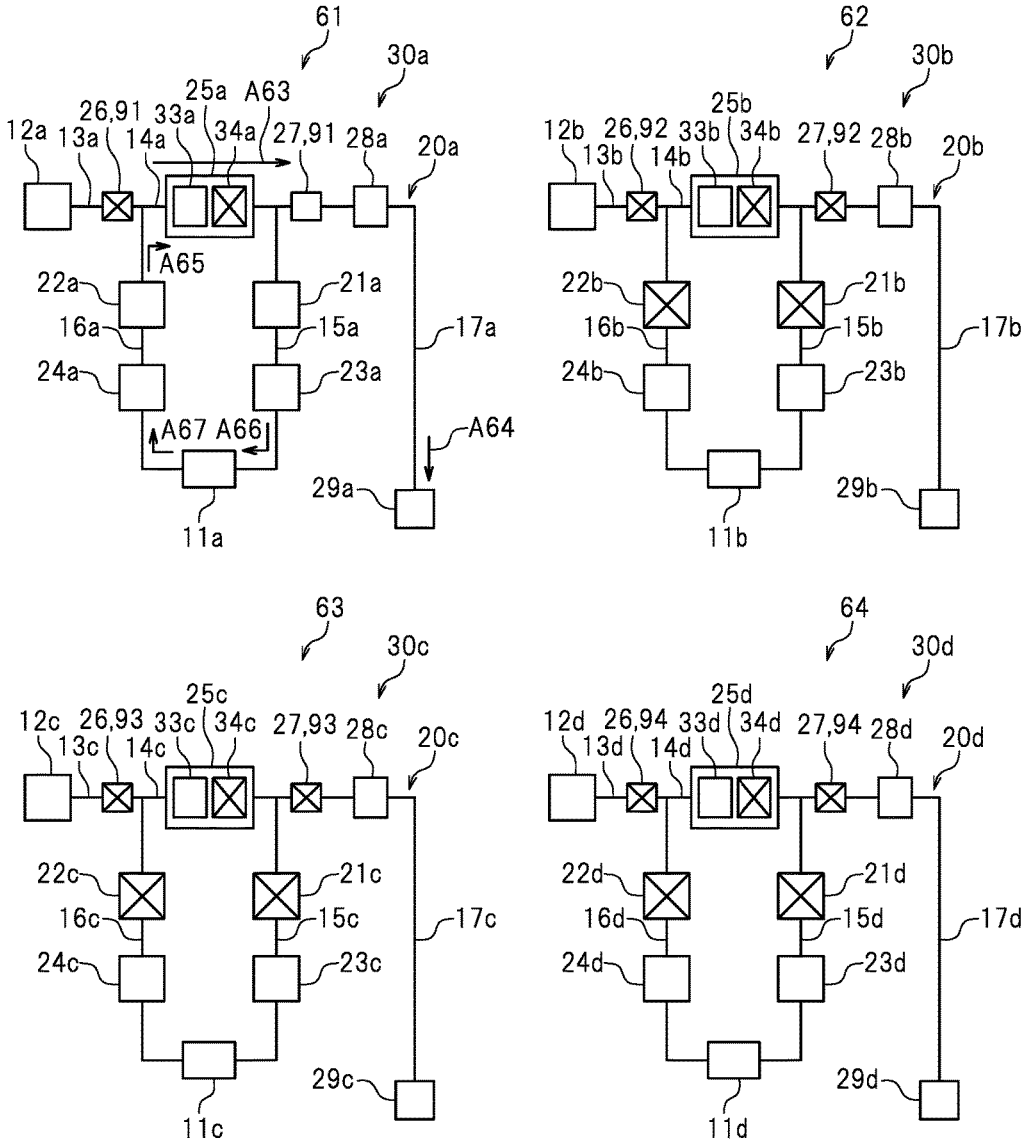
FIG. 28 is a schematic diagram of the first to fourth ink supply mechanisms during second discharge control in the ink discharge state.
Figure 29:
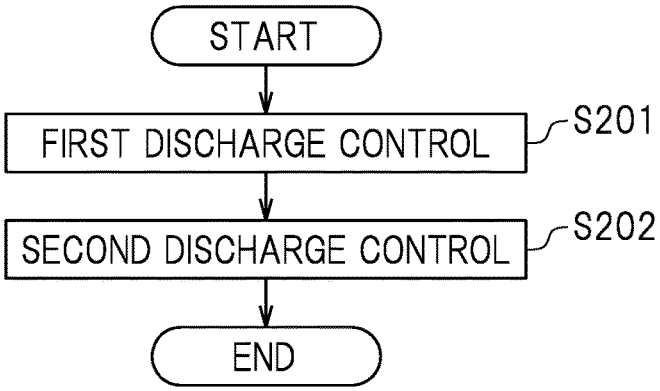
FIG. 29 is a flowchart illustrating the procedure of control of the controller in the ink discharge state.

Next, the control of the controller 55 in the ink discharge state will be described. FIGS. 27 and 28 are schematic diagrams of the first to fourth ink supply mechanisms 30*a* to 30*d* when an ink discharge operation is performed with respect to the first ink supply mechanism 30*a*. FIG. 29 is a flowchart illustrating the procedure of the control of the controller 55 when an ink discharge operation is performed with respect to the first ink supply mechanism 30*a*. In the present preferred embodiment, the ink discharge state refers to a state in which ink in the any one ink flow channel 20 of the first to fourth ink flow channels 20*a* to 20*d* is discharged. For example, when the printer 100 is moved to another place, the printer 100 is put into the ink discharge state so that ink in the first to fourth ink flow channels 20*a* to 20*d* is discharged to the outside. In the ink discharge state, an ink discharge operation is performed with respect to the ink supply mechanism 30 belonging to any one of the first to fourth groups 61 to 64. In this example, as illustrated in FIG. 27, in the ink discharge state, the ink tank 12 is detached from the inlet flow channel 13 of the ink supply mechanism 30 in which an ink discharge operation is performed. The inlet flow channel 13 is structured so that ink does not leak from one end of the inlet flow channel 13 when the ink tank 12 is detached from one end of the inlet flow channel 13.

In the ink discharge state, when an ink discharge operation is performed with respect to the first ink supply mechanism 30*a*, as illustrated in FIG. 17, the first of first ink discharge control processor 161*a* and the second of first ink discharge control processor 162*a* perform control. When an ink discharge operation is performed with respect to the second ink supply mechanism 30*b*, the first of second ink discharge control processor 161*b* and the second of second ink discharge control processor 162*b* perform control. When an ink discharge operation is performed with respect to the third ink supply mechanism 30*c*, the first of third ink discharge control processor 161*c* and the second of third ink discharge control processor 162*c* perform control. When an ink discharge operation is performed with respect to the fourth ink supply mechanism 30*d*, the first of fourth ink discharge control processor 161*d* and the second of fourth ink discharge control processor 162*d* perform control.

For example, as illustrated in FIG. 29, when an ink discharge operation is performed with respect to the first ink supply mechanism 30*a*, first discharge control and second discharge control are performed sequentially. First, in step S201, the first of first ink discharge control processor 161*a* performs the first discharge control. Specifically, as illustrated in FIG. 27, in a state in which the first ink tank 12*a* is detached from the first inlet flow channel 13*a*, the first of first ink discharge control processor 161*a* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the third position P3 (see FIG. 12). In this way, the first to fourth inlet flow channels 13*a* to 13*d* enter an open state. The first outlet flow channel 17*a* enters an open state. The second to fourth outlet flow channels 17*b* to 17*d* enter a closed state. Moreover, the first of first ink discharge control processor 161*a* performs control so that the first to fourth upstream pumps 21*a* to 21*d* and the first to fourth downstream pumps 22*a* to 22*d* are stopped and the first to fourth outlet pumps 28*a* to 28*d* are driven. The first of first ink discharge control processor 161*a* may perform control so that the second to fourth outlet pumps 28*b* to 28*d* are stopped. Moreover, the first of first ink discharge control processor 161*a* performs control so that the discharge mechanisms 34*a* to 34*d* of the first to fourth air traps 25*a* to 25*d* are stopped.

In the first discharge control, the first upstream pump 21*a* and the first downstream pump 22*a* are stopped. Due to this, ink does not circulate in the first ink flow channel 20*a*, and the ink in the first connection flow channel 14*a* does not flow into the first upstream flow channel 15*a*. In the first discharge control, the first inlet flow channel 13*a* and the first outlet flow channel 17*a* are open and the first outlet pump 28*a* is driven. Due to this, the ink in the first inlet flow channel 13*a* is discharged into the first waste tank 29*a* through the first connection flow channel 14*a* and the first outlet flow channel 17*a* as indicated by arrows A61 and A62. In the ink discharge state, the first ink tank 12*a* is not connected to the first inlet flow channel 13*a*. Due to this, ink is not supplied to the first inlet flow channel 13*a*. Therefore, the first inlet flow channel 13*a* enters an ink empty state.

After the first discharge control ends, in step S202 of FIG. 29, the second of first ink discharge control processor 162*a* performs the second discharge control. As illustrated in FIG. 28, in the second discharge control, the second of first ink discharge control processor 162*a* controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11). In this way, the first to fourth inlet flow channels 13*a* to 13*d* enter a closed state. Moreover, the second of first ink discharge control processor 162*a* performs control so that the first upstream pump 21*a* and the first downstream pump 22*a* which are in a stopped state are driven. In the second discharge control, the ink in the first outlet flow channel 17*a* is discharged into the first waste tank 29*a* as indicated by arrow A64. The ink in the first connection flow channel 14*a* is discharged into the first waste tank 29*a* through the first outlet flow channel 17*a* as indicated by arrows A63 and A64. In the second discharge control, the first downstream pump 22*a* is driven. Due to this, the ink in the first downstream flow channel 16*a* is discharged into the first waste tank 29*a* through the first connection flow channel 14*a* and the first outlet flow channel 17*a* as indicated by arrows A65, A63, and A64. Moreover, the first upstream pump 21*a* is driven. Due to this, the ink in the first upstream flow channel 15*a* is discharged into the first waste tank 29*a* through the first downstream flow channel 16*a*, the first connection flow channel 14*a*, and the first outlet flow channel 17*a* as indicated by arrows A66, A67, A65, A63, and A64. In this way, in the second discharge control, the ink in the first connection flow channel 14*a*, the first upstream flow channel 15*a*, the first downstream flow channel 16*a*, and the first outlet flow channel 17*a* is discharged. In this way, the ink in the first ink flow channel 20*a* of the first ink supply mechanism 30*a* is discharged.

When an ink discharge operation is performed with respect to the second to fourth ink supply mechanisms 30*b* to 30*d*, control may be performed in such a manner that the respective elements of the first ink supply mechanism 30*a* when an ink discharge operation is performed with respect to the first ink supply mechanism 30*a* are replaced with the respective elements of the ink supply mechanism 30 in which an ink discharge operation is to be performed. For example, although not illustrated in the drawings, when an ink discharge operation is performed with respect to the second ink supply mechanism 30*b*, in a state in which the second ink tank 12*b* is detached from the second inlet flow channel 13*b*, the first of second ink discharge control processor 161*b* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the fourth position P4 (see FIG. 13). In this way, the first to fourth inlet flow channels 13*a* to 13*d* enter an open state. The second outlet flow channel 17*b* enters an open state. The first, third, and fourth outlet flow channels 17*a*, 17*c*, and 17*d* enter a closed state. Moreover, the first of second ink discharge control processor 161*b* performs control so that the first to fourth upstream pumps 21*a* to 21*d* and the first to fourth downstream pumps 22*a* to 22*d* are stopped and the first to fourth outlet pumps 28*a* to 28*d* are driven. The first of second ink discharge control processor 161*b* may perform control so that the first, third, and fourth outlet pumps 28*a*, 28*c*, and 28*d* are stopped. Moreover, the first of second ink discharge control processor 161*b* performs control so that the discharge mechanisms 34*a* to 34*d* of the first to fourth air traps 25*a* to 25*d* are stopped.

Subsequently, after the control by the first of second ink discharge control processor 161*b* is performed, the second of second ink discharge control processor 162*b* controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11). Moreover, the second of second ink discharge control processor 162*b* performs control so that the second upstream pump 21*b* and the second downstream pump 22*b* which are in a stopped state are driven. By the above-mentioned procedure, it is possible to discharge ink in the second ink flow channel 20*b* of the second ink supply mechanism 30*b*.

For example, although not illustrated in the drawings, when an ink discharge operation is performed with respect to the third ink supply mechanism 30*c*, in a state in which the third ink tank 12*c* is detached from the third inlet flow channel 13*c*, the first of third ink discharge control processor 161*c* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the fifth position P5 (see FIG. 14). In this way, the first to fourth inlet flow channels 13*a* to 13*d* enter an open state. The third outlet flow channel 17*c* enters an open state. The first, second, and fourth outlet flow channels 17*a*, 17*b*, and 17*d* enter a closed state. Moreover, the first of third ink discharge control processor 161*c* performs control so that the first to fourth upstream pumps 21*a* to 21*d* and the first to fourth downstream pumps 22*a* to 22*d* are stopped and the first to fourth outlet pumps 28*a* to 28*d* are driven. The first of third ink discharge control processor 161*c* may perform control so that the first, second, and fourth outlet pumps 28*a*, 28*b*, and 28*d* are stopped. Moreover, the first of third ink discharge control processor 161*c* performs control so that the discharge mechanisms 34*a* to 34*d* of the first to fourth air traps 25*a* to 25*d* are stopped. Subsequently, after the control by the first of third ink discharge control processor 161*c* is performed, the second of third ink discharge control processor 162*c* controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11). Moreover, the second of third ink discharge control processor 162*c* performs control so that the third upstream pump 21*c* and the third downstream pump 22*c* which are in a stopped state are driven. By the above-mentioned procedure, it is possible to discharge ink in the third ink flow channel 20*c* of the third ink supply mechanism 30*c*.

For example, although not illustrated in the drawings, when an ink discharge operation is performed with respect to the fourth ink supply mechanism 30*d*, in a state in which the fourth ink tank 12*d* is detached from the fourth inlet flow channel 13*d*, the first of fourth ink discharge control processor 161*d* controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the sixth position P6 (see FIG. 15). In this way, the first to fourth inlet flow channels 13*a* to 13*d* enter an open state. The fourth outlet flow channel 17*d* enters an open state. The first to third outlet flow channels 17*a* to 17*c* enter a closed state. Moreover, the first of fourth ink discharge control processor 161*d* performs control so that the first to fourth upstream pumps 21*a* to 21*d* and the first to fourth downstream pumps 22*a* to 22*d* are stopped and the first to fourth outlet pumps 28*a* to 28*d* are driven. The first of fourth ink discharge control processor 161*d* may perform control so that the first to third outlet pumps 28*a* to 28*c* are stopped. Moreover, the first of fourth ink discharge control processor 161*d* performs control so that the discharge mechanisms 34*a* to 34*d* of the first to fourth air traps 25*a* to 25*d* are stopped. Subsequently, after the control by the first of fourth ink discharge control processor 161*d* is performed, the second of fourth ink discharge control processor 162*d* controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11). Moreover, the second of fourth ink discharge control processor 162*d* performs control so that the fourth upstream pump 21*d* and the fourth downstream pump 22*d* which are in a stopped state are driven. By the above-mentioned procedure, it is possible to discharge ink in the fourth ink flow channel 20*d* of the fourth ink supply mechanism 30*d*.

As described above, in the present preferred embodiment, as illustrated in FIG. 4, when the rotating shaft 72 is rotated by the rotating mechanism 73, the first to fourth cams 81 to 84 are rotated. Moreover, by rotation of the rotating shaft 72, the rotating positions in the rotating direction R11 of the first to fourth cams 81 to 84 can be any one of the first to sixth positions P1 to P6. For example, as illustrated in FIG. 12, when the flow channel 96 of the first valve 91 is to be open and the flow channels 96 of the second to fourth valves 92 to 94 are to be closed, the rotating shaft 72 may be rotated so that the rotating positions in the rotating direction R11 of the first to fourth cams 81 to 84 are at the third position P3. Therefore, it is possible to control opening and closing of the flow channels 96 of the first to fourth valves 91 to 94 simultaneously by rotating all of the first to fourth cams 81 to 84 with a simple operation of rotating the rotating shaft 72. Therefore, according to the valve opening/closing mechanisms 26 and 27 of the present preferred embodiment, it is possible to prevent the control of opening and closing the plurality of valves 91 to 94 from becoming complex.

In the present preferred embodiment, although four types of cams 81 to 84 of which the relative positions in the rotating direction R11 are different preferably are provided on the rotating shaft 72, for example, the number of types of cams provided on the rotating shaft 72 is not particularly limited. For example, the fourth cam 84 may be omitted. For example, the third and fourth cams 83 and 84 may be omitted.

In the present preferred embodiment, as illustrated in FIG. 4, the first to fourth cams 81 to 84 are provided in at least two sets on the rotating shaft 72. Specifically, as illustrated in FIG. 6, two sets of one of the first to fourth cams 81 to 84 contacts with the opening/closing member 97 of one of the valves 91 to 94. Due to this, for example, it is possible to press the opening/closing member 97 of one first valve 91 using two first cams 81 in a direction of closing the flow channel 96. Therefore, it is possible to press the opening/closing member 97 more stably than a case of pressing the opening/closing member 97 of one first valve 91 using one first cam 81.

In the present preferred embodiment, as illustrated in FIGS. 7 and 8, the first to fourth cams 81 to 84 preferably have the same shape. Due to this, the first to fourth cams 81 to 84 can be produced using the same mold. Therefore, it is possible to reduce the manufacturing cost as compared to a case in which the first to fourth cams 81 to 84 have different shapes.

In the present preferred embodiment, the first cam 81 and the second cam 82 are provided on the rotating shaft 72 in the same orientation with respect to an axial direction of the rotating shaft 72. The third cam 83 and the fourth cam 84 are provided on the rotating shaft 72 in the same orientation with respect to the axial direction of the rotating shaft 72 such that the first cam 81 is reversed with respect to the axial direction of the rotating shaft 72. In this way, by providing the third cam 83 and the fourth cam 84 so as to be reversed with respect to the axial direction of the rotating shaft 72, it is possible to realize a plurality of patterns of opening and closing the flow channels 96 of the first to fourth valves 91 to 94 using the cams 81 to 84 having a simpler shape.

In the present preferred embodiment, as illustrated in FIG. 4, the lock mechanism 74 locks the positions of the first to fourth cams 81 to 84 in a state in which the rotating positions in the rotating direction R11 of the first to fourth cams 81 to 84 are at the second position P2 (see FIG. 11). For example, in a state in which a main power source is turned off contrary to a user's intention such as in the event of power failure, when the flow channel 96 of any one of the first to fourth valves 91 to 94 is open, the ink stored in the ink tank 12 is able to be supplied to the ink head 11 through the inlet flow channel 13. However, in the present preferred embodiment, when a main power source is turned off, the first to fourth cams 81 to 84 are locked by the lock mechanism 74 when the rotating positions in the rotating direction R11 of the first to fourth cams 81 to 84 are at the second position P2. Therefore, when a main power source is turned off, for example, the inlet flow channel 13 enters a closed state. Due to this, it is possible to prevent ink from being supplied to the ink head 11.

In the present preferred embodiment, as illustrated in FIG. 18, in the printing state, the print control processor 152 controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and performs control so that the first to fourth upstream pumps 21*a* to 21*d* and the first to fourth downstream pumps 22*a* to 22*d* are driven. In this way, in the printing state, it is possible to supply the ink stored in the first to fourth ink tanks 12*a* to 12*d* to the first to fourth ink heads 11*a* to 11*d*, respectively.

In the present preferred embodiment, as illustrated in FIG. 19, the print standby control processor 153 controls the rotating mechanism 73 of the inlet valve opening/closing mechanism 26 so that the rotating positions of the first to fourth cams 81 to 84 of the inlet valve opening/closing mechanism 26 are at the second position P2 (see FIG. 11) and controls the rotating mechanism 73 of the outlet valve opening/closing mechanism 27 so that the rotating positions of the first to fourth cams 81 to 84 of the outlet valve opening/closing mechanism 27 are at the second position P2. Moreover, the print standby control processor 153 performs control so that the first to fourth upstream pumps 21*a* to 21*d* and the first to fourth downstream pumps 22*a* to 22*d* are stopped. In this way, in the print standby state, it is possible to prevent ink from flowing into the first to fourth ink heads 11*a* to 11*d*. In the print standby state, it is possible to prevent ink from leaking from the first to fourth ink heads 11*a* to 11*d*. Moreover, in the print standby state, it is possible to prevent the ink in the first to fourth ink tanks 12*a* to 12*d* from flowing into the first to fourth connection flow channels 14*a* to 14*d*.

In the present preferred embodiment, for example, in the air discharge state, when an air discharge operation is performed with respect to the first ink supply mechanism 30*a*, the first air discharge control processor 154*a* performs control. When an air discharge operation is performed with respect to the second ink supply mechanism 30*b*, the second air discharge control processor 154*b* performs control. When an air discharge operation is performed with respect to the third ink supply mechanism 30*c*, the third air discharge control processor 154*c* performs control. When an air discharge operation is performed with respect to the fourth ink supply mechanism 30*d*, the fourth air discharge control processor 154*d* performs control. For example, when an air discharge operation is performed with respect to the first ink supply mechanism 30*a*, as illustrated in FIG. 20, the first upstream pump 21*a* and the first downstream pump 22*a* are stopped. Due to this, it is possible to prevent the air trapped in the first ink pouch 33*a* of the first air trap 25*a* from flowing into the first upstream flow channel 15*a* and the first downstream flow channel 16*a*. Therefore, it is possible to prevent the first ink head 11*a* from injecting the ink containing air mixed therein during printing.

In the present preferred embodiment, as illustrated in FIG. 21, the purge control processor 155 controls the rotating mechanism 73 of the inlet valve opening/closing mechanism 26 so that the rotating positions of the first to fourth cams 81 to 84 of the inlet valve opening/closing mechanism 26 are at the first position P1 (see FIG. 4) and controls the rotating mechanism 73 of the outlet valve opening/closing mechanism 27 so that the rotating positions of the first to fourth cams 81 to 84 of the outlet valve opening/closing mechanism 27 are at the second position P2 (see FIG. 11). Moreover, the purge control processor 155 performs control so that the upstream pump 21 of any one of the first to fourth upstream pumps 21*a* to 21*d* is driven, the remaining upstream pumps 21 are stopped, and the first to fourth downstream pumps 22*a* to 22*d* are stopped. In this way, ink is injected from the ink head 11 of the ink supply mechanism 30, driven by the upstream pump 21, and the ink in the ink tank 12 is supplied to the ink head 11 through the upstream flow channel 15. Therefore, by putting the printer into the purging state when an injection fault occurs, it is possible to eliminate an injection fault.

In the present preferred embodiment, for example, when an ink filling operation is performed with respect to the first ink supply mechanism 30*a*, as illustrated in FIG. 17, the first of first to fourth of first ink filling control processors 156*a* to 159*a* perform control. When an ink filling operation is performed with respect to the second ink supply mechanism 30*b*, the first of second to fourth of second ink filling control processors 156*b* to 159*b* perform control. When an ink filling operation is performed with respect to the third ink supply mechanism 30*c*, the first of third to fourth of third ink filling control processors 156*c* to 159*c* perform control. When an ink filling operation is performed with respect to the fourth ink supply mechanism 30*d*, the first of fourth to fourth of fourth ink filling control processors 156*d* to 159*d* perform control. For example, when an ink filling operation is performed with respect to the first ink supply mechanism 30*a*, as illustrated in FIG. 22, it is possible to fill ink into the first connection flow channel 14*a* and the first upstream flow channel 15*a* by the control of the first of first ink filling control processor 156*a*. Moreover, as illustrated in FIG. 23, it is possible to fill ink into the first ink pouch 33*a* of the first air trap 25*a* by the control of the second of first ink filling control processor 157*a*. Moreover, as illustrated in FIG. 24, by the control of the third of first ink filling control processor 158*a*, the ink in the first ink tank 12*a* flows into the first downstream flow channel 16*a* through the first connection flow channel 14*a* and the first upstream flow channel 15*a*. Due to this, it is possible to fill ink into the first downstream flow channel 16*a*. By the control of the first of first to third of first ink filling control processor s 156*a* to 158*a*, the air in the first ink flow channel 20*a* is trapped in the ink pouch 33*a* of the first air trap 25*a*. Therefore, as illustrated in FIG. 25, by the control of the fourth of first ink filling control processor 159*a*, the air trapped in the ink pouch 33*a* of the first air trap 25*a* is discharged into the first waste tank 29*a* through the first outlet flow channel 17*a* together with ink. Therefore, by the control of the first of first to fourth of first ink filling control processors 156*a* to 159*a*, it is possible to fill ink into the first ink flow channel 20*a* in which the ink is empty and to remove the air in the first ink flow channel 20*a*.

In the present preferred embodiment, in the ink discharge state, when an ink discharge operation is performed with respect to the first ink supply mechanism 30*a*, as illustrated in FIG. 17, the first of first and second of first ink discharge control processors 161*a* and 162*a* perform control. When an ink discharge operation is performed with respect to the second ink supply mechanism 30*b*, the first of second and second of second ink discharge control processors 161*b* and 162*b* perform control. When an ink discharge operation is performed with respect to the third ink supply mechanism 30*c*, the first of third and second of third ink discharge control processors 161*c* and 162*c* perform control. When an ink discharge operation is performed with respect to the fourth ink supply mechanism 30*d*, the first of fourth and second of fourth ink discharge control processors 161*d* and 162*d* perform control. For example, when an ink discharge operation is performed with respect to the first ink supply mechanism 30*a*, as illustrated in FIG. 27, it is possible to cause the ink in the first inlet flow channel 13*a* to flow into the first connection flow channel 14*a* by the control of the first of first ink discharge control processor 161*a*. Due to this, a state in which the ink in the first inlet flow channel 13*a* is empty can be created. Moreover, as illustrated in FIG. 28, it is possible to discharge the ink in the first outlet flow channel 17*a* into the first waste tank 29*a* by the control of the second of first ink discharge control processor 162*a*. The ink in the first connection flow channel 14*a* can be discharged into the first waste tank 29*a* through the first outlet flow channel 17*a*. The ink in the first downstream flow channel 16*a* can be discharged into the first waste tank 29*a* through the first connection flow channel 14*a* and the first outlet flow channel 17*a*. Moreover, the ink in the first upstream flow channel 15*a* can be discharged into the first waste tank 29*a* through the first downstream flow channel 16*a*, the first connection flow channel 14*a*, and the first outlet flow channel 17*a*. Therefore, by discharging the ink in the first ink flow channel 20*a* by the control of the first of first and second of first ink discharge control processors 161*a* and 162*a*, it is possible to create a state in which ink is not filled in the first ink flow channel 20*a*.

In the present preferred embodiment, the valve opening/closing mechanisms 26 and 27 each preferably include sixteen cams 81 to 84 and eight valves 91 to 94, for example. Moreover, opening/closing of one valve is controlled preferably using two cams, for example. However, the number of cams and the number of valves provided in each of the valve opening/closing mechanisms 26 and 27 are not particularly limited. For example, the valve opening/closing mechanism may include sixteen cams and sixteen valves and the cam and the valve may be paired with each other. In this case, opening/closing of one valve may be controlled using one cam, for example. Moreover, for example, the valve opening/closing mechanism may include eight cams and eight valves. In this case, opening/closing of one valve may be controlled using one cam, for example. Moreover, the number of cams may be different from the number of valves. For example, opening/closing of some of all valves may be controlled by one cam, and opening/closing of the remaining valves may be controlled by a plurality of cams (for example, two cams). The above-described configuration of the valve opening/closing mechanism includes unique technical features of a preferred embodiment of the present invention.

The respective processors of the controller 55 may be configured as software. That is, the respective processors may be realized by a computer when the computer executes a computer program. The present invention includes a printing computer program for causing a computer to function as the respective processors. Moreover, the present invention includes a computer-readable recording medium having the computer program recorded thereon. Moreover, the respective processors may be processors realized by executing a computer program stored in the controller 55. In this case, the respective processors may be realized by one processor or may be realized by a plurality of processors. Moreover, the present invention includes a circuit in which the same functions as the programs executed by the respective processors are realized.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A valve opening/closing mechanism comprising:

a rotating shaft;

a first cam provided on the rotating shaft so as to rotate together with the rotating shaft;

a first valve including a first flow channel in which ink flows and a first opening/closing member that is disposed at a position at which the first opening/closing member contacts with the first cam so as to open or close the first flow channel, depending on whether the first opening/closing member makes contact with the first cam;

a second cam provided on the rotating shaft so as to rotate together with the rotating shaft;

a second valve including a second flow channel in which ink flows and a second opening/closing member that is disposed at a position at which the second opening/closing member contacts with the second cam so as to open or close the second flow channel, depending on whether the second opening/closing member makes contact with the second cam; and a rotating mechanism to rotate the rotating shaft; wherein rotating positions of the first and second cams, when the first opening/closing member opens the first flow channel and the second opening/closing member opens the second flow channel, are defined as a first position;

rotating positions of the first and second cams, when the first opening/closing member closes the first flow channel and the second opening/closing member closes the second flow channel, are defined as a second position;

rotating positions of the first and second cams, when the first opening/closing member opens the first flow channel and the second opening/closing member closes the second flow channel, are defined as a third position;

rotating positions of the first and second cams, when the first opening/closing member closes the first flow channel and the second opening/closing member opens the second flow channel, are defined as a fourth position;

when the rotating shaft is rotated by the rotating mechanism, the rotating positions of the first and second cams are at any of the first, second, third, and fourth positions; and the first cam and the second cam have a same shape.

2. The valve opening/closing mechanism according to claim 1, wherein the first cam and the second cam are provided in at least two sets on the rotating shaft;

the at least two first cams contact with the first opening/closing member; and the at least two second cams contact with the second opening/closing member.

3. The valve opening/closing mechanism according to claim 1, further comprising a lock that locks positions of the first and second cams in a state in which the rotating positions of the first and second cams are at the second position.

4. The valve opening/closing mechanism according to claim 1, further comprising:

a third cam provided on the rotating shaft so as to rotate together with the rotating shaft; and a third valve including a third flow channel in which ink flows and a third opening/closing member that is disposed at a position at which the third opening/closing member contacts with the third cam so as to open or close the third flow channel, depending on whether the third opening/closing member makes contact with the third cam; wherein rotating positions of the first, second, and third cams, when the first opening/closing member closes the first flow channel, the second opening/closing member closes the second flow channel, and the third opening/closing member opens the third flow channel, are defined as a fifth position;

the first position is the rotating positions of the first, second, and third cams, when the first opening/closing member opens the first flow channel, the second opening/closing member opens the second flow channel, and the third opening/closing member opens the third flow channel;

the second position is the rotating positions of the first, second, and third cams, when the first opening/closing member closes the first flow channel, the second opening/closing member closes the second flow channel, and the third opening/closing member closes the third flow channel;

the third position is the rotating positions of the first, second, and third cams, when the first opening/closing member opens the first flow channel, the second opening/closing member closes the second flow channel, and the third opening/closing member closes the third flow channel;

the fourth position is the rotating positions of the first, second, and third cams, when the first opening/closing member closes the first flow channel, the second opening/closing member opens the second flow channel, and the third opening/closing member closes the third flow channel; and when the rotating shaft is rotated by the rotating mechanism, the rotating positions of the first, second, and third cams are at any of the first, second, third, fourth, and fifth positions.

5. The valve opening/closing mechanism according to claim 4, further comprising:

a fourth cam provided on the rotating shaft so as to rotate together with the rotating shaft; and a fourth valve including a fourth flow channel in which ink flows and a fourth opening/closing member that is disposed at a position at which the fourth opening/closing member contacts with the fourth cam so as to open or close the fourth flow channel, depending on whether the fourth opening/closing member makes contact with the fourth cam; wherein the rotating positions of the first, second, third, and fourth cams, when the first opening/closing member closes the first flow channel, the second opening/closing member closes the second flow channel, the third opening/closing member closes the third flow channel, and the fourth opening/closing member opens the fourth flow channel, are defined as a sixth position;

the first position is the rotating positions of the first, second, third, and fourth cams, when the first opening/closing member opens the first flow channel, the second opening/closing member opens the second flow channel, the third opening/closing member opens the third flow channel, and the fourth opening/closing member opens the fourth flow channel;

the second position is the rotating positions of the first, second, third, and fourth cams, when the first opening/closing member closes the first flow channel, the second opening/closing member closes the second flow channel, the third opening/closing member closes the third flow channel, and the fourth opening/closing member closes the fourth flow channel;

the third position is the rotating positions of the first, second, third, and fourth cams, when the first opening/closing member opens the first flow channel, the second opening/closing member closes the second flow channel, the third opening/closing member closes the third flow channel, and the fourth opening/closing member closes the fourth flow channel;

the fourth position is the rotating positions of the first, second, third, and fourth cams, when the first opening/closing member closes the first flow channel, the second opening/closing member opens the second flow channel, the third opening/closing member closes the third flow channel, and the fourth opening/closing member closes the fourth flow channel;

the fifth position is the rotating positions of the first, second, third, and fourth cams when the first opening/closing member closes the first flow channel, the second opening/closing member closes the second flow channel, the third opening/closing member opens the third flow channel, and the fourth opening/closing member closes the fourth flow channel; and when the rotating shaft is rotated by the rotating mechanism, the rotating positions of the first, second, third, and fourth cams are at any of the first, second, third, fourth, fifth, and sixth positions.

6. The valve opening/closing mechanism according to claim 5, wherein the first, second, third, and fourth cams have a same shape;

the first and second cams are provided on the rotating shaft in a same orientation with respect to an axial direction of the rotating shaft;

the third and fourth cams are provided on the rotating shaft in a same orientation with respect to the axial direction of the rotating shaft so as to be disposed in such an orientation that the first cam is reversed with respect to the axial direction of the rotating shaft.

7. An ink supply system comprising:

a value opening/closing mechanism includes:

a rotating shaft;

a first cam provided on the rotating shaft so as to rotate together with the rotating shaft;

a first valve including a first flow channel in which ink flows and a first opening/closing member that is disposed at a position at which the first opening/closing member contacts with the first cam so as to open or close the first flow channel, depending on whether the first opening/closing member makes contact with the first cam;

a second cam provided on the rotating shaft so as to rotate together with the rotating shaft;

a second valve including a second flow channel in which ink flows and a second opening/closing member that is disposed at a position at which the second opening/closing member contacts with the second cam so as to open or close the second flow channel, depending on whether the second opening/closing member makes contact with the second cam; and a rotating mechanism to rotate the rotating shaft; wherein rotating positions of the first and second cams, when the first opening/closing member opens the first flow channel and the second opening/closing member opens the second flow channel, are defined as a first position;

rotating positions of the first and second cams, when the first opening/closing member closes the first flow channel and the second opening/closing member closes the second flow channel, are defined as a second position;

rotating positions of the first and second cams, when the first opening/closing member opens the first flow channel and the second opening/closing member closes the second flow channel, are defined as a third position;

rotating positions of the first and second cams, when the first opening/closing member closes the first flow channel and the second opening/closing member opens the second flow channel, are defined as a fourth position;

when the rotating shaft is rotated by the rotating mechanism, the rotating positions of the first and second cams are at any of the first, second, third, and fourth positions;

an inlet valve opening/closing mechanism including the valve opening/closing mechanism;

a first ink supply mechanism including first ink and in which the first ink flows; and a second ink supply mechanism including second ink and in which the second ink flows; wherein the first ink supply mechanism includes:

a first ink tank in which the first ink is stored;

a first ink head that injects the first ink to a recording medium;

a first inlet flow channel includes one end connected to the first ink tank;

a first upstream flow channel that is connected to the first ink head so as to supply the first ink to the first ink head;

a first connection flow channel that couples the first inlet flow channel and the first upstream flow channel;

a first downstream flow channel that includes a first end connected to the first ink head and a second end connected to the first connection flow channel;

a first upstream pump that is provided in the first upstream flow channel so as to supply the first ink to the first ink head;

a first downstream pump that is provided in the first downstream flow channel so that the first ink in the first ink head flows out of the first ink head;

a first upstream damper provided in the first upstream flow channel so as to be positioned closer to the first ink head than the first upstream pump; and a first downstream damper that is provided in the first downstream flow channel so as to be positioned closer to the first ink head than the first downstream pump;

the second ink supply mechanism includes:

a second ink tank in which the second ink is stored;

a second ink head that injects the second ink to a recording medium;

a second inlet flow channel that includes one end connected to the second ink tank;

a second upstream flow channel that is connected to the second ink head so as to supply the second ink to the second ink head;

a second connection flow channel that couples the second inlet flow channel and the second upstream flow channel;

a second downstream flow channel that includes a first end connected to the second ink head and a second end connected to the second connection flow channel;

a second upstream pump that is provided in the second upstream flow channel so as to supply the second ink to the second ink head;

a second downstream pump that is provided in the second downstream flow channel so that the second ink in the second ink head flows out of the second ink head;

a second upstream damper that is provided in the second upstream flow channel so as to be positioned closer to the second ink head than the second upstream pump; and a second downstream damper that is provided in the second downstream flow channel so as to be positioned closer to the second ink head than the second downstream pump; wherein the first valve of the inlet valve opening/closing mechanism is provided in the first inlet flow channel; and the second valve of the inlet valve opening/closing mechanism is provided in the second inlet flow channel.

8. The ink supply system according to claim 7, further comprising:

a controller that controls the rotating mechanism of the inlet valve opening/closing mechanism, the first upstream pump, the first downstream pump, the second upstream pump, and the second downstream pump; wherein the controller includes a print control processor that controls the rotating mechanism of the inlet valve opening/closing mechanism so that the rotating positions of the first and second cams of the inlet valve opening/closing mechanism are at the first position during printing and performs control so that the first upstream pump, the first downstream pump, the second upstream pump, and the second downstream pump are driven.

9. The ink supply system according to claim 7, further comprising:

an outlet valve opening/closing mechanism including another one of the valve opening/closing mechanism; wherein the first ink supply mechanism includes a first outlet flow channel including a first end connected to the first connection flow channel and a second end connected to a first waste tank;

the second ink supply mechanism includes a second outlet flow channel including a first end connected to the second connection flow channel and a second end connected to a second waste tank;

the first valve of the outlet valve opening/closing mechanism is provided in the first outlet flow channel;

the second valve of the outlet valve opening/closing mechanism is provided in the second outlet flow channel; and the controller includes a print standby control processor that controls the rotating mechanism of the inlet valve opening/closing mechanism so that the rotating positions of the first and second cams of the inlet valve opening/closing mechanism are at the second position in a print standby state, controls the rotating mechanism of the outlet valve opening/closing mechanism so that the rotating positions of the first and second cams of the outlet valve opening/closing mechanism are at the second position, and performs control so that the first upstream pump, the first downstream pump, the second upstream pump, and the second downstream pump are stopped.

10. The ink supply system according to claim 9, wherein the controller includes a purge control processor that controls the rotating mechanism of the inlet valve opening/closing mechanism so that the rotating positions of the first and second cams of the inlet valve opening/closing mechanism are at the first position, controls the rotating mechanism of the outlet valve opening/closing mechanism so that the rotating positions of the first and second cams of the outlet valve opening/closing mechanism are at the second position, and performs control so that one of the first and second upstream pumps is driven, the other of the first and second upstream pumps is stopped, and the first and second downstream pumps are stopped or a flow rate thereof is decreased.

11. The ink supply system according to claim 9, wherein the first ink supply mechanism includes a first outlet pump provided in the first outlet flow channel so as to be positioned closer to the first waste tank than the first valve of the outlet valve opening/closing mechanism; and the second ink supply mechanism includes a second outlet pump provided in the second outlet flow channel so as to be positioned closer to the second waste tank than the second valve of the outlet valve opening/closing mechanism.

12. The ink supply system according to claim 11, wherein the controller includes:

a first of a plurality of ink discharge control processors that controls the rotating mechanism of the inlet valve opening/closing mechanism so that the rotating positions of the first and second cams of the inlet valve opening/closing mechanism are at the first position in a state in which the first ink tank is detached from the first inlet flow channel, controls the rotating mechanism of the outlet valve opening/closing mechanism so that the rotating positions of the first and second cams of the outlet valve opening/closing mechanism are at the third position, and performs control so that the first upstream pump and the first downstream pump are stopped and the first outlet pump is driven; and a second of the plurality of first ink discharge control processors that controls the rotating mechanism of the inlet valve opening/closing mechanism so that the rotating positions of the first and second cams of the inlet valve opening/closing mechanism are at the second position and performs control so that the first upstream pump and the first downstream pump are driven after the control by the first of first ink discharge control processor is performed;

a first of a plurality of second ink discharge control processors that controls the rotating mechanism of the inlet valve opening/closing mechanism so that the rotating positions of the first and second cams of the inlet valve opening/closing mechanism are at the first position in a state in which the second ink tank is detached from the second inlet flow channel, controls the rotating mechanism of the outlet valve opening/closing mechanism so that the rotating positions of the first and second cams of the outlet valve opening/closing mechanism are at the fourth position, and performs control so that the second upstream pump and the second downstream pump are stopped and the second outlet pump is driven; and a second of the plurality of second ink discharge control processors that controls the rotating mechanism of the inlet valve opening/closing mechanism so that the rotating positions of the first and second cams of the inlet valve opening/closing mechanism are at the second position and performs control so that the second upstream pump and the second downstream pump are driven after the control by the first of second ink discharge control processor is performed.

13. The ink supply system according to claim 11, wherein the first ink supply mechanism includes a first air trap including a first air storing section in which air in the first ink is trapped and a first discharge mechanism that discharges the air trapped in the first air storing section to be discharged to the first waste tank, the first air trap being provided in the first connection flow channel; and the second ink supply mechanism includes a second air trap including a second air storing section in which air in the second ink is trapped and a second discharge mechanism that discharges the air trapped in the second air storing section to be discharged to the second waste tank, the second air trap being provided in the second connection flow channel.

14. The ink supply system according to claim 13, wherein the controller includes:

a first air discharge control processor that controls the rotating mechanism of the inlet valve opening/closing mechanism so that the rotating positions of the first and second cams of the inlet valve opening/closing mechanism are at the first or second position, controls the rotating mechanism of the outlet valve opening/closing mechanism so that the rotating positions of the first and second cams of the outlet valve opening/closing mechanism are at the third position, and performs control so that the first upstream pump and the first downstream pump are stopped, the first outlet pump is driven, and the first discharge mechanism of the first air trap is driven; and a second air discharge control processor that controls the rotating mechanism of the inlet valve opening/closing mechanism so that the rotating positions of the first and second cams of the inlet valve opening/closing mechanism are at the first or second position, controls the rotating mechanism of the outlet valve opening/closing mechanism so that the rotating positions of the first and second cams of the outlet valve opening/closing mechanism are at the fourth position, and performs control so that the second upstream pump and the second downstream pump are stopped, the second outlet pump is driven, and the second discharge mechanism of the second air trap is driven.

15. The ink supply system according to claim 13, wherein the controller includes:

a first of a plurality of first ink filling control processors that controls the rotating mechanism of the inlet valve opening/closing mechanism so that the rotating positions of the first and second cams of the inlet valve opening/closing mechanism are at the first position, controls the rotating mechanism of the outlet valve opening/closing mechanism so that the rotating positions of the first and second cams of the outlet valve opening/closing mechanism are at the second position, and performs control so that the first upstream pump is driven, the first downstream pump is stopped, and the first discharge mechanism of the first air trap is stopped;

a second of the plurality of first ink filling control processors that controls the first upstream pump so that the first upstream pump is stopped after the control by the first of first ink filling control processor is performed;

a third of the plurality of first ink filling control processors that performs control so that the first upstream pump and the first downstream pump are driven after the control by the second of first ink filling control processor is performed;

a fourth of the plurality of first ink filling control processors that controls the rotating mechanism of the outlet valve opening/closing mechanism so that the rotating positions of the first and second cams of the outlet valve opening/closing mechanism are at the third position and performs control so that the first upstream pump and the first downstream pump are stopped, the first discharge mechanism of the first air trap is driven, and the first outlet pump is driven after the control by the third of first ink filling control processor is performed;

a first of a plurality of second ink filling control processors that controls the rotating mechanism of the inlet valve opening/closing mechanism so that the rotating positions of the first and second cams of the inlet valve opening/closing mechanism are at the first position, controls the rotating mechanism of the outlet valve opening/closing mechanism so that the rotating positions of the first and second cams of the outlet valve opening/closing mechanism are at the second position, and performs control so that the second upstream pump is driven, the second downstream pump is stopped, and the second discharge mechanism of the second air trap is stopped;

a second of the plurality of second ink filling control processors that performs controls on the second upstream pump so that the second upstream pump is stopped after the control by the first of second ink filling control processor is performed;

a third of the plurality of second ink filling control processors that performs control so that the second upstream pump and the second downstream pump are driven after the control by the second of second ink filling control processor is performed; and a fourth of the plurality of second ink filling control processors that controls the rotating mechanism of the outlet valve opening/closing mechanism so that the rotating positions of the first and second cams of the outlet valve opening/closing mechanism are at the fourth position and performs control so that the second upstream pump and the second downstream pump are stopped, the second discharge mechanism of the second air trap is driven, and the second outlet pump is driven after the control by the third of second ink filling control processor is performed.

16. An ink jet printer comprising:

the ink supply system according to claim 7; and a platen on which a recording medium is placed.

* * * * *